US007624461B2

(12) United States Patent
Tidwell et al.

(10) Patent No.: US 7,624,461 B2
(45) **Date of Patent: *Dec. 1, 2009**

(54) SUPPORT PILLOW AND COVER WITH MAT AND METHODS FOR USING

(75) Inventors: Kristin A. Tidwell, Denver, CO (US); Susan Matthews Brown, Golden, CO (US)

(73) Assignee: The Boppy Company, LLC, Golden, CO (US)

( * ) Notice: Subject to any disclaimer, the term of this patent is extended or adjusted under 35 U.S.C. 154(b) by 276 days.

This patent is subject to a terminal disclaimer.

(21) Appl. No.: 11/623,645

(22) Filed: Jan. 16, 2007

(65) Prior Publication Data

US 2007/0192961 A1 Aug. 23, 2007

Related U.S. Application Data

(63) Continuation-in-part of application No. 11/112,142, filed on Apr. 22, 2005, now Pat. No. 7,290,303, which is a continuation-in-part of application No. 11/015,708, filed on Dec. 17, 2004, now Pat. No. 7,146,663, and a continuation-in-part of application No. 09/802,097, filed on Mar. 8, 2001, now abandoned, said application No. 11/015,708 is a continuation of application No. 10/789,784, filed on Feb. 27, 2004, now Pat. No. 7,000,274, said application No. 10/789,784 is a continuation-in-part of application No. 10/638,058, filed on Aug. 7, 2003, now Pat. No. 6,851,143, which is a continuation of application No. 10/241,504, filed on Sep. 10, 2002, now Pat. No. 6,625,828, which is a continuation of application No. 09/802,310, filed on Mar. 8, 2001, now Pat. No. 6,453,493, said application No. 09/802,097 is a continuation-in-part of application No. 09/679,139, filed on Oct. 3, 2000, now abandoned.

(51) Int. Cl.
*A47G 9/10* (2006.01)
*A61G 7/065* (2006.01)

(52) U.S. Cl. ..... 5/655; 5/656; 5/657

(58) Field of Classification Search ..... 5/655, 5/640, 657, 630, 632, 419, 653, 656, 490
See application file for complete search history.

(56) References Cited

U.S. PATENT DOCUMENTS 1,212,515 A 1/1917 Leavitt (Continued)

FOREIGN PATENT DOCUMENTS

| | | |
|---|---|---|
| FR | 2379268 | 9/1978 |
| GB | 1508809 | 4/1978 |
| WO | WO 94/09689 | 5/1994 |
| WO | WO 98/58569 | 12/1998 |

OTHER PUBLICATIONS

Kids II Play to Learn Toys, Discovery Bug Play Gym, Model 897, Alpharetta, GA, 1999.
The Right Start Website, http://www.rightstart.com/baby/home/default.clm?Site=baby, Sep. 29, 2000.
Tiny Love Soft Developmental Toys, Gymini 3-D Activity Gym, Huntington Beach, CA.
Toys 'R' Us catalog, It's Baby Safety Month, Sep. 5-7, 2000.

*Primary Examiner*—Michael Trettel
(74) *Attorney, Agent, or Firm*—Townsend and Townsend and Crew, LLP

(57) ABSTRACT

A support pillow is disclosed which may include a cushion body, a cover and a mat. The cushion body may have a medial region and two opposing arms that define a generally open well, with the cushion body possibly having an outer periphery and an inner periphery adjacent the well. The cover may be disposed over the cushion body such that the cover may conform generally to the shape of the cushion body. The mat may be coupled with at least one of the cushion body and the cover.

20 Claims, 39 Drawing Sheets

U.S. PATENT DOCUMENTS 1,898,272 A 2/1933 Stern
2,078,022 A 4/1937 Roemer
2,379,340 A 6/1945 Corbett
2,522,120 A * 9/1950 Kaskey et al. ..... 5/636
2,561,931 A 7/1951 Kleiser
2,994,889 A 8/1961 Oblander
3,312,987 A 4/1967 Emery
3,378,948 A 4/1968 Gervaise
4,197,604 A 4/1980 Nakamura
4,236,264 A 12/1980 Britzman
4,345,347 A 8/1982 Kantor
4,574,412 A * 3/1986 Smith ..... 5/632
4,731,890 A 3/1988 Roberts
4,914,765 A 4/1990 Smith
5,103,514 A 4/1992 Leach
D328,683 S * 8/1992 Kalozdi ..... D6/601
5,148,564 A 9/1992 Reder
5,154,649 A 10/1992 Pender
5,184,362 A 2/1993 Yager et al.
5,193,235 A 3/1993 Kircher
5,207,791 A 5/1993 Scherbarth
5,261,134 A 11/1993 Matthews
D359,869 S 7/1995 Oren
5,519,906 A 5/1996 Fanto-Chan
5,546,620 A 8/1996 Matthews
5,581,833 A 12/1996 Zenoff
5,586,351 A * 12/1996 Ive ..... 5/655
5,661,861 A 9/1997 Matthews
5,778,468 A 7/1998 Saarela et al.
5,930,854 A 8/1999 O'Neill et al.
5,940,909 A 8/1999 Sapp
5,979,981 A * 11/1999 Dunne et al. ..... 297/219.12
6,038,720 A 3/2000 Matthews et al.
6,052,848 A 4/2000 Kelly
6,055,687 A 5/2000 Matthews
6,061,854 A 5/2000 Crowley
6,119,873 A 9/2000 Matthews
6,230,349 B1 5/2001 Silver et al.
6,233,767 B1 5/2001 Horowitz
6,354,665 B1 3/2002 Ross
6,453,493 B1 9/2002 Matthews Brown
6,499,165 B1 12/2002 Morgillo
6,625,828 B2 9/2003 Matthews Brown
6,810,545 B1 11/2004 Darling et al.
6,851,143 B2 2/2005 Matthews Brown
7,000,274 B2 2/2006 Matthews Brown et al.
7,146,663 B2 12/2006 Brown et al.
D550,017 S * 9/2007 Boutin ..... D6/595
D553,411 S * 10/2007 Boutin ..... D6/595
7,290,303 B2 11/2007 Mead et al.
2002/0042953 A1 4/2002 Matthews Brown
2006/0207029 A1 * 9/2006 Bell ..... 5/655

* cited by examiner

FIG. 3
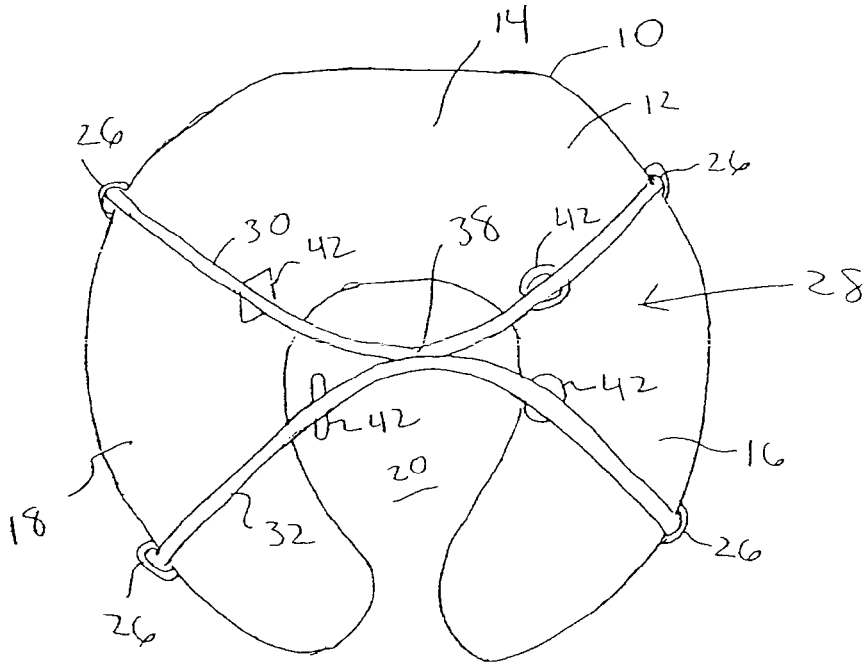
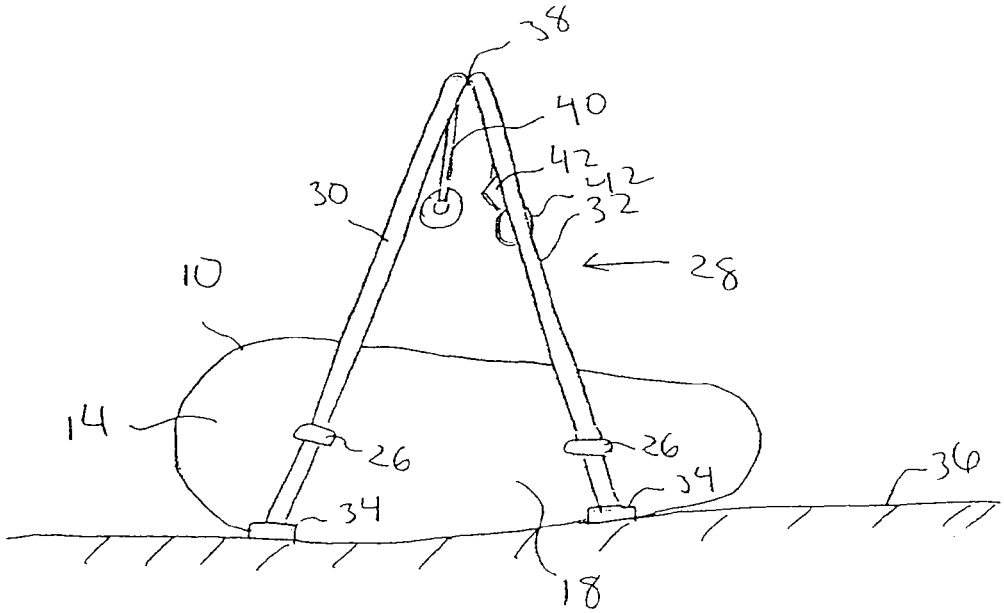
FIG. 4

Fig. 12
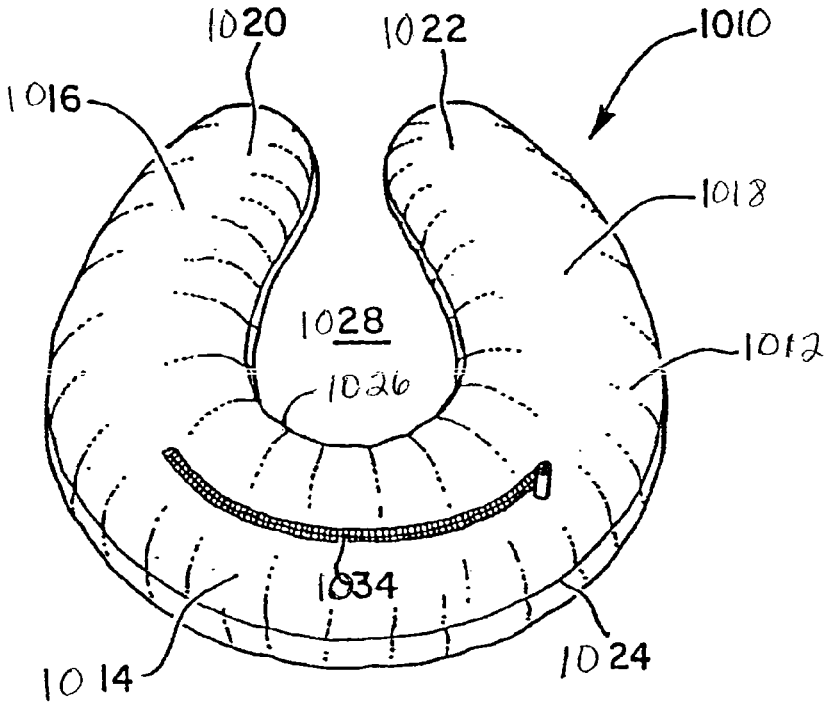
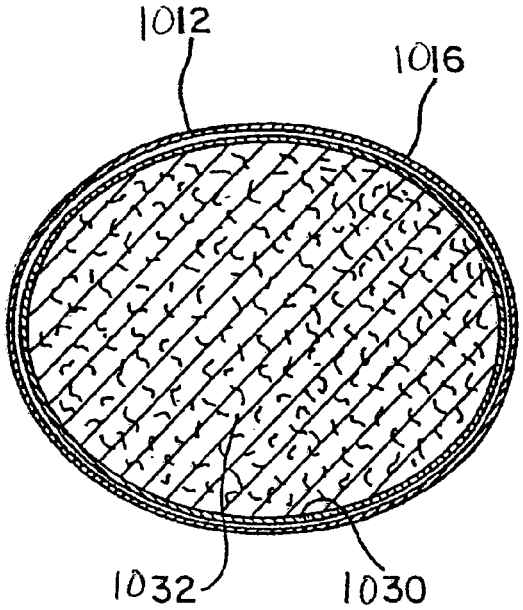
Fig. 13

Fig. 18
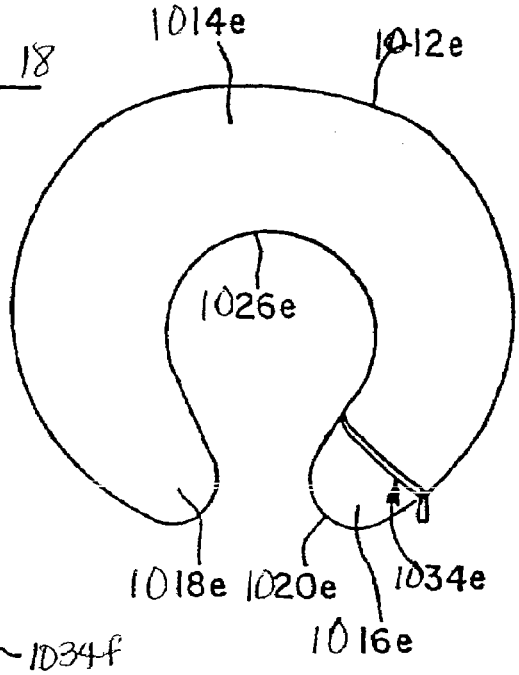
Fig. 19
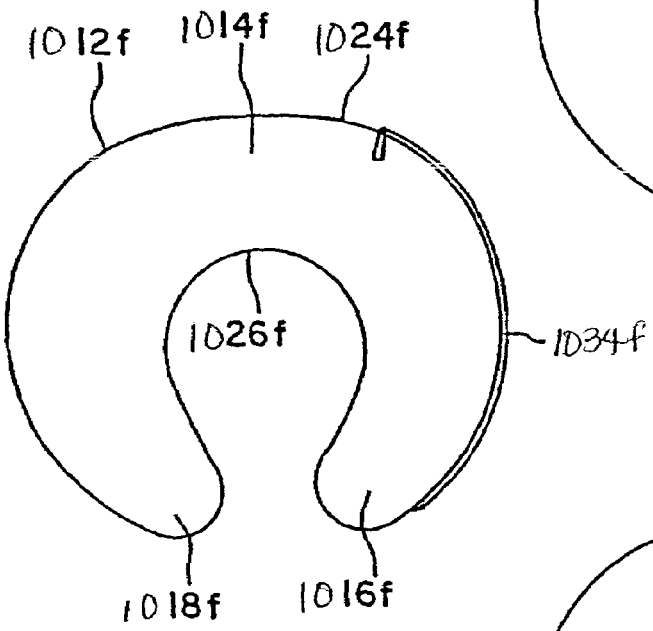
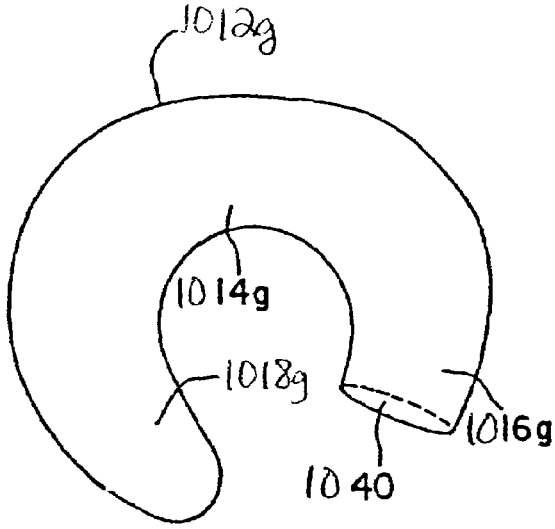
Fig. 20A
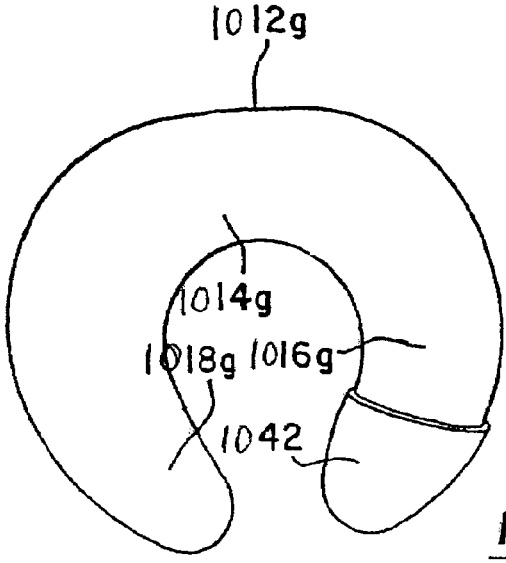
Fig. 20B

SUPPORT PILLOW AND COVER WITH MAT AND METHODS FOR USING

CROSS REFERENCE TO RELATED APPLICATIONS

This application is a continuation-in-part of U.S. application Ser. No. 11/112,142, filed Apr. 22, 2005, which is a continuation of U.S. application Ser. No. 11/015,708, filed Dec. 17, 2004 (now U.S. Pat. No. 7,146,663), which is a continuation application of U.S. application Ser. No. 10/789,784, filed Feb. 27, 2004 (now U.S. Pat. No. 7,000,274), which is a continuation-in-part application of U.S. application Ser. No. 10/638,058, filed Aug. 7, 2003 (now U.S. Pat. No. 6,851,143), which is a continuation application of U.S. application Ser. No. 10/241,504, filed Sep. 10, 2002 (now U.S. Pat. No. 6,625,828), which is a continuation application of U.S. application Ser. No. 09/802,310, filed Mar. 8, 2001 (now U.S. Pat. No. 6,453,493), the complete disclosures of which are herein incorporated by reference.

U.S. application Ser. No. 11/112,142 (discussed above) is also a continuation-in-part of U.S. application Ser. No. 09/802,097 (now abandoned), filed Mar. 8, 2001, which is a continuation-in-part application of U.S. application Ser. No. 09/679,139, filed Oct. 3, 2000, the complete disclosures of which are herein incorporated by reference.

BACKGROUND OF THE INVENTION

This invention relates generally to the field of support pillows, and in particular to covers for support pillows and play bars for support pillows. In one aspect, the invention relates to removable covers for support pillows so that a single support pillow can be modified simply by substituting one cover with another cover. In another aspect, bars are provided for suspending articles above support pillows.

Infants and small children often need to be entertained, pacified or simply distracted. Fortunately, this may be done in such a manner so as to improve physical coordination, to help improve motor skills, or to facilitate educational development. One such way to entertain a small child is by lying the child down and permitting the child to play with one or more toys. However, if the child is unable to move around or hold a toy, it is difficult to keep the child entertained without adult supervision.

Support pillows have gained widespread acceptance in a variety of applications. For example, support pillows are now commonly used to support infants and babies in certain positions. Support pillows are also used to provide back support, to facilitate nursing, to support objection in front of a person, and the like. Such uses are described in, for example, U.S. Pat. Nos. 5,261,134; 5,661,861; 6,038,720; 6,055,687; 6,119,873; and 5,546,620, the complete disclosures of which are herein incorporated by reference.

Some support pillows are constructed of a filler material that is stuffed into a fabric shell. This shell may be completely closed, such as with a sewn seam, to prevent the filler material from inadvertently being removed. The fabric shell may be decorated with a variety of colors and/or patterns.

This invention is related to covers for these and other types of support pillows so that the decorative and/or utilitarian functionally of such pillows may to easily be varied. In some cases, such support pillows may also be used to support various articles as described more fully below.

SUMMARY OF THE INVENTION

In one aspect, the invention provides exemplary covers for support pillows and methods for their use. With such covers, a single support pillow can be modified to have different colors, designs, textures, or the like as well as different utilitarian functions.

In one embodiment, the covers are useful with a cushion body having a medial region and two opposing arms that define a generally open well. The cushion body further includes an outer periphery and an inner periphery adjacent the well, with each of the arms terminating in an end. A shell encompasses and in some cases tightly conforms to the cushion body. With such support pillows, the fabric cover may be constructed so that it may be placed over the shell, with the fabric cover generally conforming to the shape of the pillow body. To facilitate placement of the cover over the pillow, the fabric cover includes an opening into which the pillow may be inserted. The opening in some embodiments may be defined by a seam where the fabric is separated. In one aspect, at least one fastener is provided to close the opening once the cover has been placed over the shell. In this way, a support pillow may be modified simply by inserting the pillow into the opening of the cover and then operating the fastener to close the opening.

The opening may be positioned at a wide variety of locations on the cover. For example, the opening may be located along the outer or inner periphery at the medial region, along the inner periphery on one of the arms, along the outer periphery on one of the arms, across the medial region, along one of the ends, or across one of the arms. In one aspect, the fabric cover may comprise a curved tubular member having two ends, where one of the ends is closed and one of the ends is open to define the opening. Such a cover further includes an end flap to cover the opening, and the fastener is used to couple the end flap to the tubular member.

In another aspect, the cushion body is constructed of a fill material that is compressed or held within the shell. For example, polymer fibers, beads or other fill materials may be held within the interior. In a further aspect, the shell is constructed of a fabric. In some cases, the cover may have a fabric with different colors, textures and/or patterns on each side. In this way, the cover may be reversed to display the other side of the cover. In other cases, different fabrics may be placed on each side.

A variety of fasteners may be used to close the opening. For example, the fastener may comprise a zipper, a hook and loop fastener material, ties, buttons, buckles, snaps, hooks or the like. In one optional aspect, at least one peripheral item may be attached to the cover to vary the utility of the pillow. Conveniently, an attachment mechanism may be used to attach the peripheral item to the cover. Merely by way of example, the peripheral item may comprise a toy and the attachment mechanism may comprise a strap or loop. The peripheral item may also comprise toy bars from which toys may be hung above the pillow. As another example, the peripheral item may comprise a head of a figure, such as an animal head. Other items that may be attached to the cover include handles, pockets, appliqués, ties, blankets, bladders, padding layers, and the like.

The invention also provides a method for covering a support pillow that is similar to the support pillows described above. The method further utilizes a cover that is formed from a curved tubular member having an open interior. According to the method, a fastener on the cover is operated to form or expose an opening in the tubular member to provide access to the interior. The support pillow is placed into the interior of the cover through the opening and the cover is manipulated so that the cover covers the shell and generally conforms to the shape of the support pillow. The fastener is then operated to close or cover the opening.

By using such a cover, the fastener may be operated to reform or re-expose the opening, and the cover may be removed from the support pillow. Another cover may then be placed over the support pillow in a similar manner.

A variety of techniques may be used to form the opening. For example, a zipper may be unzipped, a flap may be removed from the cover, or the like. Other examples of fasteners include buttons, snaps, hooks, ties, a hook and loop fastener material and the like. In another aspect, a peripheral item may be attached to the cover. For example, the peripheral item may comprise a toy or a toy bar that may be attached by use of a strap that is attached to the cover. In a further aspect, the opening may be formed across the medial region, along one of the arms, along one of the ends, along the outer or inner periphery, or the like.

The invention also provides kits and techniques for presenting items, such as toys, to infants or small children. In one embodiment, such a kit includes a pillow having a pillow body and at least one attachment mechanism that is connected to the pillow. The kit also includes at least one bar that may be positioned over the pillow, with the attachment mechanism being used to attach the pillow to the bar. In this way, the bar may remain positioned over the pillow when in use. The bar also includes at least one coupling mechanism to permit one or more toys to be coupled to the bar. In this manner, the toys may be suspended over the pillow to permit a child to lie on the pillow and to reach up and play with the toys.

In one particular aspect, the kit is configured so that the position of the bar may be vertically adjusted so as to position the height of the bar relative to the pillow. One way for accomplishing this is to provide pairs of vertically spaced apart attachment points on the pillow to which ends of the play bar may be coupled. To adjust the height, the play bar may be moved from a lower set of attachment points and coupled to an upper set of attachment points. Also, wide variety of connectors may be used to couple the ends of the bar to the attachment points, such as by clips, links, ties, chains, and the like. Further, a variety of attachment points may be used, such as loops, ties, and the like. As an alternative to using spaced apart attachment points, other adjustment systems that may be used include the use of telescoping poles, spaced apart pockets on the pillow, different sizes of play bars, and the like.

In some embodiments, the kits may also include a mat that is placed onto a surface, with the pillow body resting on the mat. The bar may then be coupled to the pillow body and/or the mat. The mat may be either integrally attached to the pillow body or be removably attached to the pillow body.

In one aspect, the pillow has a medial region and two opposing arms that define a generally open well. Such a configuration permits a baby to be placed within the well, with the baby's head resting on the medial region. In this way, the medial region provides a comfortable support for the baby's head as well as "propping up" the baby so that the baby may easily reach the suspended toys. Further, the two arms prevent the baby from rolling from side to side so that the toys will remain suspended over the baby. When used with the mat, the baby's body may rest upon the mat. For example, the mat may be configured to extend across the well and beyond that opposing arms. In this way, the baby may lie within the well and rest on the mat, rather than directly on the floor.

The bar may include two or more ends that may be placed onto a surface onto which the pillow also rests to hold the bar over the pillow. The attachment mechanisms may be coupled to the bar at or just above the ends so that a middle section of the bar is free to suspend the toys. The bar may be fashioned into a variety of shapes. For example, the bar may be curved over the pillow. Further, multiple bars may be used to increase the number of toys that may be suspended. Merely by way of example, two bars may be used that each have a pair of ends. The four ends of the bars extend around the periphery of the pillow to help hold the pillow beneath the bars. For instance, two of the ends may be positioned near the free ends of the opposing arms while the other two ends are positioned near where the arms are joined to the medial region. However, it will be appreciated that other arrangements are possible particularly depending on the numbers of bars and/or ends of the bars.

A variety of attachment mechanisms may be used to attach the pillow to the bars. For example, a loop of fabric or other material that is coupled to the pillow body may be used. With such a configuration, the ends of the bars may simply be slid through the loops. Other attachment mechanisms include fabric or other strips having snaps, a hook and loop fastener material, such as Velcro, or the like. Alternatively, the strips may be tied together. In some cases, the attachment mechanism may be a pocket on the pillow or the mat into which the end of the bar is inserted.

In a similar manner, a variety of coupling mechanisms may be used to couple the toys to the bars. For example, the coupling mechanism may comprise a strip of fabric or other material hanging from the bar. The strip may include a snap or a hook and loop fastener material to permit the strip to be looped around the toy and fastened together.

Instead of providing a pillow with the kit, a pillow cover may alternatively be used. Optionally, a mat may be included that is integrally attached or removably attachable to the cover. In this way, a user already having a pillow may simply place the cover over the pillow and then attach the pillow to the bar. Conveniently, the attachment mechanisms may be coupled to the cover or the mat so that the pillow may easily be attached to the bar once the cover is placed over the pillow. The pillow cover may optionally include a zipper or other fastener to permit the cover to be opened when placing the cover about the pillow. Once in place, the zipper is closed to secure the cover about the pillow.

In use, a child may be placed onto the pillow so that the child is lying face up. The bar may be placed over the child and secured to the pillow. This may be done while the toys are attached to the bar, or afterward. Alternatively, the bar may be placed about the pillow, and the child inserted between the bar and the pillow. Once in place, the toys are suspended over the child's head and chest to permit the child to reach up and play with the toys. If desired, one or more of the toys may be removed and substituted with another toy. Optionally, a mat may be positioned under the pillow so that at least a portion of the child may rest upon the mat.

In another embodiment, a support pillow is provided. The support pillow may include a cushion body, a cover and a mat. The cushion body may have a medial region and two opposing arms that define a generally open well. The cushion body may include a shell and a fill material within the shell. The cover may be removably disposed over the shell of the cushion body such that the cover possibly conforms generally the shape of the cushion body. The mat may be coupled with the cover.

In other embodiments of the invention, various methods of using the support pillows of the invention are provided. In one method, the support pillow may be placed onto a surface, and the mat may be positioned to lie generally flat underneath the cushion body and the well. Moreover, the method may include placing a baby at least partially in the well, possibly with its back facing either toward or away from the mat. In another method of the invention, the pillow may be placed onto a surface, while the mat may be positioned to lie generally flat on the surface and away from the well. Furthermore, the method may include placing a baby at least partially on the mat such that at least one of the baby's head or the baby's torso is supported by the cushion body. Again, the baby's back may, merely by way of example, be facing either generally towards or away from the mat. In another possible method of the invention, the support pillow may be placed such that the cushion body is above the lap of a caregiver, where the waist or lower torso of the caregiver is at least partially within the well defined by the medial region and the arms of the cushion body, with the medial region being on the lap of the caregiver. Moreover, the method may include placing a baby at least partially above the medial region such that at least a portion of the baby's back is generally facing the medial region.

BRIEF DESCRIPTION OF THE DRAWINGS

FIG. 3 illustrates a kit having the pillow of FIG. 1 and a pair of bars that suspend a set of toys over the pillow according to the invention.

FIG. 4 is a side view of the kit of FIG. 3.

FIG. 12 is a perspective view of one embodiment of a support pillow having a removable cover according to the invention.

FIG. 13 is a cross sectional view of the support pillow and cover of FIG. 1.

FIG. 18 is a top view of one particular embodiment of a pillow cover according to the invention.

FIG. 19 is a top view of a further embodiment of a pillow cover according to the invention.

FIG. 20A is a top view of a pillow cover having an open end according to the invention.

FIG. 20B illustrates the cover of FIG. 9A with an end flap to cover the opening.

FIG. 60 is a perspective view of one embodiment of a cover that covers a support pillow, with the cover having attachments along the outer periphery that couple toys to the cover.

DESCRIPTION OF THE SPECIFIC EMBODIMENTS

Figure 1:
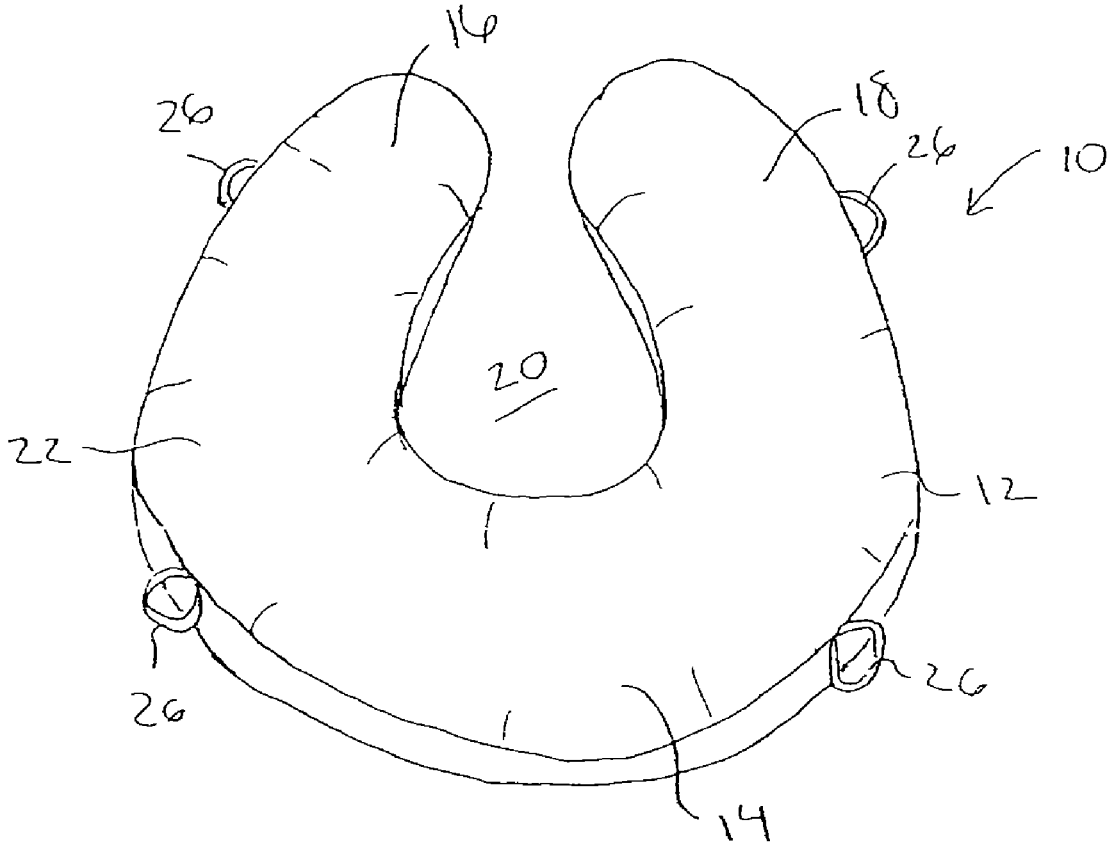
FIG. 1 is a top view of an embodiment of a pillow according to the invention.

In one aspect, the invention provides structures and techniques for suspending objects, such as toys, over infants or small children. Conveniently, the toys may be positioned within the grasp of the child while the child is lying down, inclined or sitting upright. To suspend the objects, the invention utilizes a suspension system or other type of structure from which one or more objects may be suspended. The suspension system or structure may have at least one end or a base that is configured to rest on a surface or to be mounted to another type of structure. For example, the ends may be mounted to a pillow or a mat disposed beneath the pillow. As another example, the ends of the suspension system may all rest a support surface, or one or more ends may be suspended in air. One way to construct the suspension system is by the use of one or more bars or poles that extend into the air so that objects may be suspended from the bars. The bars may be joined together, may cross each other, or be formed as an integral unit. The bars may be constructed of any material having sufficient rigidity to remain suspended in air. Merely by way of example, types of materials that may be used include metals, plastics, composites, wood, rubbers, and the like.

The bar structure may be configured to be positioned about a perimeter of a pillow or other resilient structure on which the child is to be placed. This arrangement permits the support structure to be appropriately positioned so that objects may be suspended over the pillow. Further, by surrounding the pillow, the support structure helps to prevent movement of the pillow relative to the suspended objects. Optionally, the bar structure may be coupled to the pillow to further prevent movement of the pillow relative to the bar structure.

The suspension system may be configured to suspend the objects at essentially any height relative to the child. For example, the objects may be immediately above the child's head or chest to permit the child to reach up and grasp the objects. Alternatively, the objects may be placed out of reach of the child.

A wide variety of pillows may be used to support and/or to restrain movement of the child. For example, one type of pillow that may be used includes a medial region and two opposing arms that define an open well. Such pillows are described in, for example, U.S. Pat. Nos. 5,261,134; 5,546,620; 5,661,861; and 6,038,720. Other types of pillows that may be used to support the child are described in co-pending U.S. patent application Ser. Nos. 09/662,935, filed Sep. 15, 2000, 10/769,007, filed Jan. 29, 2004, 10/422,067, filed Apr. 28, 2003, 10,612,266, filed Jul. 1, 2003, 10/612,267, filed Jul. 1, 2003, 10/627,542, filed Jul. 25, 2003, and U.S. Pat. No. 6,434,770, issued on Aug. 20, 2002. The complete disclosures of all these references are herein incorporated by reference. Other types of pillows having other shapes and configurations that are known in the art may also be used. One advantage of a pillow having a medial region and two opposing arms is that the arms may be used to restrain the child to limit the child's movement. In this way, the objects may remain appropriately positioned over the child.

In some embodiments, the pillow may be coupled to a mat that is positioned beneath the pillow body. Such a mat may be constructed of a flexible material, such as a fabric. The mat may be integrally or removably coupled to the pillow body. In this way, the child may rest on the mat as well as the pillow body. One non-limiting example of such a mat is described in U.S. Pat. No. 5,546,620, previously incorporated by reference.

In embodiments where the mat is coupled with the cover (whether the cover is removably or non-removably disposed about the cushion body), the mat may be coupled to the cover at a variety of locations. Likewise, in embodiments where the mat is coupled with the cushion body, the mat may be coupled to the cushion body at a variety of locations. The mat may be coupled with at least one of: the top, bottom, ends, or sides of either arm (both interior and exterior to the well) or the medial region. In some embodiments, the mat may be coupled at multiple locations to the cover and/or cushion body. Merely by way of example, the mat may be coupled at both arms, and span the area beneath the well. One or both of the coupling points may be detachably coupled.

The mat may be constructed of any one or combination of materials including, but not limited to, animal textiles (i.e. wool and cashmere), plant textiles (i.e. paper, cotton and hemp), and synthetic textiles (i.e. polyester, acrylic, nylon, olefin, and inego). Fill materials such as those textiles mentioned or other materials such as polymers, plastics and composites may be used between layers of other materials to provided a padded mat construction. The thickness of the mat may be between about ¼ inches and about 2 inches either when uncompressed or compressed (if the mat is compressible).

Natural and synthetic leathers may also be used to at least partial construct the mat. For example, a perimeter seam of the mat may be reinforced with leather. In some embodiments, multiple mats may be provided, where each may be advantageously employed for specific purposes. For example, a water-proof or water-resistant mat, possibly constructed from rubber or plastic, may be provided to allow for cleaning and/or changing a baby's soiled clothing and/or diapers; while a soft fabric mat, possibly made from cotton and/or cashmere, may be used when caring for a baby with the mat. In some embodiments, the mat may be constructed of a material which wicks away moisture from a person or surface which it contacts.

The mat may be of differing shapes and sizes. Multiple sizes may be provided for different size and age babies and caregivers by which the support pillow may be used. In some embodiments, the mat may have a surface area on each side of between about 324 square inches and about 576 square inches. In these or other embodiments, the size and/or shape of the mat may be relative to the size and/or shape of the cushion body. Merely by way of example, the mat may be sized so when coupled underneath the medial region, and positioned under the well, to extend beyond the ends of the arms of the cushion body, and cover the entire bottom of the well. In some embodiments, the mat may include one or more pockets, covering at least some portion of the mat, in which a baby may be inserted for comfort and/or warmth.

Different shaped mats may also be employed. The shape of the mats may be either utilitarian, decorative, or both. Some possible shapes for the mat include, but are not limited to, a rectangle, a square, a circular shape, an oval shape, an hourglass, a polygon, a curved perimeter shape, or a shape of a familiar object or thing such as a vehicle (i.e. car, plane or space ship) or other thing (i.e. rainbow, cat or dog). The mat may be appropriately colored and/or decorated to complete a given aesthetic scheme. In embodiments where the mat is detachably coupled with either the cushion body or the cover, the detachable coupling point may be somewhere on the perimeter of the mat, or possibly at some interior point on the mat.

The mat may be used for various functions, either while attached or detached from the cushion body or cover. The mat may be wrapped around at least a portion of the support pillow to increase the size of a specific are of the support pillow. This may be advantageous when supporting a baby on any part of the support pillow, or when adjusting the size of support pillow for use by different size caregivers. Merely by way of example, a caregiver desiring to place the support pillow about the caregiver's waist may wrap the mat into the well of the support pillow to tighten the fit of the pillow about the waist. In another example, the mat may be bunched up within the well to provide support and stabilization for a baby placed within the well, possibly and especially when the baby is at least somewhat disproportionally smaller than the well. In another example, the mat may be folded multiple times and used to support a portion of a caregiver such as an arm.

In other embodiments, the mat may be used to raise the height of at least a portion of the support pillow. For example, a caregiver may place possibly the mat under or over the medial region when the caregiver is caring for a baby placed on the top or bottom of the medial region. In another example, the mat may be placed below or on top of the medial region to raise the level at which a baby's head or upper torso is being supported when the baby is lying inside or outside the well.

The mat may also be used for other purposes such as covering or wrapping a baby. The mat may also be used by a caregiver to wipe fluids and/or solids from a baby. In some embodiments, the mat may be nominally disposable, and easily replaced by another disposable or non-disposable mat after the original mat becomes soiled.

Conveniently, a suspension system and support pillows may be provided in kit form. In this way, a consumer may purchase a kit having both a pillow and a suspension system. Optionally, one or more objects that are to be suspended may also be provided with the kit. In one option, a kit may be provided having a suspension system and a cover, with or without a mat. In this way, a consumer already having a pillow may simply place the cover over the pillow. The cover may have one or more attachment mechanisms to permit the pillow to be attached to the suspension system.

A variety of attachment mechanisms may be used to attach the pillows and/or mats to the suspension systems. For example, one or more fabric strips, strings or loops may extend from the pillow or mat. These may be placed, wrapped or tied around the bars of the suspension system. Conveniently, snaps, buckles, a hook and loop fasteners material, or the like may also be used in attaching the pillow to the bars. In some cases, the pillow or mat may include one or more pockets into which ends of the bars may be placed. The attachment mechanisms may be coupled to a cover of the pillow or integrally formed with the pillow body.

In embodiments with a suspension system, a wide variety of objects may be suspended over the child. For example, the objects may comprise toys that are educational in design or that are configured to simply entertain or distract the child. For instance, such toys may include: balls, blocks, planes, space ships, vehicles, blocks, numbers, letters, animals, insects, figures and the like. Further, the objects may be constructed of various materials and maybe of different colors.

The objects may be coupled to the suspension system in a variety of ways. For example, coupling mechanisms such as fabric strips, strings, chains and the like may be used. The objects may have a hole, hook, or the like through which the coupling mechanism may be passed, looped or tied. Conveniently, snaps, buckles, hook and loop fastener materials, or the like may be used as coupling mechanisms. The length of the coupling mechanisms may be adjustable to vary the height at which the objects are suspended over the child. The coupling mechanism may even be elastic to permit the object to be grasped and pulled down to the child.

Figure 2:
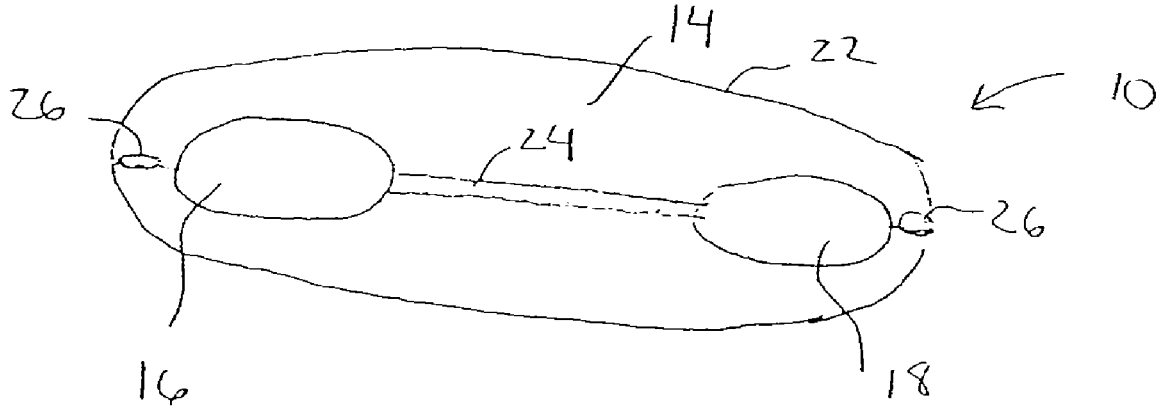
FIG. 2 is a front view of the pillow of FIG. 1.

Referring now to FIG. 1, one embodiment of a support pillow 10 will be described. Pillow 10 is constructed of a pillow body 12 having a medial region 14 and two opposing arms 16 and 18 that define a generally open well 20. Pillow body 12 may be constructed in a manner similar to that described in U.S. Pat. Nos. 5,261,134; 5,546,620; 5,661,861 and 6,038,720, previously incorporated by reference. Pillow 10 conveniently includes a fabric cover 22. As best shown in FIG. 2, cover 22 includes a zipper 24 to permit cover 22 to be opened and closed. In this way, cover 22 may be placed over and removed from pillow body 12.

Sewn to seams of cover 22 are a set of fabric loops 26 that serve as attachment mechanisms for a suspension system 28 as shown in FIG. 3 and FIG. 4. In this way, pillow 10 may be secured to suspension system 28 to prevent relative movement between suspension system 28 and pillow 10. Configuration of cover 22 is advantageous in that suspension system 28 and cover 22 may be sold as a kit so that consumers already having a support pillow need only purchase a cover rather than another pillow. Alternatively, pillow 10 may be constructed to have a non-removable cover having attachment mechanisms. In this way, a kit may be provided both with a suspension system and with a pillow.

Suspension system 28 comprises a pair of curved bars 30 and 32 having ends 34 that rest on a surface 36 along with pillow 10. Ends 34 may be shaped or oversized to help stabilize bars 30 and 32. Bars 30 and 32 are joined together at an apex 38 and are shaped such that loops 26 extend around bars 30 and 32 as shown. Bars 30 and 32 may be placed over pillow 10 and the ends inserted through loops 26. Alternatively, other attachments may be used that are looped or tied around the bars after the bars are in place. Bars 30 and 32 are positioned about pillow 10 so as to provide a large enough opening to place the child onto the pillow and to provide a generally open environment. Hanging from bars 30 and 32 are fabric strips 40. Conveniently, bars 30 and 32 may include holes through which strips 40 are fastened. Coupled to strips 40 are a set of toys 42, including a ball, a ring and a block. However, it will be appreciated that a variety of other objects may be suspended as previously described. Conveniently, strips 40 may include snaps to permit strips 40 to be wrapped around toys 42 and then snapped together. However, a variety of other coupling devices may be used as previously described. Although shown with four toys, it will be appreciated that any number of toys may be suspended. Further, these may be suspended at any height and at any location on bars 30 and 32.

Figure 5:
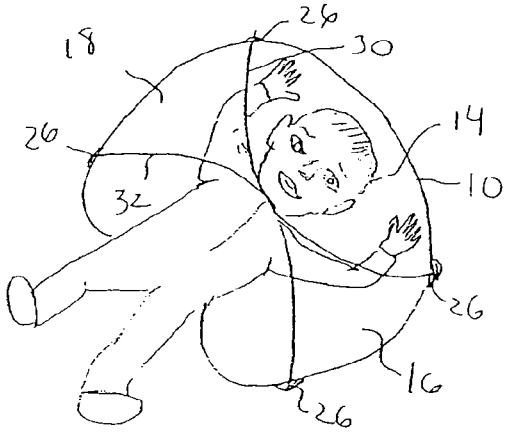
FIG. 5 illustrates a method for using the kit of FIG. 3.

In use, a child may be placed onto pillow 10 as shown in FIG. 5. The child's head is positioned on top of medial region 14 while the torso is received within the open well. In this way, arms 16 and 18 prevent the child from rolling from side to side. At the same time, medial region 14 props the child's head to permit the child to easily see and grasp the toys. If desired, additional padding may be placed under the baby as described in the previously incorporated patent documents. In some cases, the child may be placed in a sitting position within the well, with the toys hanging in front of the child. Other orientations of the child and toys are also possible.

Figure 6:
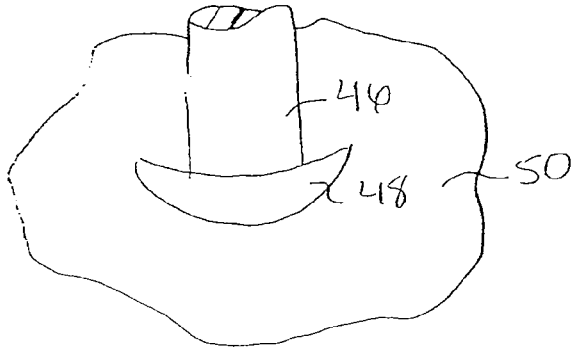
FIG. 6 illustrates an alternative attachment mechanism for attaching a bar to a pillow according to the invention.

Instead of resting the suspension system directly onto a surface, the ends of the bars may be held by the pillow itself. An example of such a configuration is shown in FIG. 6 where a flexible pole 46 is held within a pocket 48 if a cover 50. A similar pocket maybe provided on an opposite side of cover 50, and pole 46 may be flexed and inserted into the pockets. The tension in pole 46 holds the pole in place within the pockets.

Figure 7:
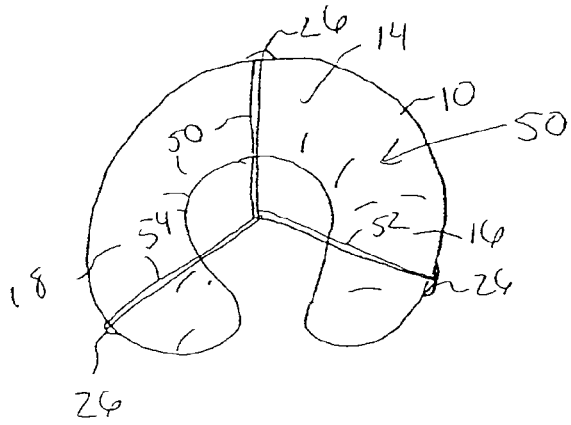
FIG. 7 illustrates an alternative kit for suspending toys over a pillow according to the invention.

The suspension systems of the invention may include other number of bars and/or feet. One example of such a configuration is shown in FIG. 7. In FIG. 7, pillow 10 has been modified to include three loops 26. Used with pillow 10 is a suspension system 50 having three bars 50, 52 and 54 and three ends. One end is adjacent medial region 14 while the other ends are adjacent arms 16 and 18. In this way, an access way is provided to place the child onto pillow 10.

Figure 8:
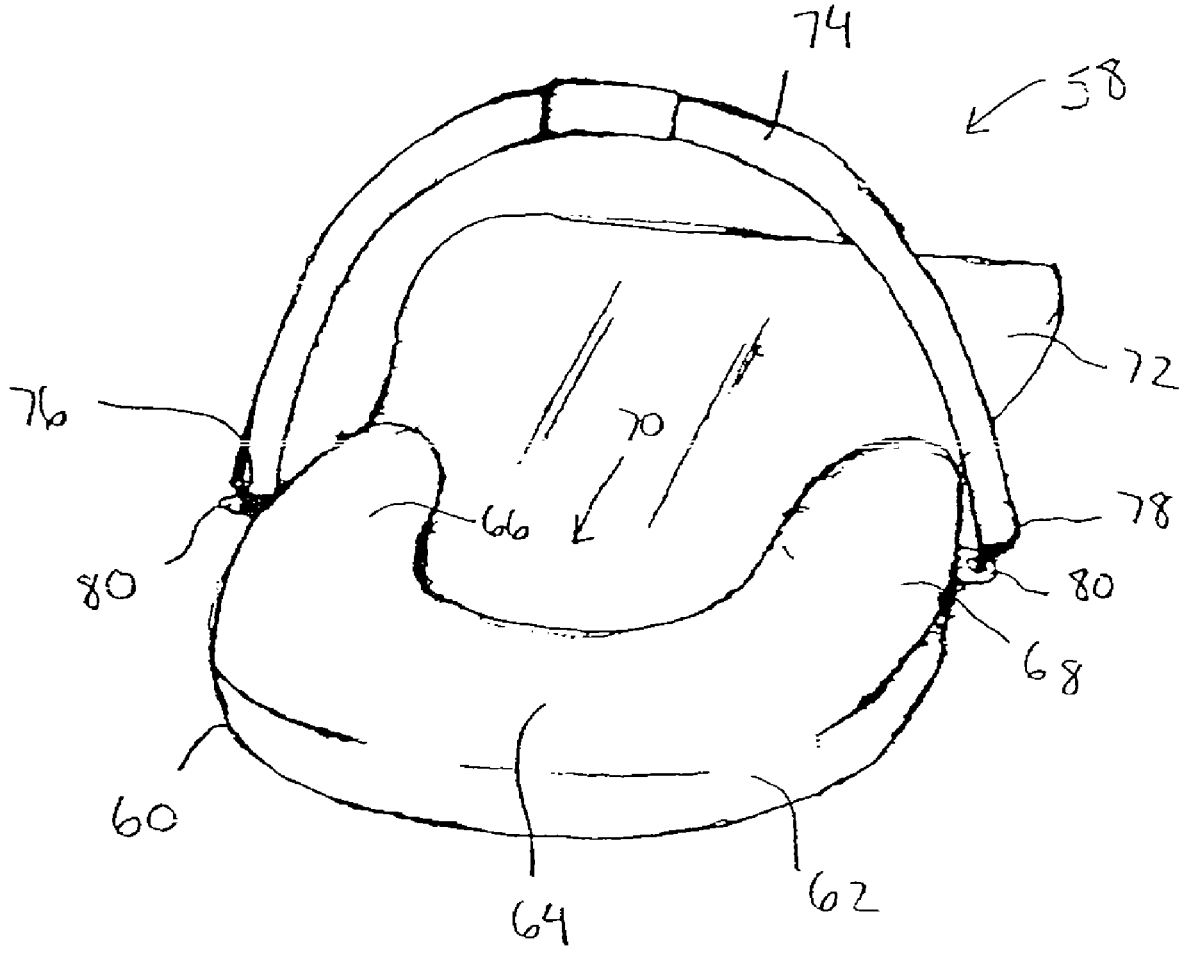
FIG. 8 illustrates another alternative kit for suspending toys according to the invention.

Any of the kits and/or suspension systems may be used with a mat that is positioned beneath the pillow body. One example of such a kit 58 is illustrated in FIG. 8. Kit 58 includes a support pillow 60 that comprises a pillow body 62 having a medial region 64 and two arms 66 and 68 extending from medial region 64. Arms 66 and 68 are generally parallel to each other and are spaced apart to from an open well 70. Disposed beneath pillow body 62 is a mat 72. Arms 66 and 68 are spaced apart to provide a relatively large well 70 so that a child will have additional space to play when resting upon mat 72. Alternatively, arms 66 and 68 could be spaced closer to each other to form a more circular well region.

Shown positioned above pillow 62 is a bar 74 having ends 76 and 78. Bar 74 is configured to be inserted through fabric loops 80 on arms 66 and 68 so that ends 76 and 78 rest upon a support surface, such as a floor. Conveniently, pillow body 62 may include a fabric cover into which loops 80 are coupled. Although shown with fabric loops, it will be appreciated that a wide variety of attachment mechanisms may be used to couple bar 74 to pillow 60, including any of those described with other embodiments. Further, in some cases, attachment mechanism may be provided on mat 72. For instance, mat 72 may include holes or pockets into which ends 76 and 78 are inserted.

Bar 72 may be employed to suspend one or more items above pillow body 62 and/or mat 72. Although not shown various coupling mechanism may be used to suspend these items in a manner similar to that described with other embodiments. Further, different numbers and/or configurations of bars may be used similar to those described with other embodiments.

Mat 72 may be fashioned in a variety of shapes and sizes. As shown, mat 72 extends across well 70 and horizontally beyond arms 66 and 68. In this way, a child may rest and play on pillow body 62 while the rest of the child's body rests on mat 72. Hence, mat 72 may be long enough so that when a child is resting on medial region 64 (or lying within well 70), the child's feet are still on mat 72. As shown, mat 72 has an hour glass shape. However, a variety of other shapes may be used, such as rectangular, scalloped, arcuate, and the like.

Mat 72 may be constructed of essentially any type of material suitable for use with small children, and may be rigid, flexible, padded and the like. For instance, mat 72 may be constructed of a sheet of fabric, which may optionally include padding.

Mat 72 may further be configured to be either integrally attached to pillow body 62 or removable. For example, mat 72 may be sewn to the pillow body 62. Alternatively, various fasteners may be used to removably attach mat 72 to pillow body 62. Such fasteners may include, for example, a hook and loop fastener material, snaps, buttons, and the like. In this way, mat 72 may be removed when desired. In some cases, pillow body 62 may include a removable cover. In this way, mat 72 may be removed from pillow body 62 along with the cover.

The play kits of the invention may utilize various covers that are placed over support pillows. The covers of the invention may be used with a wide variety of support pillows, some of which may have a generally resilient cushion body. The cushion body may be constructed in a variety of ways and of a variety of materials. One way is to stuff a fill material into a flexible shell, such as a fabric tube. Types of fill materials that may be used include fibers, balls, seeds, foamed materials, elastomers and the like. Some examples of such support pillows are described in U.S. Pat. Nos. 5,261,134; 5,661,861; 6,038,720; 6,055,687; 6,119,873; and 5,546,620, incorporated herein by reference. Other types of cushion bodies include inflatable bladders, sponges, and the like.

The support pillows may also have a variety of shapes and sizes. For example, the support pillow may have a horseshoe shape, a "U" shape, a "Y" shape, straight, semi-circular and the like. Shapes for such pillows are also described in U.S. Pat. Nos. 5,261,134; 5,661,861; 6,038,720; 6,055,687; 6,119,873; and 5,546,620, previously incorporated by reference. Such support pillows may include a variety of decorations. For example, such pillows may include a fabric shell having a certain color or pattern.

The covers of the invention are generally flexible and are used to cover the support pillow. The covers may closely or generally conform to the shape of the pillow so that the pillow maintains the same overall appearance. Examples of materials that may be used to construct the cover include fabrics, such as cotton, polyester, nylon and the like, plastics, stretchable materials, such as a mesh fabric, Lycra, and the like. The covers may include one or more openings through which the support pillows are inserted. Conveniently, one or more fasteners may be used to close the opening after the pillow has been inserted. Examples of fasteners that may be used include zippers, a hook and loop fastener material (also know as VELCRO), snaps, buttons, hooks, laces, elastomers, flaps, buckles and the like. In some cases, the covers may include the features described in co-pending U.S. application Ser. Nos. 09/679,139, filed Oct. 3, 2000 and 09/802,097, filed Mar. 8, 2001, the complete disclosures of which are herein incorporated by reference.

The covers may have a wide variety of colors, textures, patterns, designs, thicknesses and the like. In this way, an existing support pillow may have its appearance or feel modified simply by placing a cover over the pillow. Also, in some cases, the cover may be reversible so that one cover may be displayed in two different ways. For example, the cover may be made of one type of fabric, but have sides with different colors, textures, patterns or the like. As another example, different fabrics for each side may be used. For instance, a woven fabric may be used on one side, while a wipeable fabric, such as a vinyl or nylon, may be used on the other side.

In some embodiments, the covers may also include various peripheral items that are attached to the covers. Such items can include, for example, toys, teething rings, educational items, pacifiers, play mats, play bars, electronic items such as sound chips, mirrors, writing surfaces, characters, body parts, such as heads, tails, arms legs, and the like, rattles, pockets and the like. Specific examples include three dimensional characters and/or objects, such as a puppy's head, with paws and tails on ends of the arms, a flower and leaves, a clown head with floppy feet and the like.

Optionally, various attachment mechanisms may be used to attach the peripheral items to the cover. Such attachment mechanisms can include, for example, straps, strings, a hook and loop fastener material, snaps, and the like. Another type of peripheral item is a handle for carrying the support pillow. One example of such a handle is described in U.S. Pat. No. 6,434,770, the complete disclosure of which is herein incorporated by reference. By using such peripheral items, the utility of the pillow may be changed simply by using another cover having a different set of items.

Other features of the cover include various pockets, such as external and internal pockets. These may be used to hold items such as bottles, cloths, accessories, aromatherapy packs, sound or vibration units, padding and the like. Also various appliqués may be used. These include decorations or trimming that is made of a material that is attached by sewing, gluing, or the like to another material. Materials that may be used include velvets and tactile, such as textured rubber. Further, the appliqué may represent an object, such as a flower, animal or the like and may depict a cluster or a scene. Other examples include crinkle materials, squeaking devices, pressure sensitive sound chips, gels, and the like. These may be placed between the surface and the material of the appliqué.

Another feature is one or more ties that may be provided at the ends of the arms to tie the arms together. In this way, the ties may be used to hold a small infant in place. Also a harness, straps or the like may also be used to hold the baby in place. In some cases, a pattern may be provided to permit the consumer to make their own cover. The pattern may define a top piece and a bottom piece that may be sewn together to form the cover. Also, kits may be provided to include an embroidery pattern, a paint-by-number design using fabric paints, and the like.

Some covers may be constructed of a disposable material, such as a mesh, light cloth or the like. In this way, the cover may be discarded when soiled. The covers may also include features such as a chalkboard or other writing surface that can be drawn on with chalk or markers, a blanket, a bladder or other padding that may be used to raise the height of the pillow or provide different and/or additional layers of padding, and the like.

Figure 9:
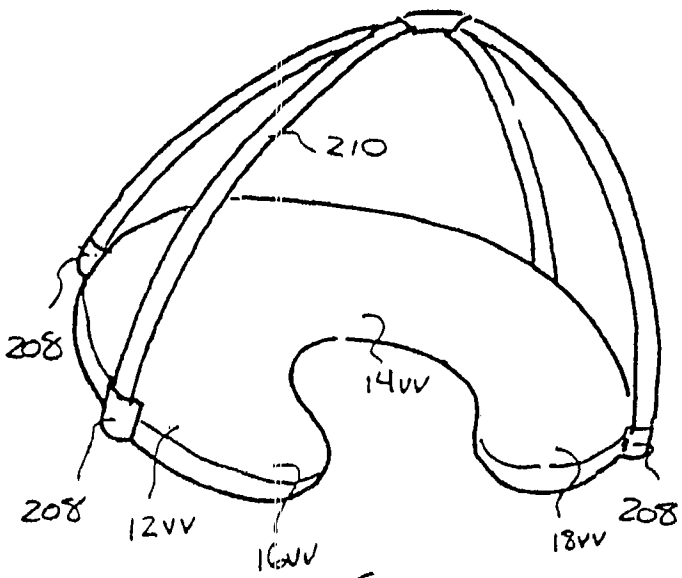
FIG. 9 is a perspective view of one embodiment of a cover that covers a support pillow, with pockets along the outer periphery that couple toy bars to the cover.
Figure 6D:
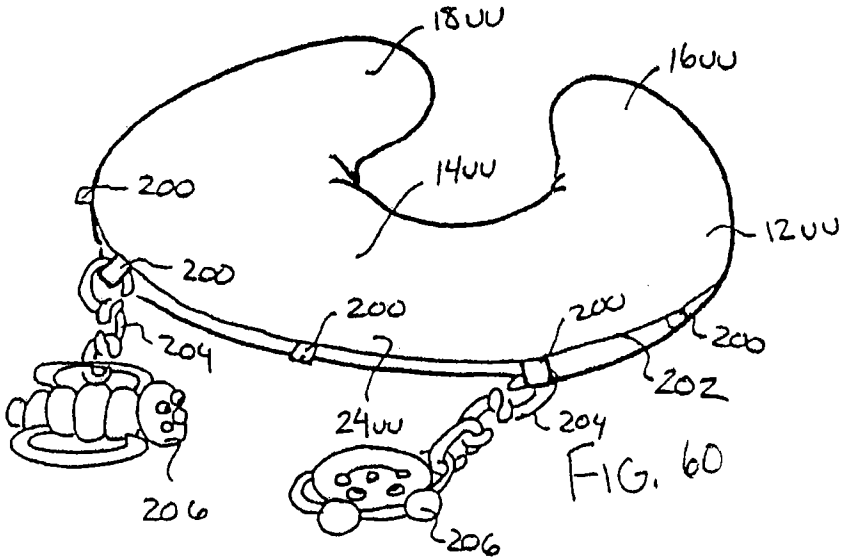
Figure 10:
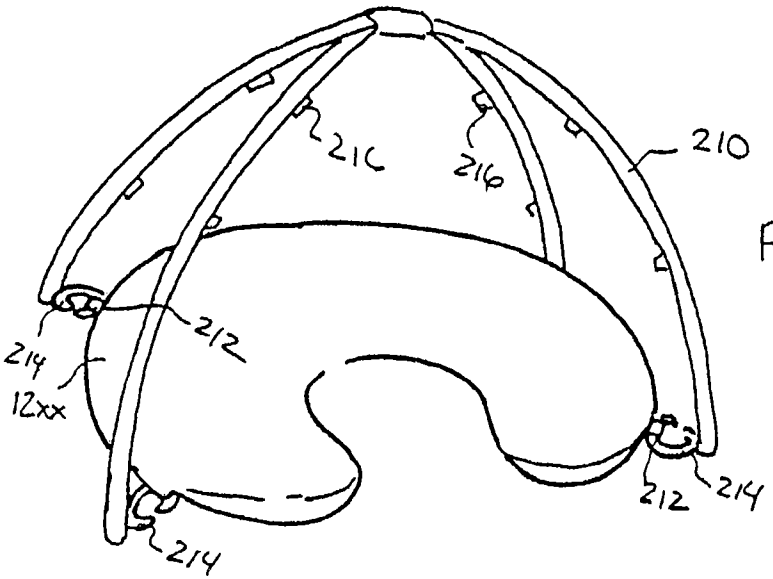
FIG. 10 is a perspective view of another embodiment of a cover that covers a support pillow, with the cover having attachments along the outer periphery that couple toy bars to the cover.

One example of how a cover may be used to support play bars is described in FIGS. 9 and 10. FIG. 9 illustrates a cover 12*vv* covering a pillow. Cover 12*vv* may include an opening and a fastener similar to other embodiments. Cover 12*vv* includes attachments 208 for holding a set of bars 210 above the pillow. Such bars may be similar to the other play bars described herein, and may be used to hang items above the pillow. However, with cover 12*vv*, bars 210 may be coupled to the pillow without directly modifying a pillow. In this way, existing pillows may be retrofit to have bars by simply adding cover 12*vv*. As shown, attachments 208 comprise pockets. However, it will be appreciated that other attachments may be used as well. For example, as shown in FIG. 10, loops 212 connected to clips 214 may be used to connect bars 210 to cover 12*xx*. Also, bars 210 may also include attachments 216 that permit items to hang from bars 210. Other attachments that may be used to couple the bars to the cover include ties, straps, ropes and the like.

Figure 11:
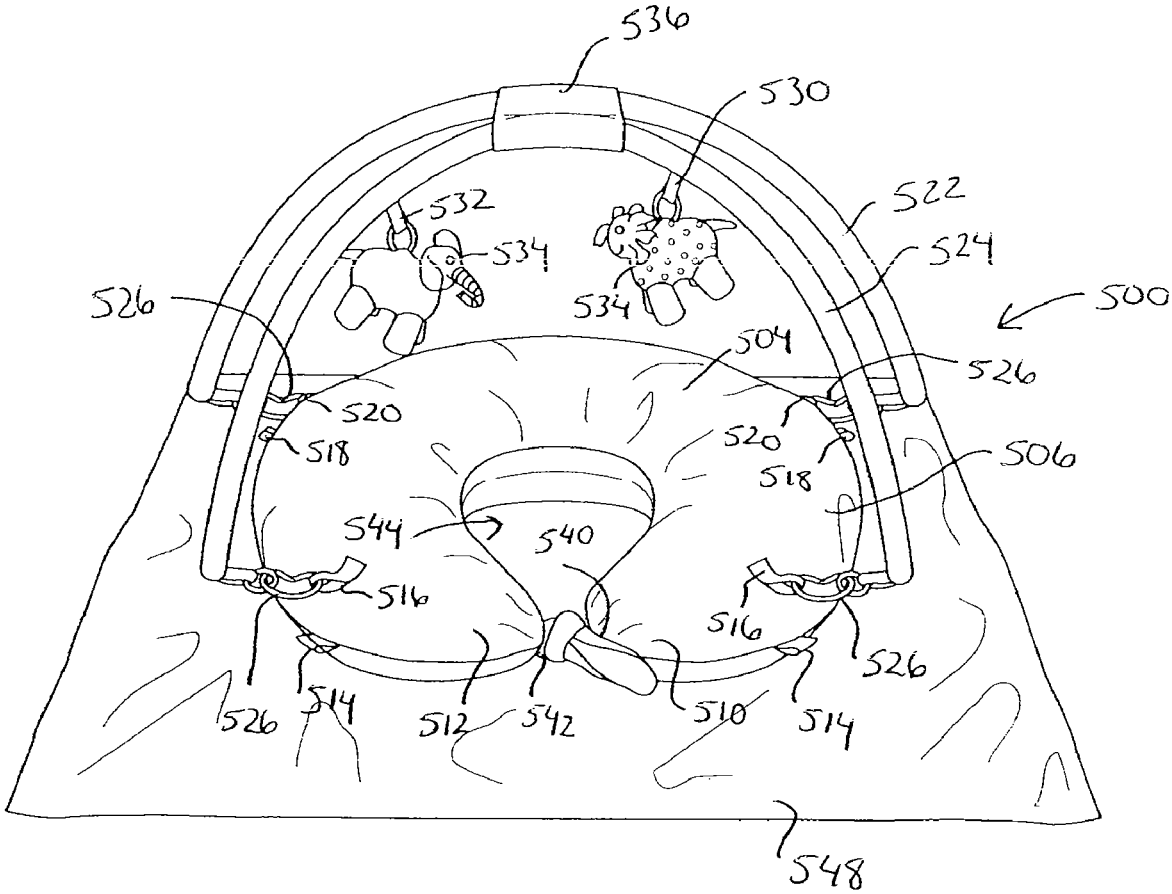
FIG. 11 is a perspective view of a kit having play bars according to one embodiment of the invention.

FIG. 11 illustrates another embodiment of a kit 500 that may be used to suspend toys or other articles above a user consistent with other embodiments described herein. Kit 500 comprises a support pillow 502 having a medial region 504 and two curved arms 506 and 508. Also, pillow 504 includes ends 510 and 512. Support pillow 502 may be constructed to be similar to any of the support pillows described herein and may optionally be provided with a removable cover similar to any of the embodiments described herein.

Support pillow 504 includes four pairs of attachment points 514, 516, 518 and 520. These pairs of attachment points are configured to couple a set of play bars 522 and 524 to pillow 504 in order to suspend various toys or articles over the support pillow. As one option, the attachment points may be part of a removable cover. A connector 526 is used to couple ends of play bars 522 and 524 to the appropriate attachment points. As shown, the attachment points comprise fabric loops that are coupled to an outer perimeter of support pillow 504, while the connectors 526 comprise links that connect the ends of the play bars to the attachment points. Conveniently, each of the play bars 522 and 524 may be covered with a fabric that permits a loop of material to be coupled to each end of the play bars. In this way, the connectors 526 may easily be coupled between ends of the play bars 522 and 524 and the attachment points 514 through 520.

In order to adjust the vertical height of the play bars 522 and 524 relative to support pillow 524, connectors 526 may be removed from the appropriate attachment points and then coupled to another pair of attachment points that are either above or below the attachment points from which the play bars were removed. For example, play bars 522 and 524 are shown as being coupled to the upper set of attachment points, i.e., attachment points 516 and 520. To lower the height of the play bars 522 and 524, they may be uncoupled from attachment points 516 and 520 and then re-coupled to attachment points 514 and 518. Although shown with two levels of attachment points, it will be appreciated that other levels may be provided to enhance the adjustability of the vertical height of the play bars relative to the pillow.

Although shown using fabric loops and linkages as connectors and attachment points, it will be appreciated that a wide variety of other types of connection schemes may be used, including chains, pockets, elastic materials, clips, and the like. Further, play bars 522 and 524 could be made to be telescoping or otherwise adjustable to adjust the vertical height.

Play bars 522 and 524 may include connectors 530 and 532 that permit various toys 534 to hang below the play bars similar to other embodiments described herein. Also, the number of connectors and number of toys or other articles that may be coupled to the play bars may be varied. Also, a stabilizer 536 may be provided at the top of the play bars to hold them together at their apex.

Optionally, support pillow 504 may include ties 540 and 542 that permit ends 510 and 512 to be tied together. In this way, an infant or small child may be placed in a well 544 and be held in position by ends 510 and 512. As another optional feature, kit 500 may include a mat or blanket 548 that is positioned below the support pillow 504. Mat 548 may be coupled to pillow 504, such as with a hook and loop fastener material, or may be a separate item.

Figure 75:
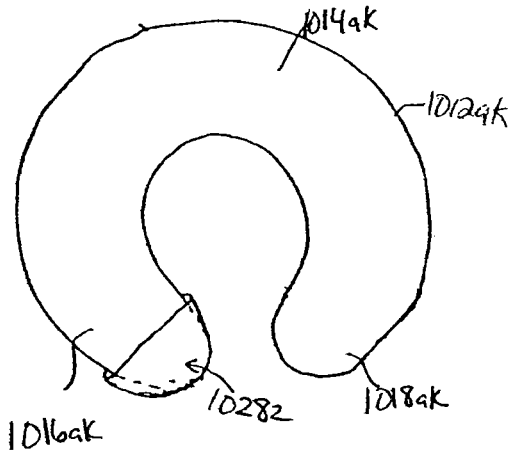
FIG. 75 illustrates the pillow and cover of FIG. 74 once the pocket has been inverted and placed over the end of the pillow.

Referring now to FIGS. 12-75, various covers and/or pillows that may be used with play bars will be described. Although not shown with attachment points, it will be appreciated that attachment points similar to those described in connection with FIG. 11 may be used with any of the embodiments shown in FIGS. 12-75 so that play bars may be coupled to them. Also, such features could be included directly on the pillow, rather than by using a removable cover. Further, it will be appreciated that other attachment schemes may be used to couple play bars to the covers/pillows of FIGS. 12-75. FIG. 12 illustrates one embodiment of a support pillow 1010 that is covered by a cover 12 will be described. Pillow 1010 may be constructed in a manner similar to those described in U.S. Pat. Nos. 5,261,134; 5,661,861; 6,038,720; 6,055,687; 6,119,873; 6,279,185 and 5,546,620, and co-pending U.S. application Ser. No. 10/769,007, filed Jan. 29, 2004, the complete disclosures of which are incorporated herein by reference. However, the invention is not limited to only this type of support pillow. For example, covers could also be provided for pillows similar to those described in co-pending U.S. application Ser. Nos. 10/4226,067, filed Apr. 28, 2003, 10/612,266, filed Jul. 1, 2003, 10/612,267, filed Jul. 1, 2003, and 10/627,542, filed Jul. 25, 2003, the complete disclosures of which are incorporated herein by reference.

Pillow 1010 has a medial region 1014 and two opposing arms 1016 and 1018 that terminate in ends 1020 and 1022. Pillow 1010 further includes an outer periphery 1024 and inner periphery 1026 that defines a generally open well 1028. As shown, outer periphery 1024 and inner periphery 1026 have a curved geometry and ends 1020 and 1022 are generally rounded.

FIG. 13 is a cross sectional view of pillow 1010 and cover 1012 taken along one of the arms. Pillow 1010 is constructed of a shell 1030 that is filled or stuffed with a fill material 1032, such as hypo allergenic fiber fill material. Shell 1030 is filled with enough fill material 1032 so that pillow 1010 is firm and does not droop or sag during handling. Shell 1030 completely encloses fill material 1032 so as to prevent its removal.

Cover 1012 closely conforms to the shape of pillow 1010 so that pillow 1010 maintains the same overall shape and appearance as shown. Cover 1012 further includes a zipper 1034 that may be unzipped to form an opening through which pillow 1010 is inserted. Because of the tight fit, cover 1012 may be manipulated until it properly covers pillow 1010. Zipper 1034 may then be zipped to close the opening. As previously described, cover 1012 may have a wide variety of colors, textures and the like to vary the appearance or feel of pillow 1010.

Figure 14:
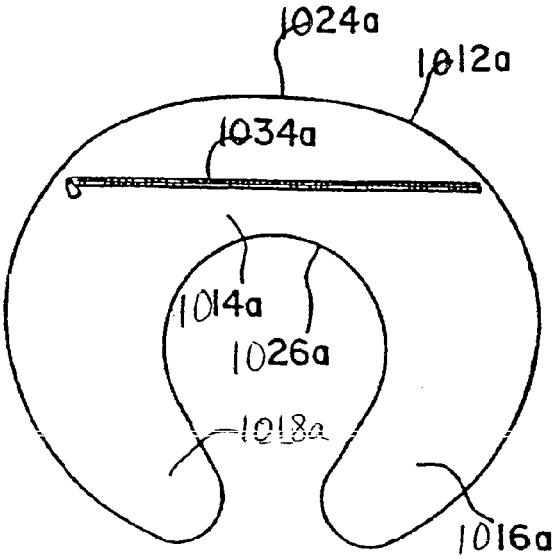
FIG. 14 is a top view of an embodiment of a pillow cover according to the invention.

Cover 1012 may be modified to vary the location of zipper 1034 (or other fastener). Examples of such variation are illustrated in FIGS. 14-19. For convenience of discussion, the covers in these examples (as well as other examples described herein) will use the same reference numerals used to describe cover 1012, followed by a certain letter. Shown in FIG. 14 is cover 1012*a* having a zipper 1034*a* that extends across the top side of medial region 1014*a*.

Figure 15:
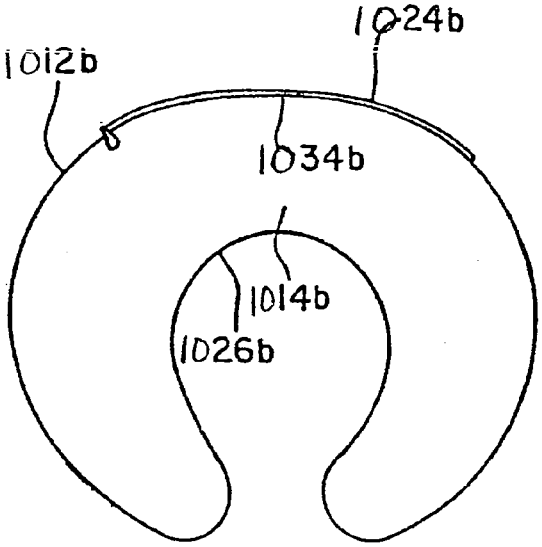
FIG. 15 is a top view of another embodiment of a pillow cover according to the invention.
Figure 16:
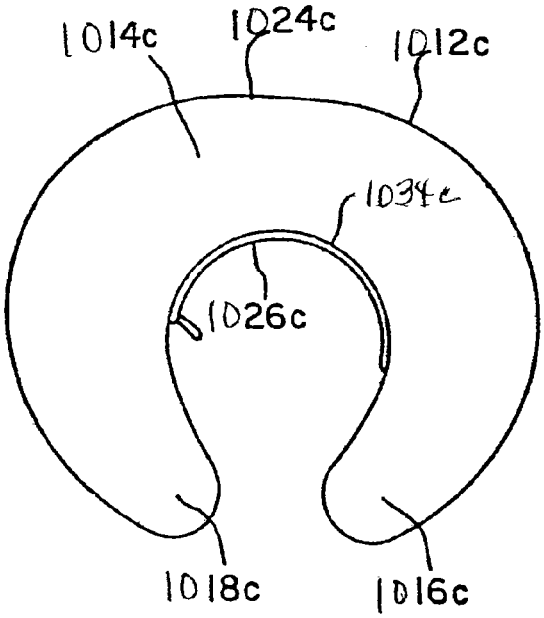
FIG. 16 is a top view of yet another embodiment of a pillow cover according to the invention.
Figure 17:
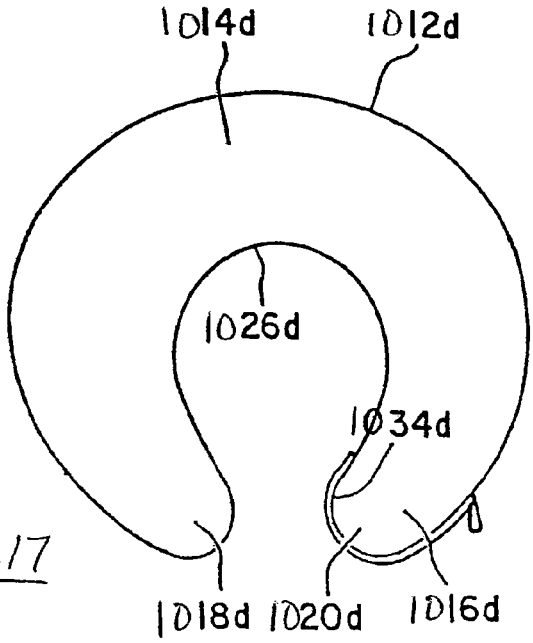
FIG. 17 is a top of still another embodiment of a pillow cover according to the invention.

FIG. 15 illustrates a cover 1012*b* having a zipper 1034*b* that extends along outer periphery 1024*b* at medial region 1014*b*. FIG. 16 illustrates a cover 1012*c* having a zipper 1034*c* that extends along inner periphery 1026*c* at medial region 104*c*. FIG. 17 illustrates a cover 1012*d* having a zipper 1034*d* that extends along end 1020*d* of arm 1016*d*. FIG. 18 illustrates a cover 1012*e* having a zipper 1034*e* that extends across the top side of arm 1016*e*. Finally, FIG. 19 illustrates a pillow 1012*f* having a zipper 1034*f* that extends along arm 1016*f* at outer periphery 1024*f*.

Another embodiment of a cover 1012*g* is illustrated in FIG. 20A and FIG. 20B. Cover 1012*g* is similar to cover 1012*e* of FIG. 18 except that end 1020*e* has been removed to leave an opening 1040 in arm 1016*g*. As shown in FIG. 20B, an end flap 1042 is placed over opening 1040 to completely enclose the support pillow after the pillow has been inserted through opening 1040. A hook and loop fastener material may be used to hold flap 1042 to arm 1016*g*.

Figure 21:
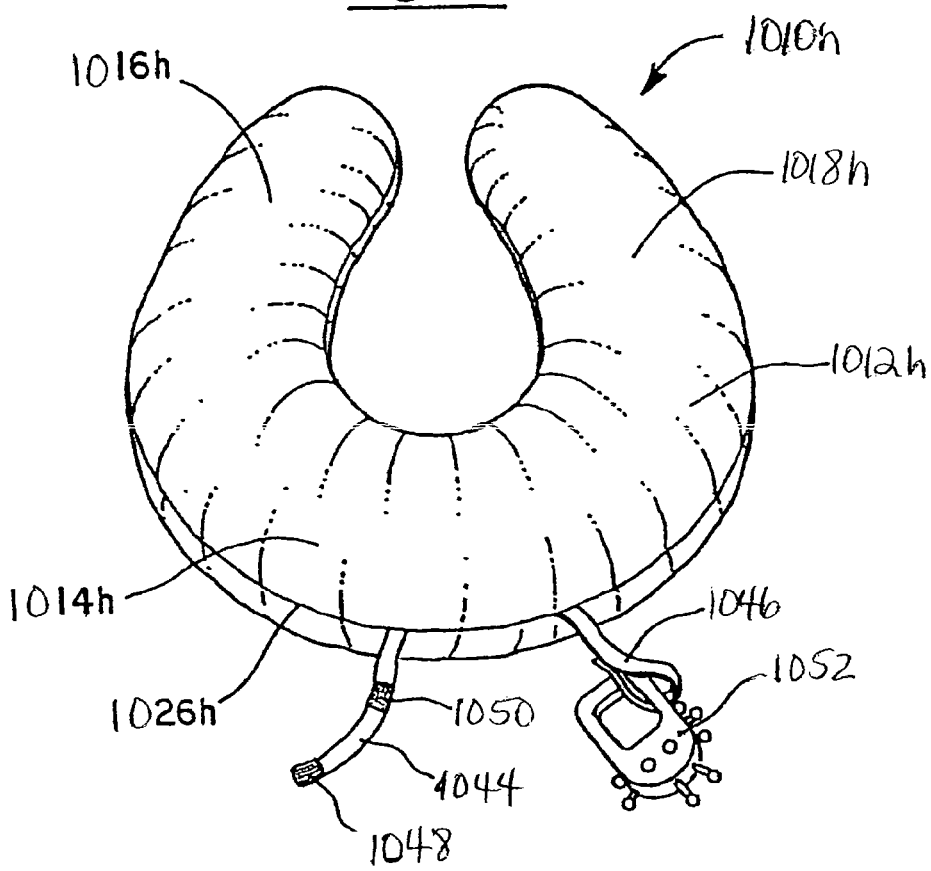
FIG. 21 illustrates a support pillow and cover having straps for attaching items to the cover according to the invention.

FIG. 21 illustrates another modification of support pillow 1010 and cover 1012 of FIG. 12. For convenience of discussion, similar elements of the support pillow of FIG. 21 and cover will use the same reference numerals, followed by the letter "h". Cover 1012*h* has a pair of attachment straps 1044 and 1046 that are sewn to the seam of outer periphery 1024*h*. Straps 1044 and 1046 include pieces 1048 and 1050 of a hook and loop fastener material to form loops in straps 1044 and 1046, it being appreciated that other fasteners may be used. Straps 1044 and 1046 are used to attach various toys, such as a toy 1052, to cover 1012*h*. In this way, the utility of pillow 1010*h* may be changed simply by attaching different items to the straps. Moreover, other attachment items may be used with the pillow simply by using another cover.

Figure 22:
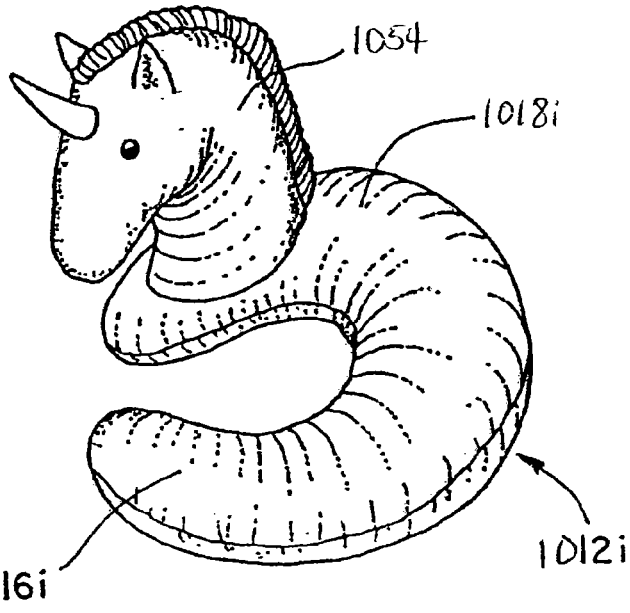
FIG. 22 illustrates a support pillow and cover having an animal head that is attached to the cover according to the invention.

By way of example, FIG. 22 illustrates another embodiment of a cover 1012*i* having an animal head 1054 attached to end 1018*i*. Further, it will be appreciated that other types of figures may be coupled to cover 102*i* and at different locations, including in the center or medial region.

Figure 23:
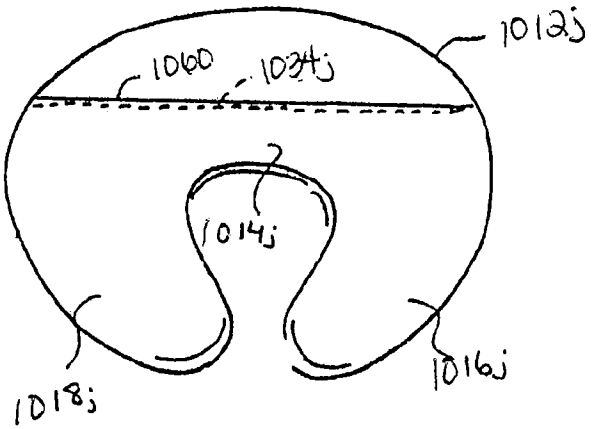
FIG. 23 is a top view of one embodiment of a cover that covers a support pillow, with the cover having a zipper across the medial region.

FIG. 23 illustrates one embodiment of a cover 1012*j* covering a pillow. Cover 1012*j* has a seam 1060 on medial region 1014*j* that defines an opening in cover 1012*j*. Incorporated into seam 1060 is a zipper 1034*j* (shown in dashed line). Seam 1060 covers zipper 1034*j* so that the top surface of cover 1012*j* is generally smooth. To access zipper 1034*j*, seam 1060 may be folded back. By providing seam 1060 on the face of medial region 1014*j*, a large opening may be provided to facilitate the introduction and removal of the pillow.

Figure 24:
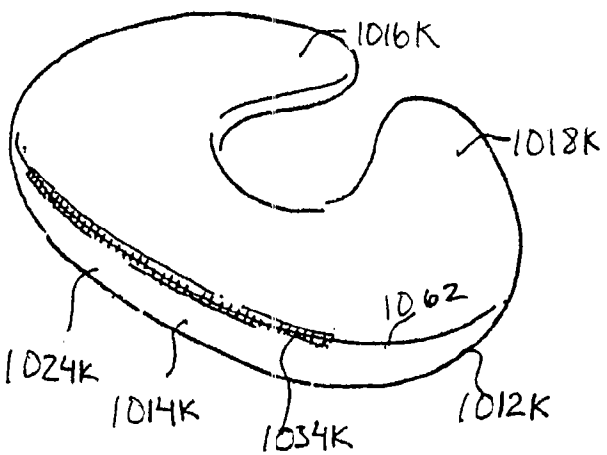
FIG. 24 is a perspective view of one embodiment of a cover that covers a support pillow, with the cover having a zipper along the outer periphery.

FIG. 24 illustrates a cover 1012*k* where a zipper 1034*k* is incorporated into a seam 1062 at the outer periphery 1024*k* of medial region 1014*k*. At seam 1062, two pieces of material that are joined together to form cover 1012*k*. Zipper 1034*k* may be operated to provide an opening into the interior of cover 1012*k*.

Figure 25:
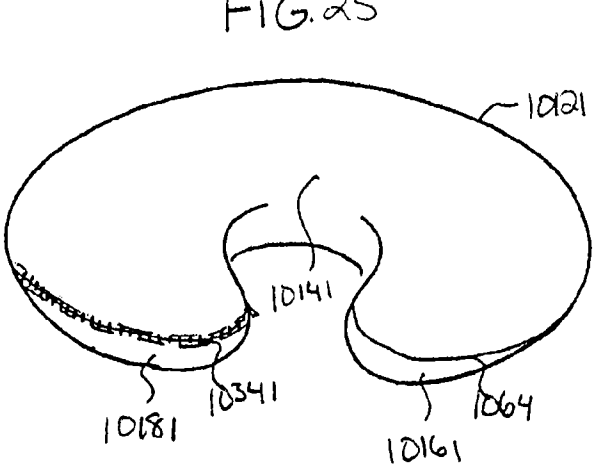
FIG. 25 is a perspective view of one embodiment of a cover that covers a support pillow, with the cover having a zipper along one of the ends.

FIG. 25 illustrates a cover 1012*l* where a zipper 1034*l* is incorporated into a seam 1064 at the end of arm 1018, it being appreciated that zipper 1034may also be incorporated into end 1016*l*. Zipper 1034may be operated to provide an opening into cover 1012at the end of one of the arms to permit the pillow to be inserted or removed.

Figure 26:
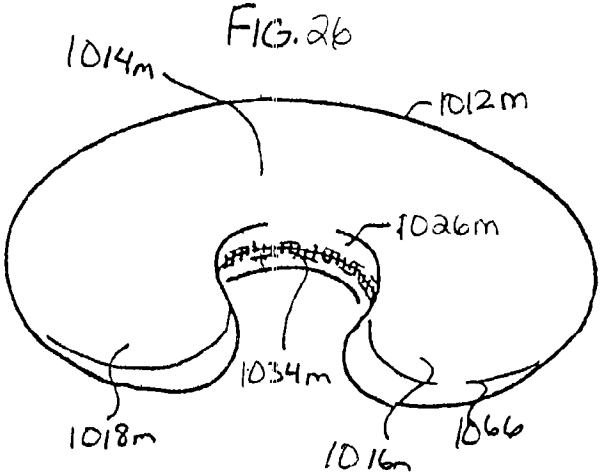
FIG. 26 is a perspective view of one embodiment of a cover that covers a support pillow, with the cover having a zipper along the inner periphery.

FIG. 26 illustrates a cover 1012*m* having a zipper 1034*m* that is incorporated into a seam 1066 at the inner periphery 1026*m* of medial region 1014*m*. By operating zipper 1034*m*, an opening is formed into cover 1012*m* to permit the pillow to be inserted or removed.

Figure 27:
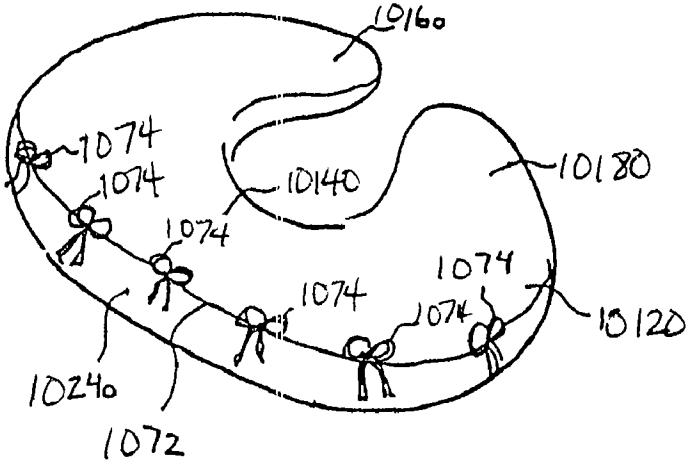
FIG. 27 is a top view of one embodiment of a cover that covers a support pillow, with the cover having ties along the medial region.

FIG. 27 illustrates one embodiment of a cover 1012*n* covering a pillow. Cover 1012*n* has a seam 1068 on medial region 1014*n* that defines an opening in cover 1012*n*. Coupled to each edge of seam 1068 are a plurality of ties 1070. By providing seam 1066 on the face of medial region 1014*n*, a large opening may be provided to facilitate the introduction and removal of the pillow. To provide the opening at seam 1068, ties 1070 may be untied from each other and seam 1068 pulled apart. Once the pillow is in place, ties 1070 may be retied. Ties 1070 may be constructed from essentially any type of flexible material, such as fabrics, strings and the like.

Figure 28:
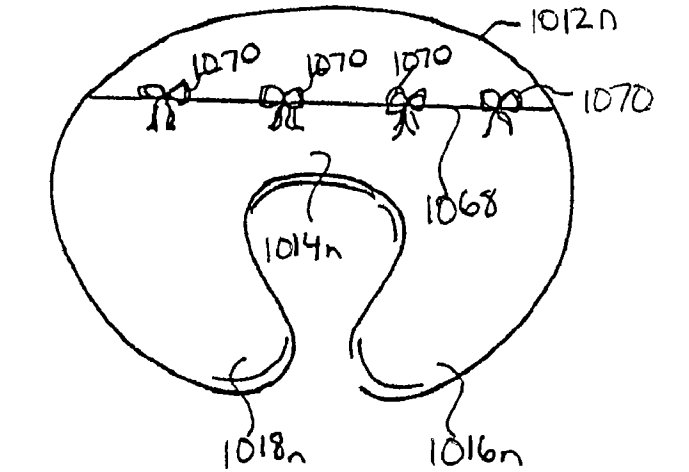
FIG. 28 is a perspective view of one embodiment of a cover that covers a support pillow, with the cover having ties along the outer periphery.

FIG. 28 illustrates a cover 1012*o* where ties 1074 are coupled to each edge of a seam 1072 at the outer periphery 1024*o* of medial region 1014*o*. At seam 1072, two pieces of material that are joined together to form cover 1012*o*. Ties 1074 may be untied to provide an opening into the interior of cover 1012*o*.

Figure 29:
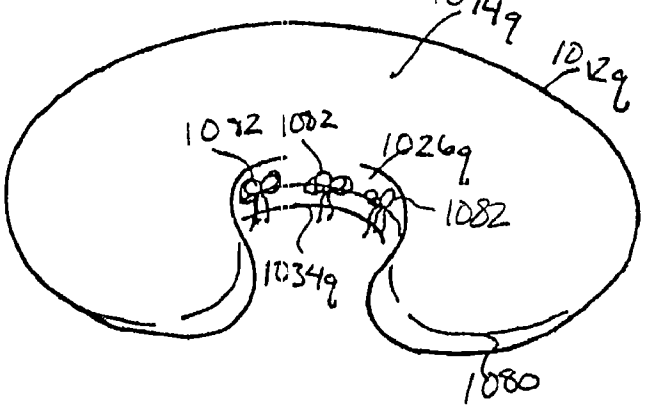
FIG. 29 is a perspective view of one embodiment of a cover that covers a support pillow, with the cover having ties along the ends of the arms.

FIG. 29 illustrates a cover 1012*p* where ties 1078 are coupled to each edge of a seam 1076 at the end of arms 1016*p* and 1018*p*, it being appreciated that ties 1078 may also be incorporated into only one of the ends. Ties 1078 may be operated to provide an opening into cover 1012*p* at the end of one of the arms to permit the pillow to be inserted or removed.

Figure 30:
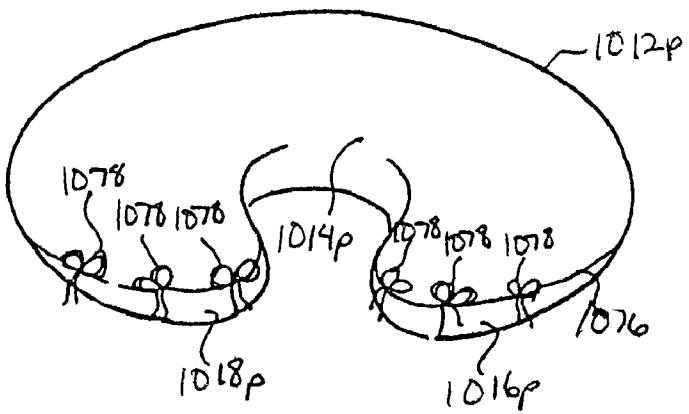
FIG. 30 is a perspective view of one embodiment of a cover that covers a support pillow, with the cover having ties along the inner periphery.

FIG. 30 illustrates a cover 1012*q* having ties 1082 that are copied to each edge of a seam 1080 at the inner periphery 1026*q* of medial region 1014*q*. By untying ties 1082, an opening is formed into cover 1012*q* to permit the pillow to be inserted or removed.

Figure 31:
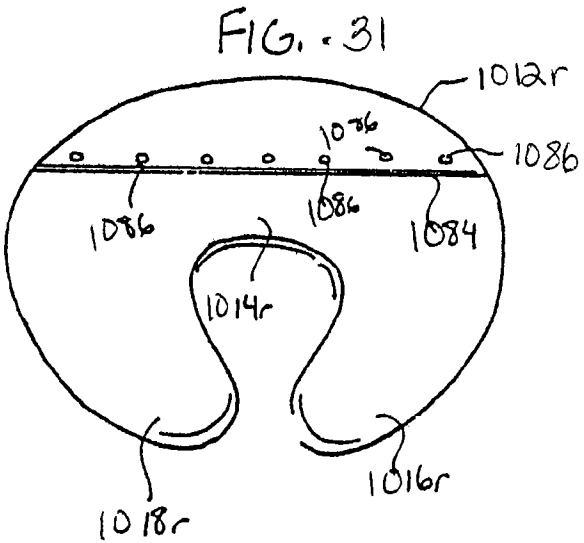
FIG. 31 is a top view of one embodiment of a cover that covers a support pillow, with the cover having buttons along the medial region.

FIG. 31 illustrates one embodiment of a cover 1012*r* covering a pillow. Cover 1012*r* has a seam 1084 on medial region 1014*r* that defines an opening in cover 1012*r*. Coupled to one edge (such as the bottom edge) of seam 1084 are a plurality of buttons 1086. The other edge (such as the top edge) includes slits through which buttons 1086 pass. By providing seam 1084 on the face of medial region 1014*r*, a large opening may be provided to facilitate the introduction and removal of the pillow. To provide the opening at seam 1084, buttons 1086 may be removed from their button holes and seam 1084 pulled apart. Once the pillow is in place, buttons 1086 may be inserted back through the button holes. Buttons 1086 may be constructed from materials such as metal, plastic and the like.

Figure 32:
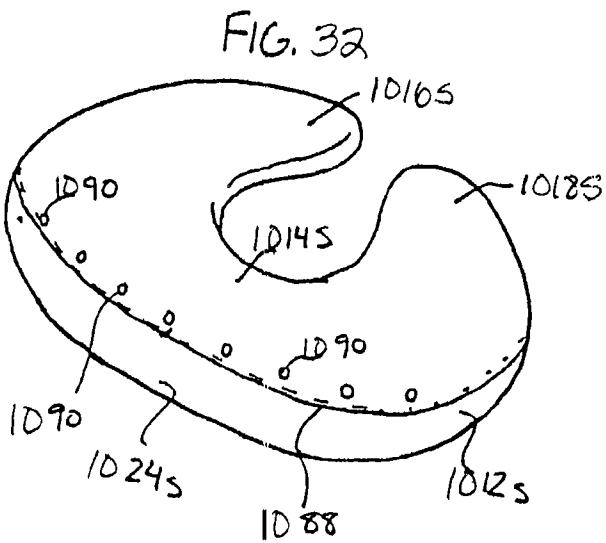
FIG. 32 is a perspective view of one embodiment of a cover that covers a support pillow, with the cover having buttons along the outer periphery.

FIG. 32 illustrates a cover 1012*s* where buttons 1090 are coupled to one edge of a seam 1088 at the outer periphery 1024*s* of medial region 1014*s*. At seam 1088, two pieces of material that are joined together to form cover 1012*s*. Buttons 1090 may be unbuttoned to provide an opening into the interior of cover 1012*s*.

Figure 33:
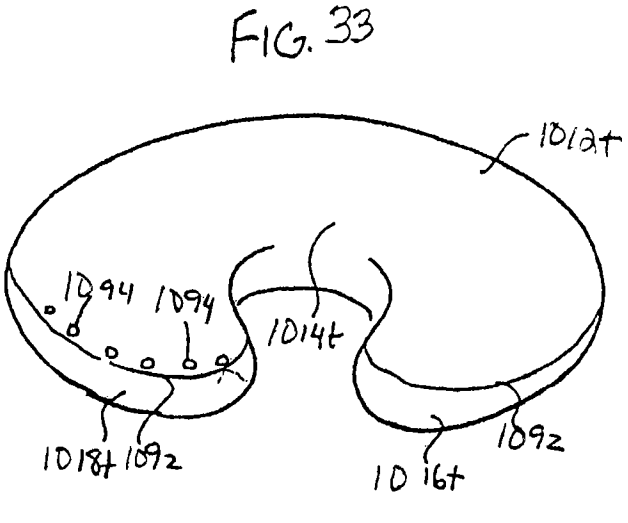
FIG. 33 is a perspective view of one embodiment of a cover that covers a support pillow, with the cover having buttons along the ends of the arms.

FIG. 33 illustrates a cover 1012*t* where buttons 1094 are coupled to one edge of a seam 1092 at the end of one or both arms 1016*t* and 1018*t*. Buttons 1094 may be operated to provide an opening into cover 1012*t* at the end of one of the arms to permit the pillow to be inserted or removed.

Figure 34:
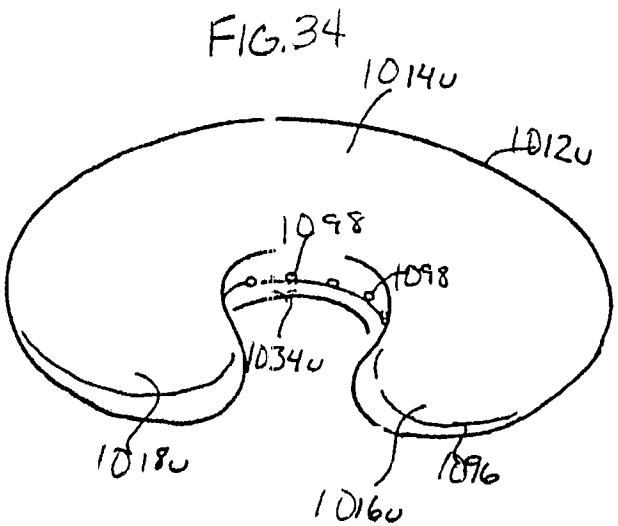
FIG. 34 is a perspective view of one embodiment of a cover that covers a support pillow, with the cover having buttons along the inner periphery.

FIG. 34 illustrates a cover 1012*u* having buttons 1098 that are coupled to one edge of a seam 1096 at the inner periphery 1026*u* of medial region 1014*u*. By unbuttoning snaps 1098, an opening is formed into cover 1012*u* to permit the pillow to be inserted or removed.

Figure 35:
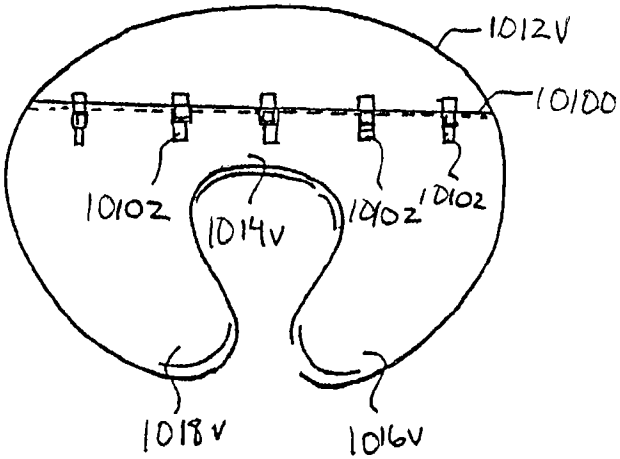
FIG. 35 is a top view of one embodiment of a cover that covers a support pillow, with the cover having buckles along the medial region.

FIG. 35 illustrates one embodiment of a cover 1012*v* covering a pillow. Cover 1012*v* has a seam 10100 on medial region 1014*v* that defines an opening in cover 1012*v*. Coupled to each edge of seam 10100 are a plurality of buckles 10102. One piece of each buckle is coupled to one inside edge while the other piece of the buckle is attached to the opposing edge of seam 10100. Examples of buckles that may be used include traditional belt buckles, quick release buckles and the like. These may be coupled to the edges of the seam using ties, straps, or the like. For instance, materials such as leather, fabric or nylon straps, strings, ropes and the like may be used to couple the buckles to the cover. By providing seam 10100 on the face of medial region 1014*v*, a large opening may be provided to facilitate the introduction and removal of the pillow. To provide the opening at seam 10100, buckles 10102 may be unsnapped from each other and seam 10100 pulled apart. Once the pillow is in place, buckles 10102 may be connected.

Figure 36:
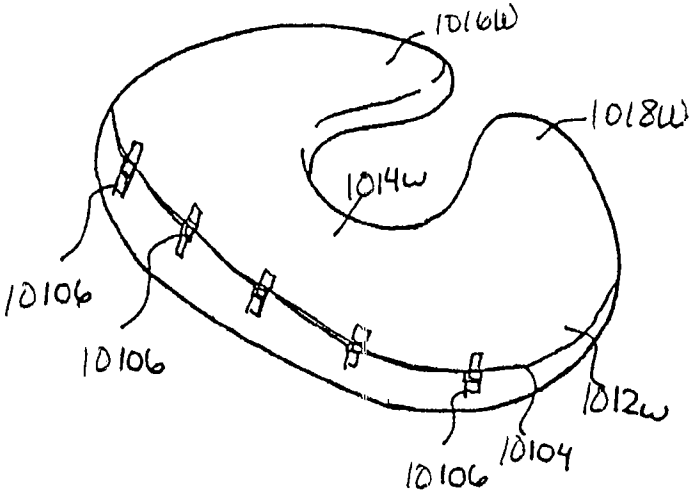
FIG. 36 is a perspective view of one embodiment of a cover that covers a support pillow, with the cover having buckles along the outer periphery.

FIG. 36 illustrates a cover 1012*w* where buckles 10106 are coupled to each edge of a seam 10104 at the outer periphery 1024*w* of medial region 1014*w*. At seam 10104, two pieces of material that are joined together to form cover 1012*w*. Buckles 10106 may be unbuckled to provide an opening into the interior of cover 1012*w*.

Figure 37:
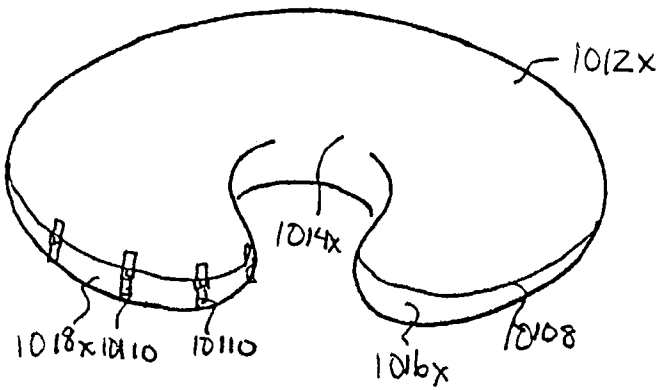
FIG. 37 is a perspective view of one embodiment of a cover that covers a support pillow, with the cover having buckles along the ends of the arms.

FIG. 37 illustrates a cover 1012*x* where buckles 10110 are coupled to each edge of a seam 10108 at the end of one or both arms 1016*x* and 1018*x*. Buckles 10110 may be operated to provide an opening into cover 1012*x* at the end of one of the arms to permit the pillow to be inserted or removed.

Figure 38:
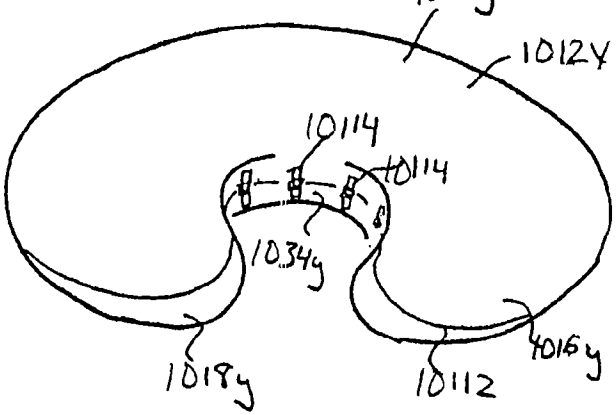
FIG. 38 is a perspective view of one embodiment of a cover that covers a support pillow, with the cover having buckles along the inner periphery.

FIG. 38 illustrates a cover 1012*y* having buckles 10114 that are coupled to each edge of a seam 10112 at the inner periphery 1026*y* of medial region 1014*y*. By unbuckling buckles 10114, an opening is formed into cover 1012*y* to permit the pillow to be inserted or removed.

Figure 39:
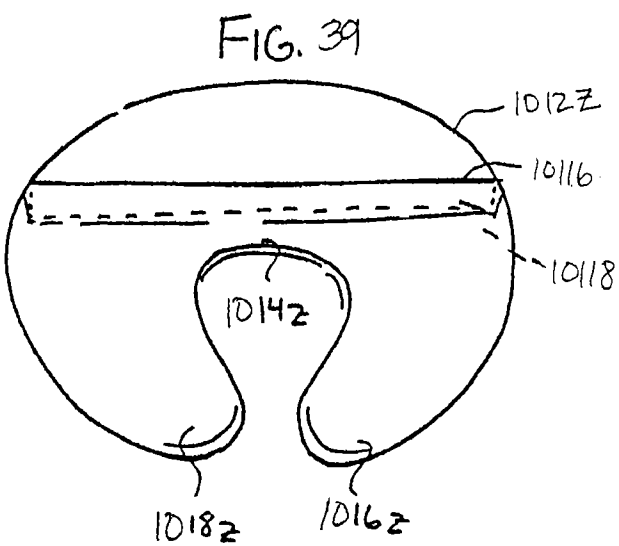
FIG. 39 is a top view of one embodiment of a cover that covers a support pillow, with the cover having a flap with an optional hook and loop fastener material along the medial region.

FIG. 39 illustrates one embodiment of a cover 1012*z* covering a pillow. Cover 1012*z* has an overlapping seam 10116 on medial region 1014*z* that forms a flap and defines an opening in cover 1012*z*. For example, the flap may overlap about 1 to about 3 inches. Because the edges of the seam overlap, a natural flap is provided to close the opening. To gain access to the interior, the flap may be lifted to expose the opening. Optionally, coupled to each edge of seam 10116 may be a hook and loop fastener material 10118 (shown in phantom line). One piece of the hook and loop mater may be coupled to one inside edge while the other piece may be attached to the opposing edge of seam 10116. By providing seam 10116 on the face of medial region 1014*z*, a large opening may be provided to facilitate the introduction and removal of the pillow. Once the pillow is in place in the interior, the flap may be smoothed over cover 1012*z*, optionally being joined by the hook and loop fastener material.

Figure 40:
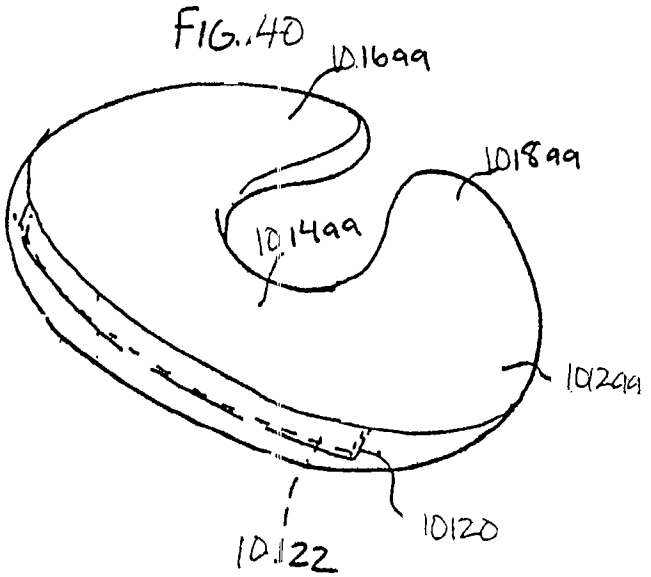
FIG. 40 is a perspective view of one embodiment of a cover that covers a support pillow, with the cover having flap with an optional hook and loop fastener material along the outer periphery.

FIG. 40 illustrates a cover 1012*aa* having an overlapping seam 10120 that forms a flap at the outer periphery 1024*aa* of medial region 1014*aa*. At seam 10120, two pieces of material that are joined together to form cover 1012*aa*. Optionally, a hook and loop fastener material 10112 may be coupled to the underside of the flap and to the opposite edge of seam 10120 is securely hold the flap to the cover. Seam 10120 may be separated to provide an opening into the interior of cover 1012*aa*.

Figure 41:
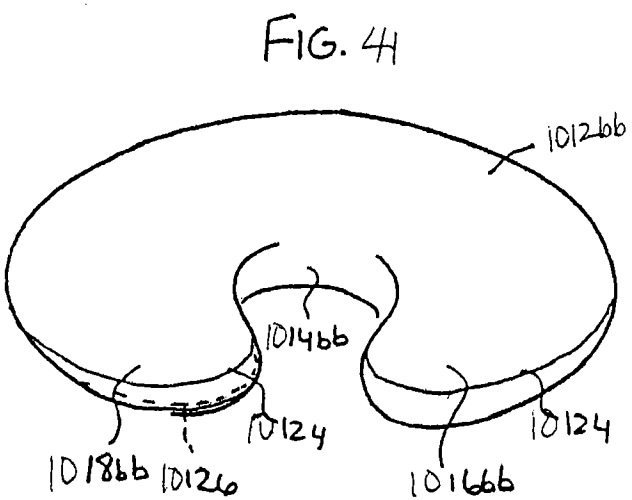
FIG. 41 is a perspective view of one embodiment of a cover that covers a support pillow, with the cover having flap with an optional hook and loop fastener material along the ends of the arms.

FIG. 41 illustrates a cover 1012*bb* where an overlapping seam 10124 is positioned at the end of one or both arms 1016*bb* and 1018*bb*. Sean 10124 may be separated to provide an opening into cover 1012*bb* at the end of one of the arms to permit the pillow to be inserted or removed. Optionally, a hook and loop fastener material 10126 may be coupled to the underside of the flap and the opposite side of the seam to securely couple the flap to the cover.

Figure 42:
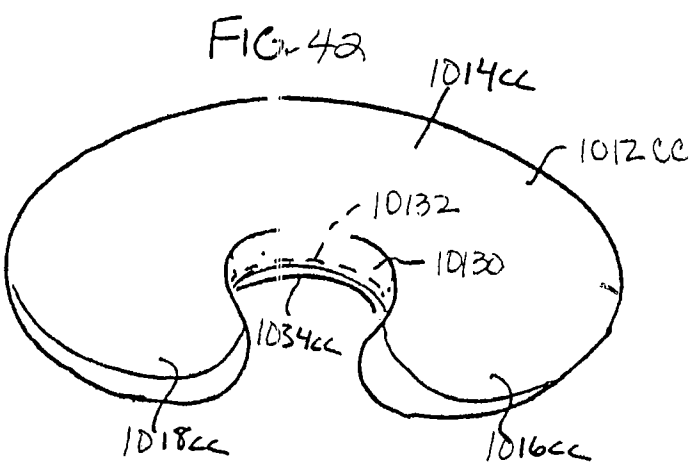
FIG. 42 is a perspective view of one embodiment of a cover that covers a support pillow, with the cover having flap with an optional hook and loop fastener material along the inner periphery.

FIG. 42 illustrates a cover 1012*cc* having an overlapping seam 10130 at the inner periphery 1026*cc* of medial region 1014*cc*. By separating seam 10130, an opening is formed into cover 1012*cc* to permit the pillow to be inserted or removed. Optionally, a hook and loop fastener material 10132 may be used to hold the flap closed.

Figure 43:
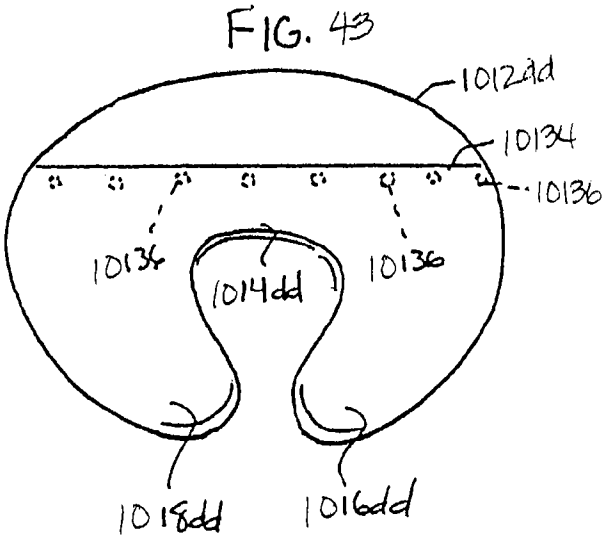
FIG. 43 is a top view of one embodiment of a cover that covers a support pillow, with the cover having snaps along the medial region.

FIG. 43 illustrates one embodiment of a cover 1012*dd* covering a pillow. Cover 1012*dd* has a seam 10134 on medial region 1014*dd* that defines an opening in cover 1012*dd*. Coupled to each edge of seam 10134 are a plurality of snaps 10136. The male part of each snap is coupled to one inside edge while the female part of the snap is attached to the opposing edge of seam 10134. By providing seam 10134 on the face of medial region 1014*dd*, a large opening may be provided to facilitate the introduction and removal of the pillow. To provide the opening at seam 10134, snaps 10136 may be unsnapped from each other and seam 10134 pulled apart. Once the pillow is in place, snaps 10136 may be snapped. Snaps 10136 may be constructed from materials such as metal, plastic and the like.

Figure 44:
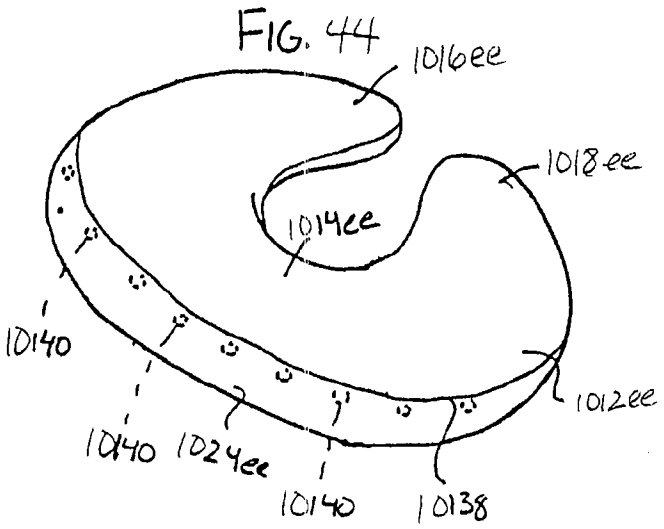
FIG. 44 is a perspective view of one embodiment of a cover that covers a support pillow, with the cover having snaps along the outer periphery.

FIG. 44 illustrates a cover 1012*ee* where snaps 10140 are coupled to each edge of a seam 10138 at the outer periphery 1024*ee* of medial region 1014*ee*. At seam 10138, two pieces of material that are joined together to form cover 1012*ee*. Snaps 10140 may be unsnapped to provide an opening into the interior of cover 1012*ee*.

Figure 45:
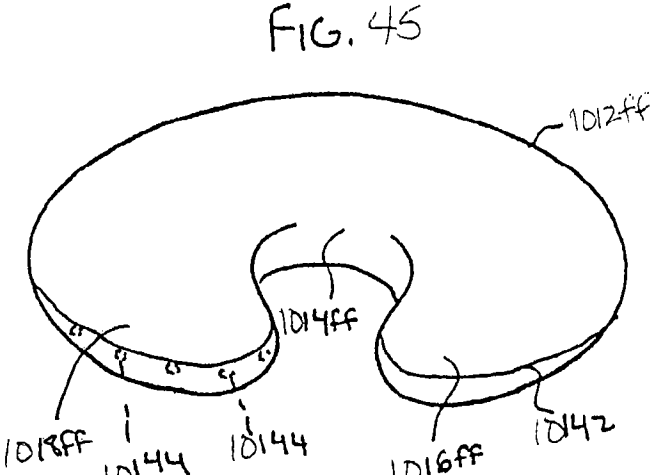
FIG. 45 is a perspective view of one embodiment of a cover that covers a support pillow, with the cover having snaps along the ends of the arms.

FIG. 45 illustrates a cover 1012*ff* where snaps 10144 are coupled to each edge of a seam 10142 at the end of one or both arms 1016*ff* and 1018*ff*. Snaps 10144 may be operated to provide an opening into cover 1012*ff* at the end of one of the arms to permit the pillow to be inserted or removed.

Figure 46:
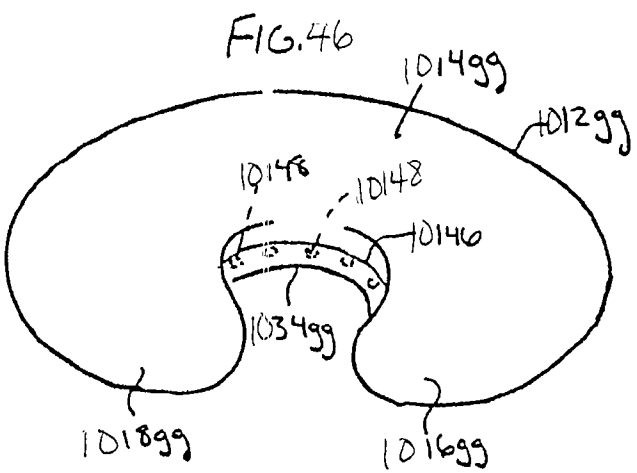
FIG. 46 is a perspective view of one embodiment of a cover that covers a support pillow, with the cover having snaps along the inner periphery.

FIG. 46 illustrates a cover 1012*gg* having snaps 10148 that are coupled to each edge of a seam 10146 at the inner periphery 1026*gg* of medial region 1014*gg*. By unsnapping snaps 10148, an opening is formed into cover 1012*gg* to permit the pillow to be inserted or removed.

Figure 47:
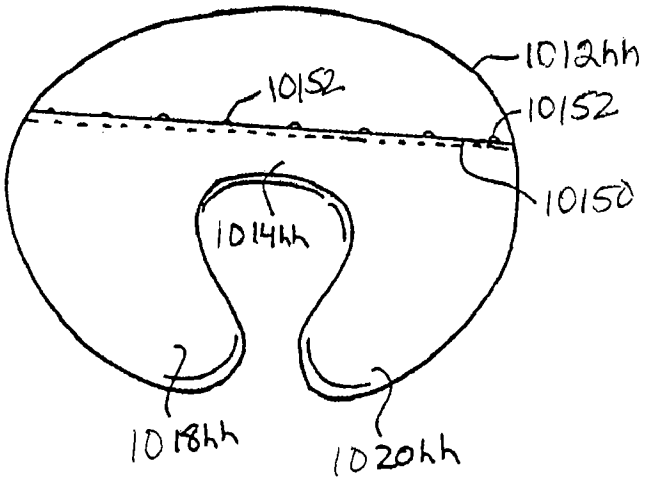
FIG. 47 is a top view of one embodiment of a cover that covers a support pillow, with the cover having hooks along the medial region.

FIG. 47 illustrates one embodiment of a cover 1012*hh* covering a pillow. Cover 1012*hh* has a seam 10150 on medial region 1014hh that defines an opening in cover 1012*hh*. Coupled to each edge of seam 10150 are a plurality of hooks 10152 that loop over catches on the opposite edge of seam 10150. By providing seam 10150 on the face of medial region 1014*hh*, a large opening may be provided to facilitate the introduction and removal of the pillow. To provide the opening at seam 10150, hooks 10152 may be unhooked from the catches and seam 10150 pulled apart. Once the pillow is in place, hooks 10152 may be re-hooked. Hooks 10152 may be constructed from materials such as metal, plastic and the like.

Figure 48:
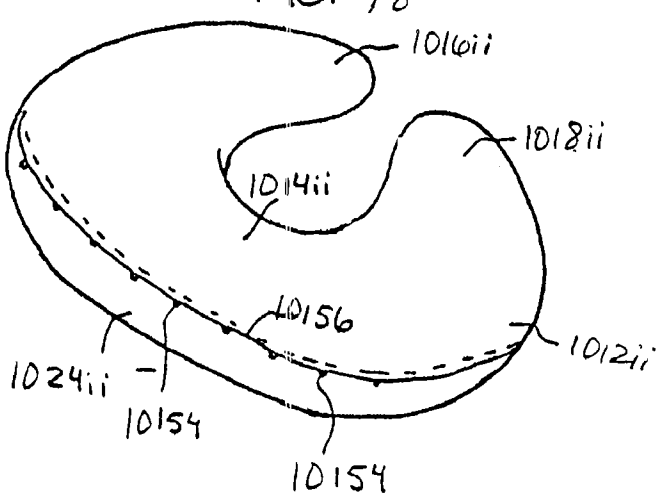
FIG. 48 is a perspective view of one embodiment of a cover that covers a support pillow, with the cover having hooks along the outer periphery.

FIG. 48 illustrates a cover 1012*ii* where hooks 10154 are coupled to one edge of a seam 10156 at the outer periphery 1024*ii* of medial region 1014*ii* and mate with catches on the other edge of the seam. At seam 10156, two pieces of material that are joined together to form cover 1012*ii*. Hooks 10154 may be un-hooked to provide an opening into the interior of cover 1012*ii*.

Figure 49:
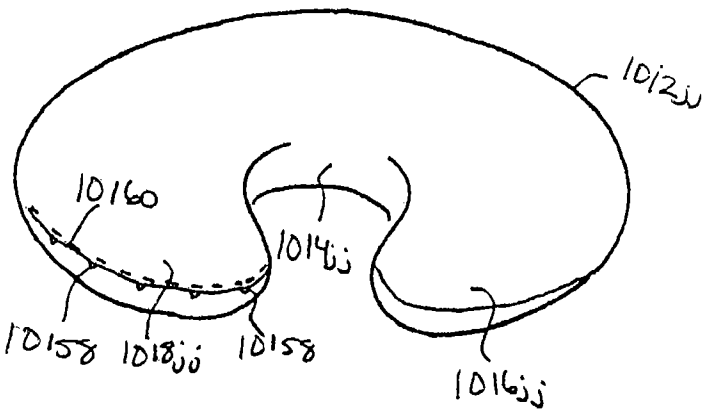
FIG. 49 is a perspective view of one embodiment of a cover that covers a support pillow, with the cover having hooks along the ends of the arms.

FIG. 49 illustrates a cover 1012*jj* where hooks 10158 are coupled to an edge of a seam 10160 at the end of one or both arms 1016*jj* and 1018*jj*. Hooks 10158 may be unhooked to provide an opening into cover 1012*jj* at the end of one of the arms to permit the pillow to be inserted or removed.

Figure 50:
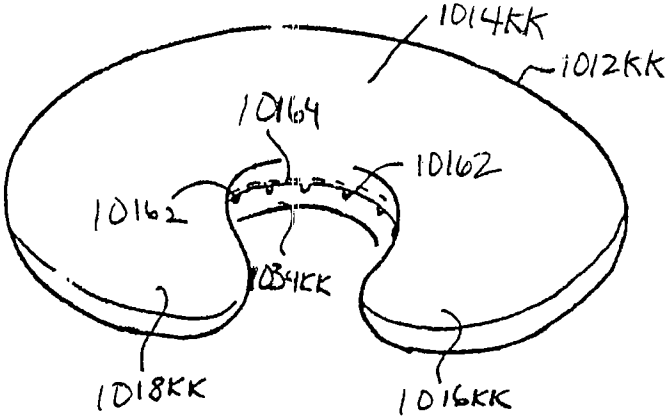
FIG. 50 is a perspective view of one embodiment of a cover that covers a support pillow, with the cover having hooks along the inner periphery.

FIG. 50 illustrates a cover 1012*kk* having hooks 10162 that are coupled to each edge of a seam 10164 at the inner periphery 1026*kk* of medial region 1014*kk*. By unhooking hooks 10162 from their catches, an opening is formed into cover 1012*kk* to permit the pillow to be inserted or removed.

Figure 51:
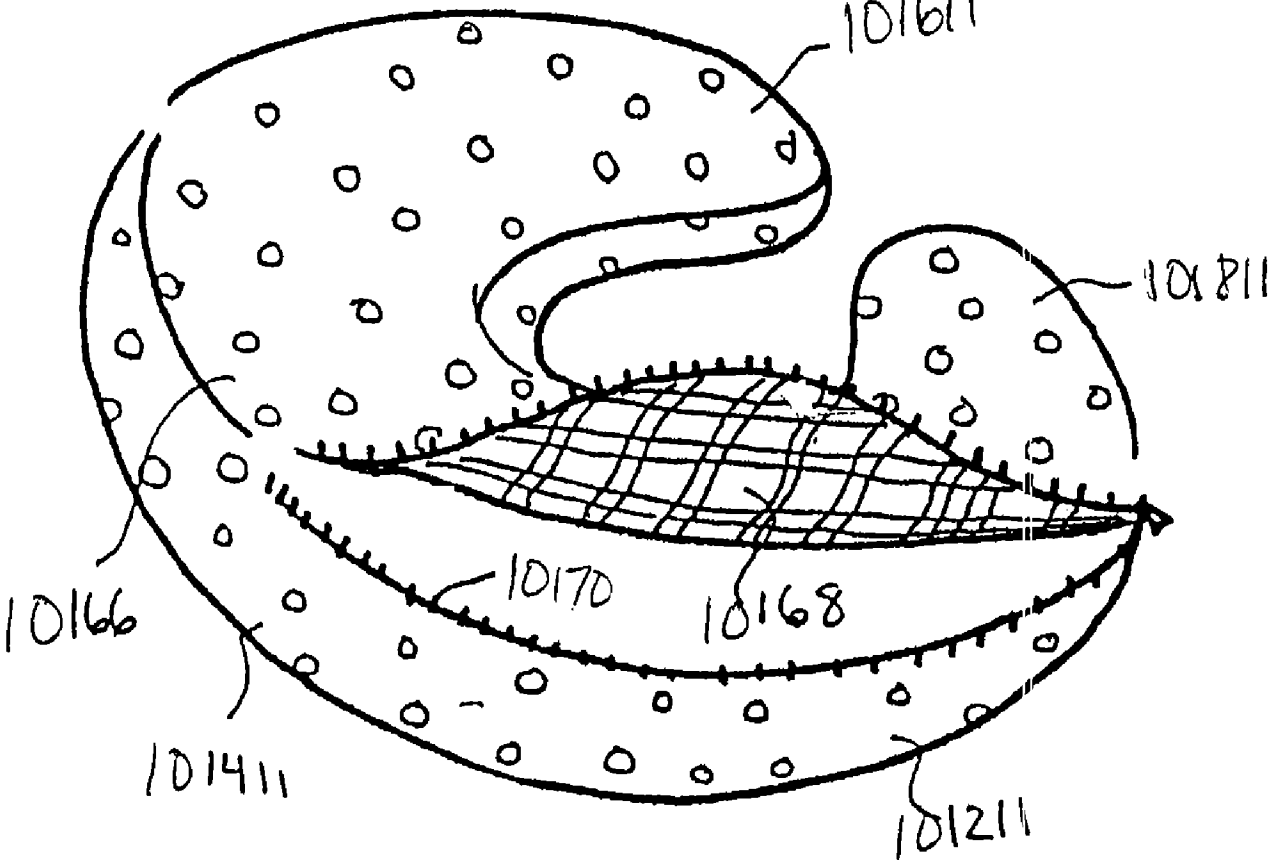
FIG. 51 is a perspective view of one embodiment of a reversible cover.

FIG. 51 illustrates a cover 1012*ll* that is constructed of a reversible fabric having two sides 10166 and 10168. In this way, cover 1012*ll* may be turned inside out so that both surfaces may be used with a single pillow. As shown, cover 1012*ll* includes a zipper 10170. However, it will be appreciated that any of the fasteners described herein which are located at any of the positions may be used. As shown, cover 1012*ll* is constructed of a single fabric with different patterns on each side. However, it will be appreciated that different fabrics or materials could be used on each side. In this way, the sides may be varied using different colors, textures, patterns, appliqués and the like. These include woven fabrics, wipeable fabrics (such as vinyl or nylon), and the like.

FIGS. 52-55 illustrate embodiments where handles may be coupled to the cover. The handles may be provided in a variety of locations on the covers using a variety of techniques, including those described in U.S. Pat. No. 6,434,770, incorporated herein by reference. Also, a variety of materials may be used to form the handles, such as ropes, nylon straps, fabrics, plastics, and the like. Attachment schemes may be used include sewing, rivets, snaps, tied ends, gluing and the like.

Figure 52:
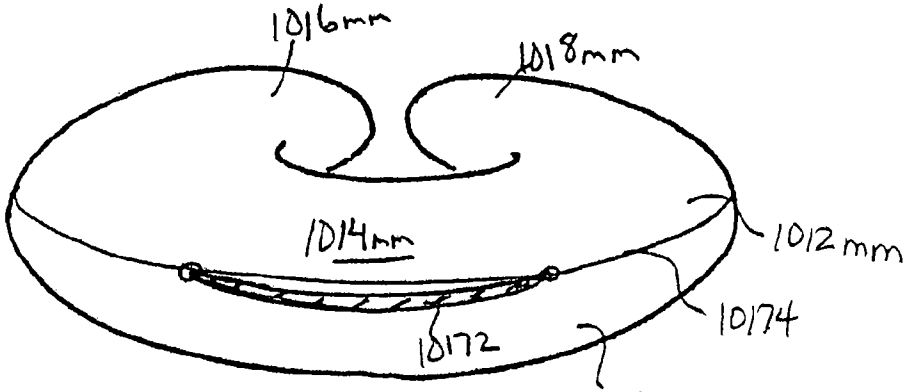
FIG. 52 is a perspective view of one embodiment of a cover that covers a support pillow, with the cover having a handle along the outer periphery at the medial region.

In FIG. 52, a cover 1012*mm* is shown with a handle 10172 that is coupled to a seam 10174 at the outer periphery of medial region 1014*mm*. Handle 10172 may have essentially any length, from the size of a hand to along the arms of cover 1012*mm*.

Figure 53:
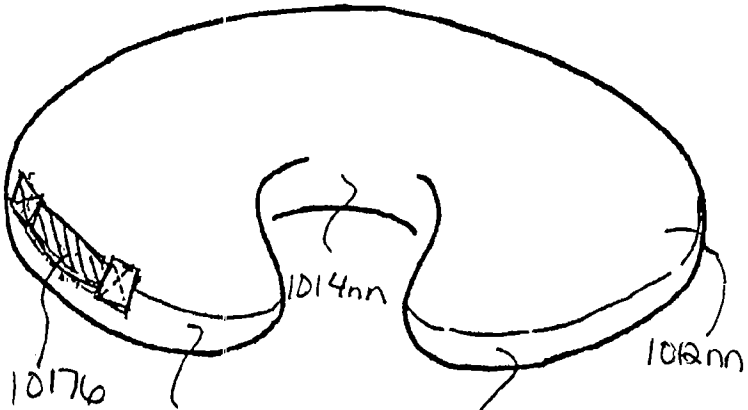
FIG. 53 is a perspective view of one embodiment of a cover that covers a support pillow, with the cover having a handle along the outer periphery along one of the arms.

FIG. 53 illustrates a cover 1012*nn* having a handle 10176 that is sewn to the outer periphery of arm 1016*nn*. As shown, handle 10176 is a piece of nylon webbing. Handle 10176 may be positioned anywhere on arm 1016*nn*, or may also be positioned on arm 1018*nn*.

Figure 54:
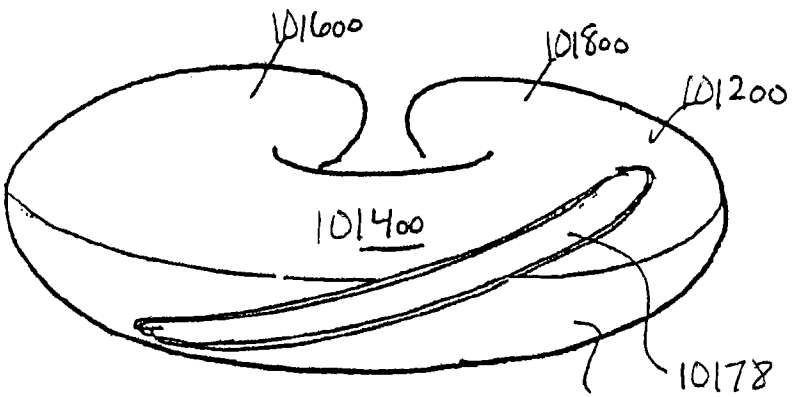
FIG. 54 is a perspective view of one embodiment of a cover that covers a support pillow, with the cover having a handle diagonally positioned along the medial region.

FIG. 54 illustrates a cover 1012*oo* having a handle 10178 that extends diagonally across the outer periphery 1024*oo* of medial region 1014*oo*. Handle 10178 may be a strip of fabric or any of the handles described herein.

Figure 55:
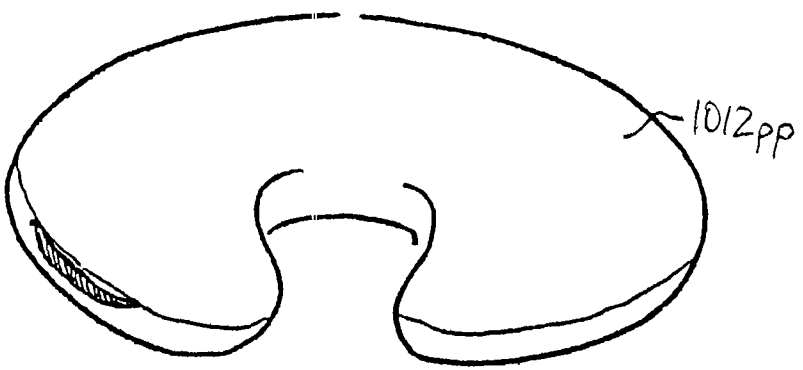
FIG. 55 is a perspective view of one embodiment of a cover that covers a support pillow, with the cover having a handle along one of the arms.

FIG. 55 illustrates a cover 1012*pp* having handle 10180 that is similar to handle 10176 of FIG. 53 except that handle 10180 is sewn directly into a seam 10182 that joins two pieces of material that form cover 1012*pp*.

Figure 56:
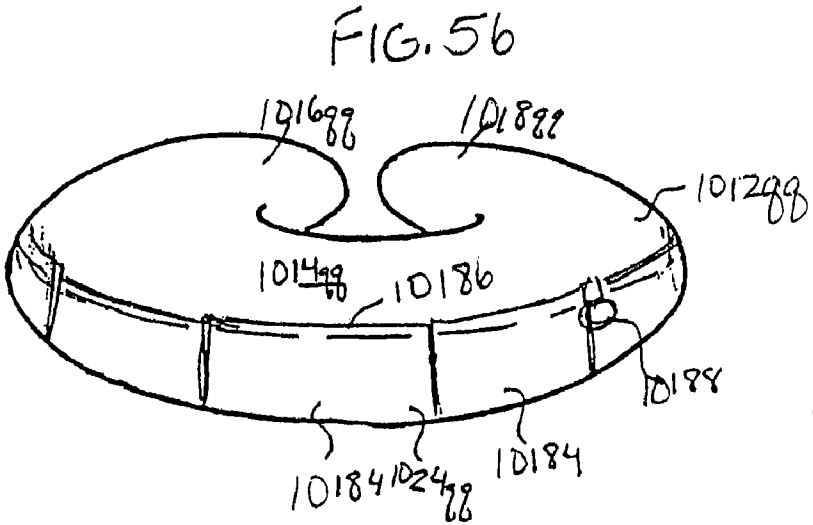
FIG. 56 is a perspective view of one embodiment of a cover that covers a support pillow, with the cover having pockets along the outer periphery at the medial region.

In some embodiments, the covers may be provided with various pockets. These may be provided essentially anywhere on the cover. As one example, FIG. 56 illustrates a cover 1012*qq* having a set of pockets 10184 along the outer perimeter 1024*qq*. These may be only at medial region 1014*qq* or may extend along arms 1016*qq* and 1018*qq*. The pockets 10184 have an open top end 10186 into which items may be placed. Optionally, one or more fasteners may be used to close the pockets. Further, the pockets may be expandable or stretchable to increase the holding capacity. Examples of items that may be held include toys, wipes, diapers, bottles, burp cloths, pacifiers, accessories and the like. Optionally an attachment 10188 may be provided to permit items to be attached to cover 1012*qq*.

Figure 57:
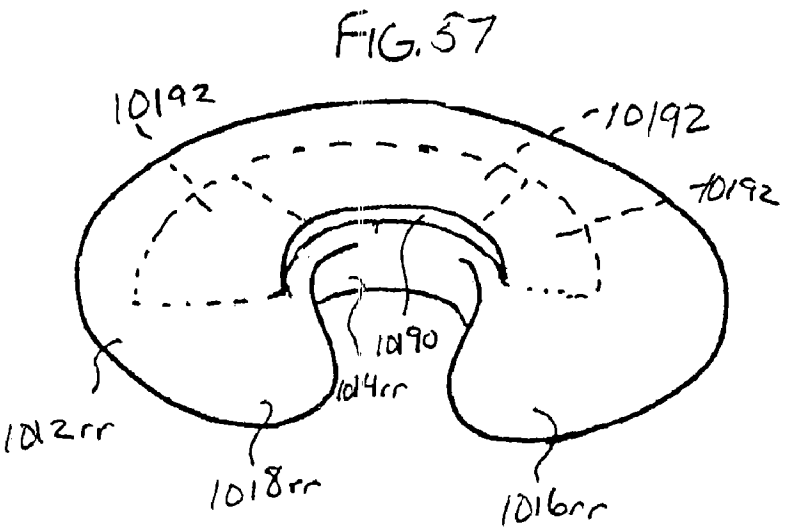
FIG. 57 is a perspective view of one embodiment of a cover that covers a support pillow, with the cover having pockets along the face of the medial region.

FIG. 57 illustrates a cover 1012*rr* having an opening 10190 providing access to a set of internal pockets 10192 that are on a generally flat surface of the pillow. These pockets may be at medial region 1014*rr*, as well as along arms 1016*rr* and 1018*rr* and may be formed using a piece of fabric that is coupled to the inside of cover 1012*rr*. Examples of items that may be held in pockets 10192 include aromatherapy packs, sound or vibration units, therapeutic magnets, padding and the like.

Figure 58:
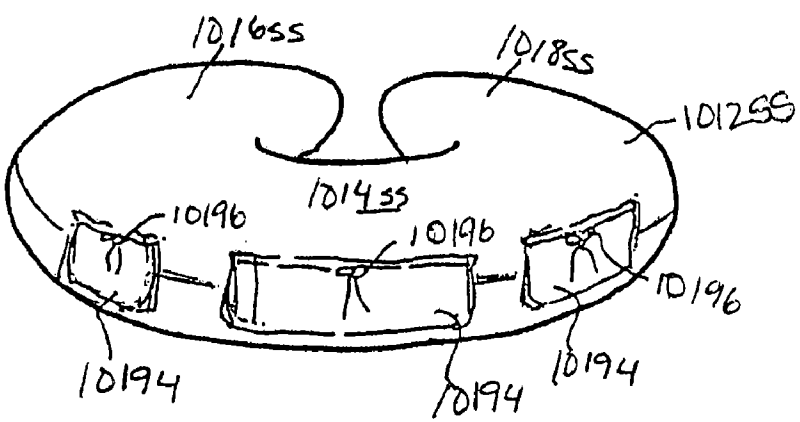
FIG. 58 is a perspective view of one embodiment of a cover that covers a support pillow, with the cover having pockets along the outer periphery at the medial region.

FIG. 58 illustrates a cover 1012*ss* having pockets 10194 along the outer perimeter 1024*ss*. Pockets 10194 have ties 10196 that may be tied together to close the pockets. Also, other fasteners may be used as described herein.

Figure 59:
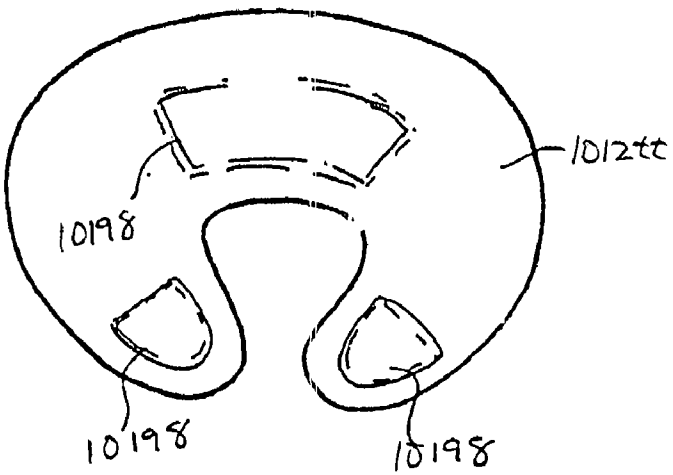
FIG. 59 is a perspective view of one embodiment of a cover that covers a support pillow, with the cover having pockets on the medial region and the arms.

FIG. 59 illustrates a cover 1012*tt* having a set of internal pockets 10198 for holding items similar to that described in FIG. 46. Although shown with three spaced apart pockets, it will be appreciated that other numbers and spacing may be used.

FIG. 60 illustrates a cover 1012*uu* having several attachments 10200 for attaching various items to cover 1012*uu*. Attachments 10200 comprise loops that are sewn into a seam 10202 in cover 1012*uu*. A variety of items may be coupled to the loops, such as plastic links 10204 that are connected to toys 10206. This permits toys or other items to be coupled to a pillow by covering the pillow with cover 1012*uu*. In this way, a preexisting pillow does not need to be modified to have toys attached. One example of a pillow having attachments is described in U.S. Pat. No. 5,546,620, incorporated herein by reference. With cover 1012*uu*, such attachments to do need to be made directly on the pillow, thereby making the pillow more versatile in its uses. Also, it will be appreciated that other attachments may be used including clips, hooks, straps and the like.

Figure 61:
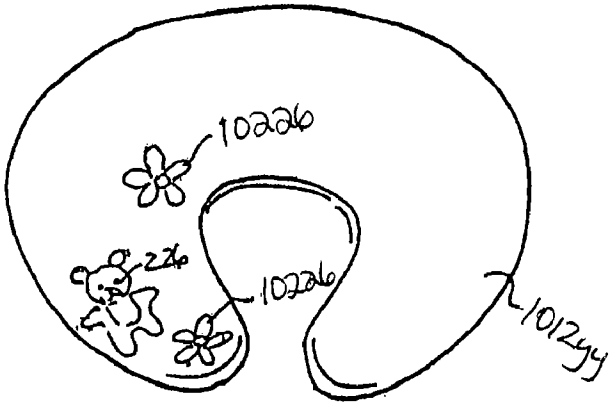
FIG. 61 is a top view of one embodiment of a cover that covers a support pillow, with the cover having one arrangement of appliqués.

Various appliqués may also be added to any of the covers described herein. Some examples of such appliqués are illustrates in FIGS. 61-64. These covers may have openings and fasteners similar to the other covers described herein. In FIG. 61, a cover 1012*yy* has a set of objects 10226. These may be sewed, glued, painted or the like to cover 1012*yy*. As shown, objects 10226 are single objects that are separated from each other. However, they could be combined in a scene or connected together.

Figure 62:
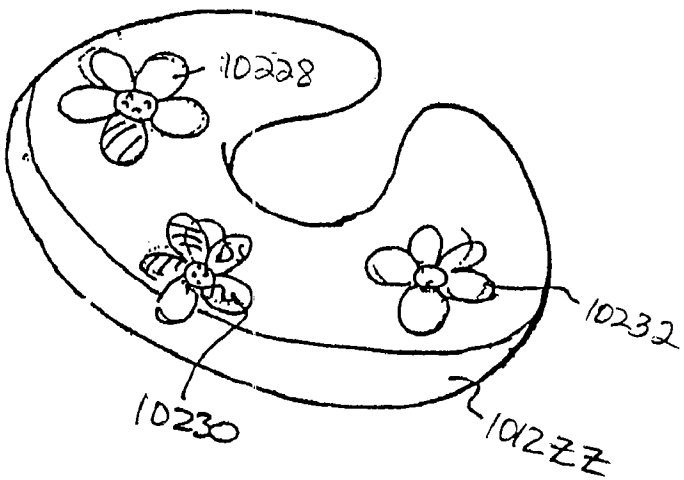
FIG. 62 is a perspective view of one embodiment of a cover that covers a support pillow, with the cover having another arrangement of appliqués.

In FIG. 62, a cover 1012*zz* has a set of objects 10228, 10230 and 10232. Object 10228 may comprise a crinkle material that crinkles when played with by a baby. Object 10230 may be constructed of materials with different textures, such as on each pedal of the flower. Object 10232 may be configured to squeak when pressure is applied.

Figure 63:
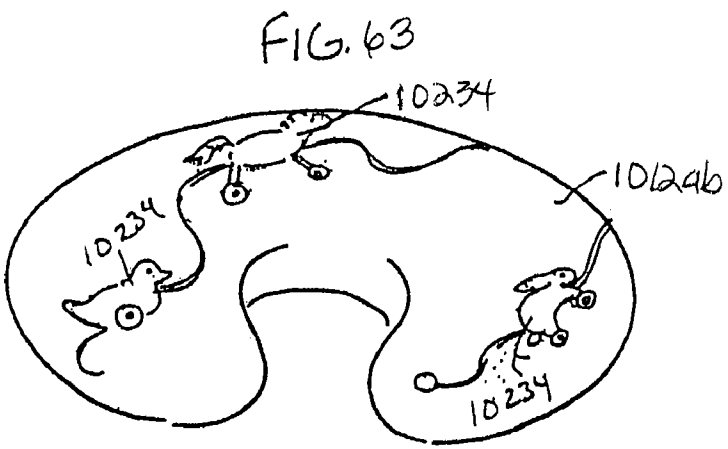
FIG. 63 is a perspective view of one embodiment of a cover that covers a support pillow, with the cover having a further arrangement of appliqués.

FIG. 63 illustrates a cover 1012*ab* with a set of connected objects 10234 that are similar to cover 1012*yy*, but are interconnected.

Figure 64:
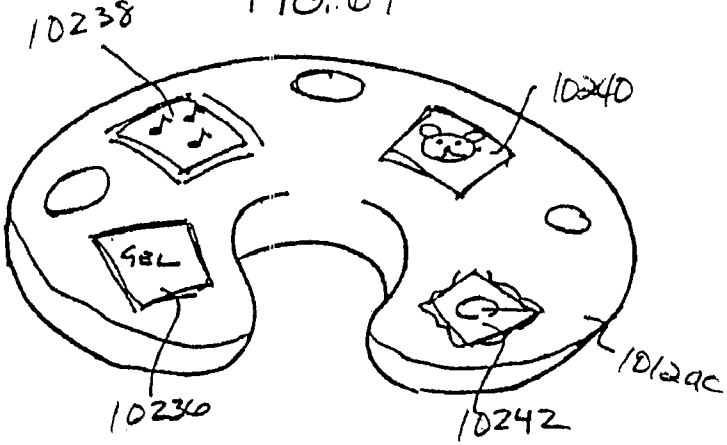
FIG. 64 is a perspective view of one embodiment of a cover that covers a support pillow, with the cover having still a further arrangement of appliqués.

FIG. 64 illustrates a cover 1012*ac* having a variety of objects with various features. These objects may be covered with a material or otherwise attached to the cover 1012*ac*. Object 10236 comprises a gel pack that may be pressed to give a "squishy" feel. Object 10238 comprises a pressure sensitive sound chip that produces a sound or music when pressed. Object 10240 comprises an appliqué that squeaks when pressed. Object 10242 comprises a material that crinkles when touched.

Figure 65:
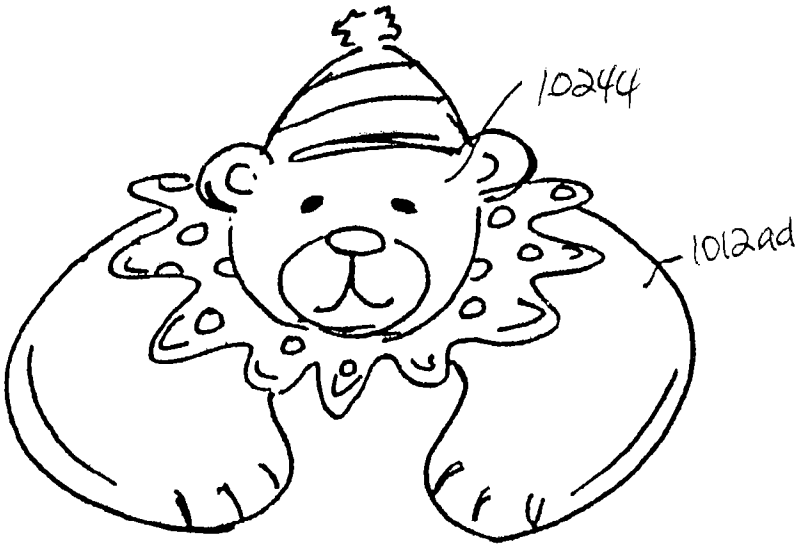
FIG. 65 is a perspective view of a cover having an animal head.

FIG. 65 illustrates a cover 1012*ad* having a clown head 10244. Cover 1012*ad* may include an opening and a fastener to close the opening similar to the other covers described herein. Although shown with a clown head, other items may be used as well, including other characters, body parts, and essentially any other types of object.

Figure 66:
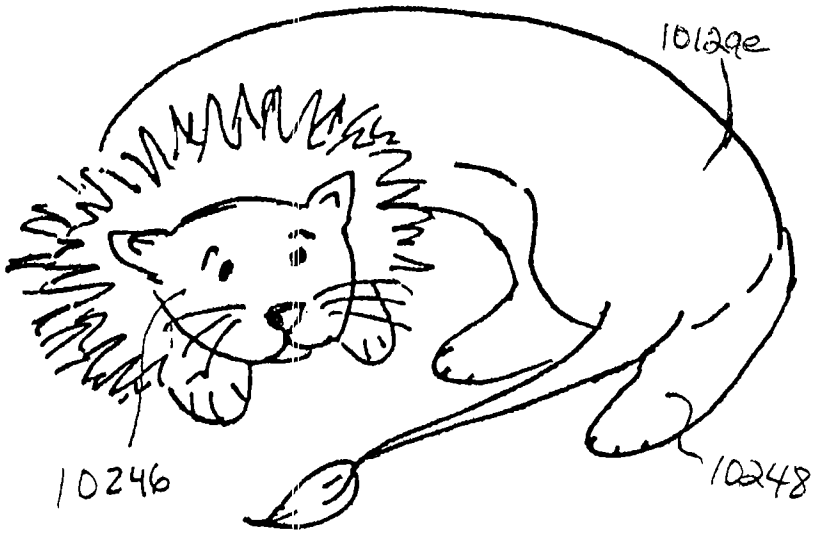
FIG. 66 is a perspective view of a cover in the shape of an animal.

FIG. 66 illustrates a cover 1012*ae* in the shape of a lion, including a head 10246 and feet 10248. Other objects may be used as well. For instance, the cover could include a puppy head and paws and tails on ends of the arms, flower petals and leaves, and the like. Other examples of characters are described in U.S. Pat. No. 6,055,687, incorporated herein by reference.

One advantage of using covers 1012*ad* and 1012*ae* is that a cover may be used to convert a conventional pillow to have a character or other item. This increases the versatility of a conventional pillow.

Figure 67:
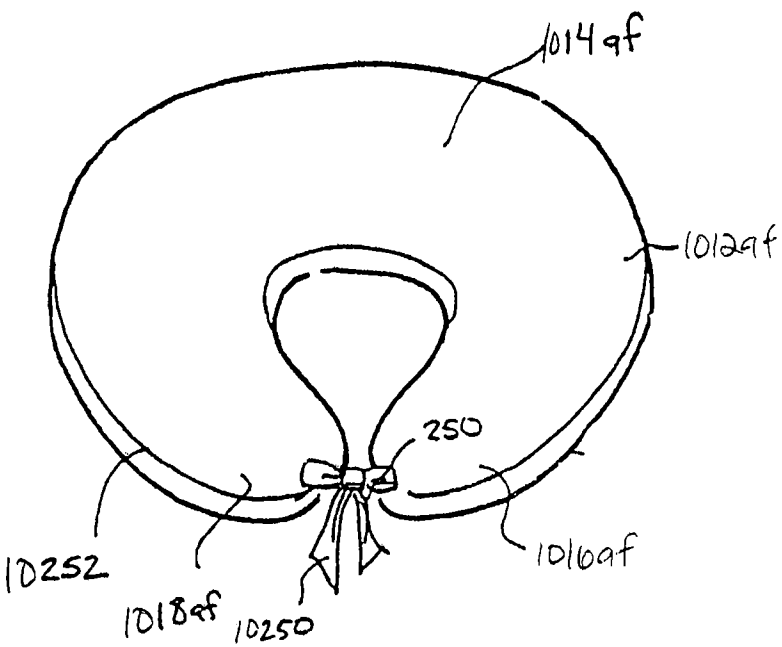
FIG. 67 is a front perspective view of one embodiment of a cover that covers a support pillow, with the cover having ties at the ends of the arms.

FIG. 67 illustrates a cover 1012*af* that may be particularly useful with a newborn or a small infant. Cover 1012*af* may be placed over a pillow using any of the techniques described herein. Cover 1012*af* also includes a pair of ties 10250 that are affixed to each end 1016*af* and 1018*af*. For example, ties 10250 could be sewn into a center seam 10252 of cover 1012*af*. Ties 10250 may each have a length of about 4 inches to about 10 inches, and more typically from about 6 to about 7 inches. Materials that may be used for ties 10250 include fabric strips, webbing, rope, string, leather straps and the like. In use, ties 10250 are crossed and pulled together to pull arms 1016*af* and 1018*af* together. In so doing, the small infant is better held within the well created by the pillow. Optionally, ties 10250 may be tied in the shape of a bow, or may use some other type of knot. As another alternative, various connectors or fasteners may be used to keep the arms close to each other. For example, the arms could be pulled together and then held in place using a buckle (such as on a backpack strap), or cinched together using a grip buckle. Other possible buckles or fasteners include press buckles, twist locks, slip locks, tuck buckles, cord locks, a hook and loop fastener material and the like.

Figure 68:
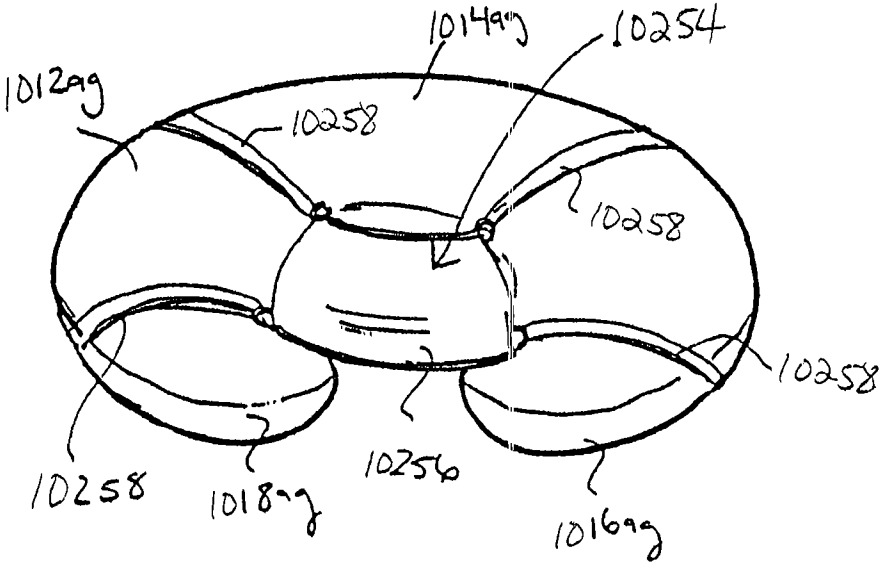
FIG. 68 is a front perspective view of one embodiment of a cover that covers a support pillow, with the cover having a harness.

FIG. 68 illustrates a cover 1012*ag* having a harness 10254. Harness 10254 has a holding region 10256 onto which the infant is rested and extends over the well region. For example, the infant could be place in a supine position on holding region 10256, with the harness 10254 holding the infant off the ground. A variety of techniques may be used to couple harness 10254 to cover 1012*ag*. For example, harness 10254 could be permanently attached to cover 1012*ag*, or could be removable (in which case harness 10254 could be placed directly onto a pillow that does not have a cover). As shown, harness 10254 includes a set of straps 10258 that are coupled to holding region 10256. Straps 10258 could be sewn or glued to cover 1012*ag*, or simply looped around arms 1016*ag* and 1018*ag* and/or medial region 1014*ag*. Further, instead of using straps, other materials could be used, such as a webbing material, a wide piece of fabric or the like. In some cases, holding region 10256 could be directly coupled to cover 1012*ag*, such as by sewing.

Figure 69:
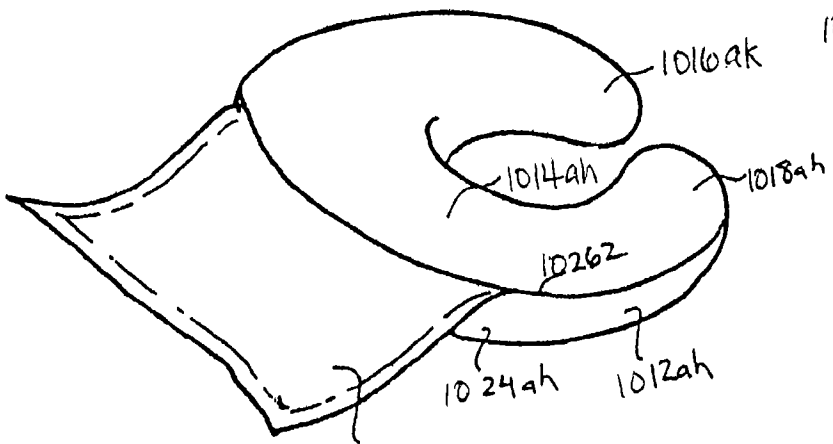
FIG. 69 is a perspective view of one embodiment of a cover that covers a support pillow, with the cover having a blanket coupled thereto.

FIG. 69 illustrates a cover 1012*ah* that may be placed over a pillow using any of the techniques described herein. Attached to cover 1012*ah* is a blanket 10260 that may be used to permit a child to lay on the floor, similar to that described in U.S. Pat. Nos. 5,546,620 and 6,523,200, incorporated herein by reference. As shown, cover 10260 is sewed into a seam 10262; however, it will be appreciated that other techniques may be used, such as by gluing, buttons, snaps, and the like. Also, in some cases, blanket 10260 may be removable from cover 1012*ah*. By using cover 1012*ah*, a pillow may be converted to have a blanket, simply by placing cover 1012*ah* over the pillow. Blanket 10260 may extend anywhere along outer periphery 1024*ah*, and may have a length sufficient to hold a baby. For example, the length could be from about 18 inches to about 3 feet.

Figure 70:
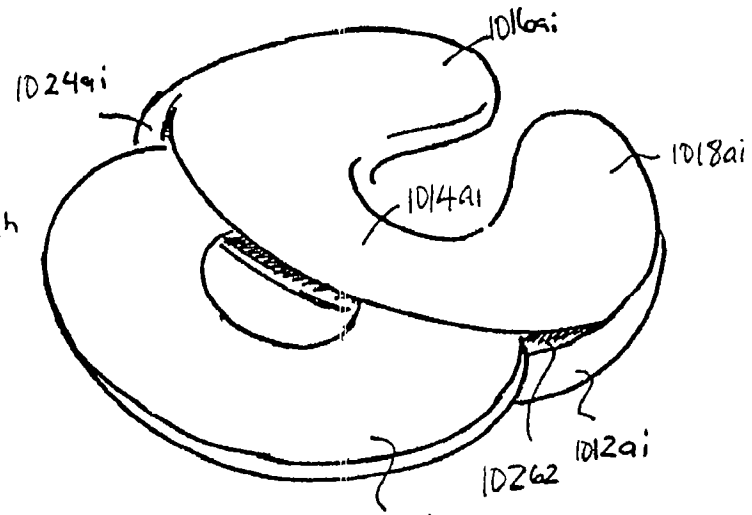
FIG. 70 is a rear perspective view of one embodiment of a cover that covers a support pillow, with the cover having an internal pocket for holding a padding layer.

FIG. 70 illustrates a cover 1012*ai* that may be attached to a pillow using any of the techniques described herein. In one particular arrangement, cover 1012*ai* may have an opening 10262 where the pillow may be inserted. Opening 10262 also permits a padding layer 10264 (having the same general shape as the pillow) to be inserted between the pillow and cover 1012*ai*. In some cases, a pocket may be coupled to cover 1012*ai* to hold padding layer 10264 in position.

Padding layer 10264 may be used to raise the height of the pillow, give it a slightly different shape or simply provide a different type of padding. For example, padding layer 10264 may comprise one or more layers of polyurethane foam, foam rubber, a visco-elastic material, or the like and may have a height in the range from about ½ inch to about 5 inches. In some cases, the surface of padding layer 10264 could be angled or contoured to alter the shape of the pillow. In other cases, padding layer 10264 may be constructed of a relatively dense or stiff material to increase the firmness of the pillow. Also, padding layers of different sizes may be used to adjust the shape of the pillow.

Figure 72:
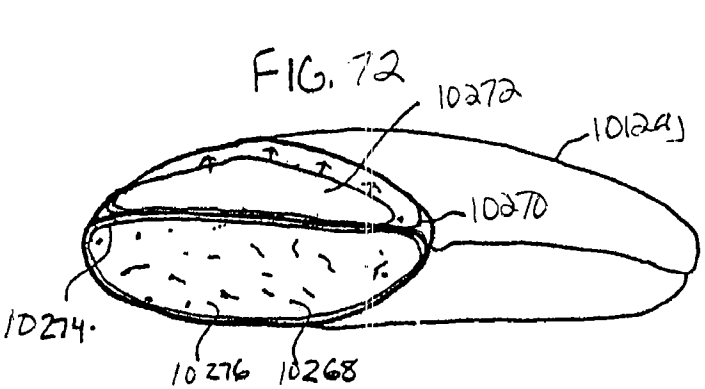
FIG. 72 is a cross-sectional view of the pillow and cover of FIG. 71 taken along lines 62-62.
Figure 71:
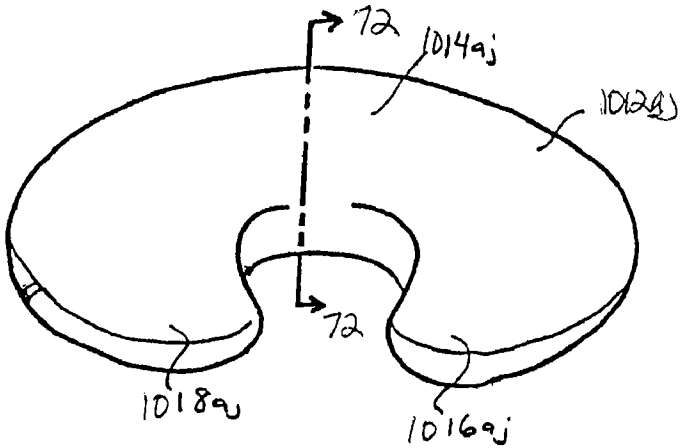
FIG. 71 is a perspective view of one embodiment of a cover that covers a support pillow, and an inflatable bladder between the cover and the pillow.

FIG. 71 and FIG. 72 illustrate a cover 1012*aj* that may be placed over a pillow 10268 using any of the techniques described herein. Cover 1012*aj* includes an optional interior pocket 10270 for holding an inflatable bladder 10272. Alternatively, bladder 10272 could be placed directly between the shell 10274 that encompasses the fill material 10276 of pillow 10266 and cover 1012*aj*. Also, cover 1012*aj* may include an opening similar to cover 1012*ai* for inserting and removing bladder 10272. When inflated, bladder 10272 expands as illustrated by the arrows. Bladder 10272 may be inflated with air, a liquid, or the like and may be inflated to different pressures to adjust the firmness and or shape of the pillow. Further multiple bladders of different sizes and shapes may be used.

Figure 74:
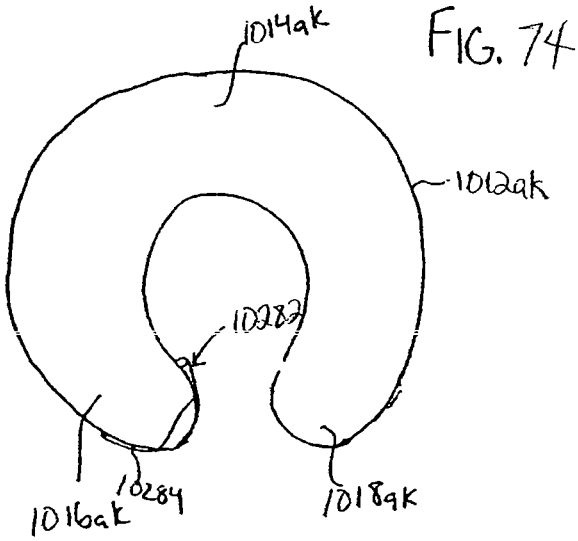
FIG. 74 is a bottom view of the pillow and cover of FIG. 73.
Figure 73:
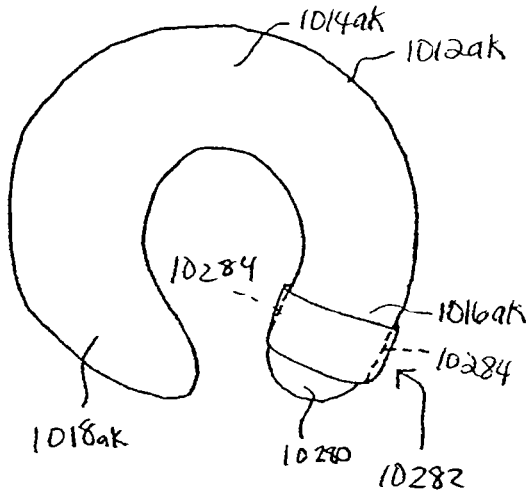
FIG. 73 is a top view of one embodiment of a cover that covers a support pillow, with the cover having a reversible pocket at one end for closing the cover over the pillow.

FIG. 73 illustrates another embodiment of a cover 1012*ak* that may be placed over a pillow 10280. Cover 1012*ak* has two ends, 1016*ak* and 1018*ak*, one or both of which may have an open end. At the open end is a reversible pocket 10282 (such as at end 1016*ak*). Pocket 10282 is sewn (or otherwise affixed) to sides 10284 of cover 1012*ak* in a reversed orientation. By having end 1016*ak* open, pillow 10280 may be inserted into cover 1012*ak* through the open end. To close cover 1012*ak*, pocket 10282 is reversed to the position illustrated in FIG. 74 and FIG. 75 where it is folded over the end of the pillow to enclose the pillow. In this way, pocket 10282 operates somewhat similar to a traditional sandwich bag. To remove pillow 10280, pocket 10282 is simply reversed back to the position illustrated in FIG. 64 and pillow 10280 is pulled through the open end.

Figure 76A:
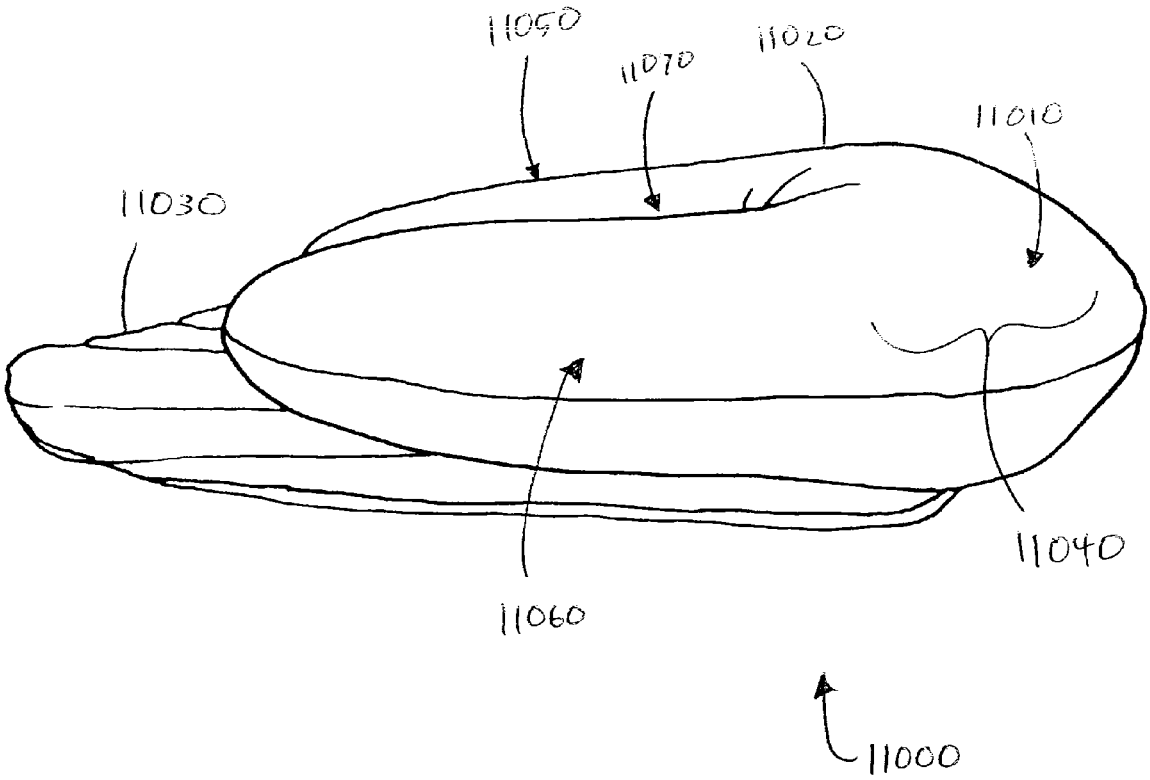
FIG. 76A is a perspective side view of a support pillow having a cushion body, a cover, and a mat coupled with the cover.
Figure 76B:
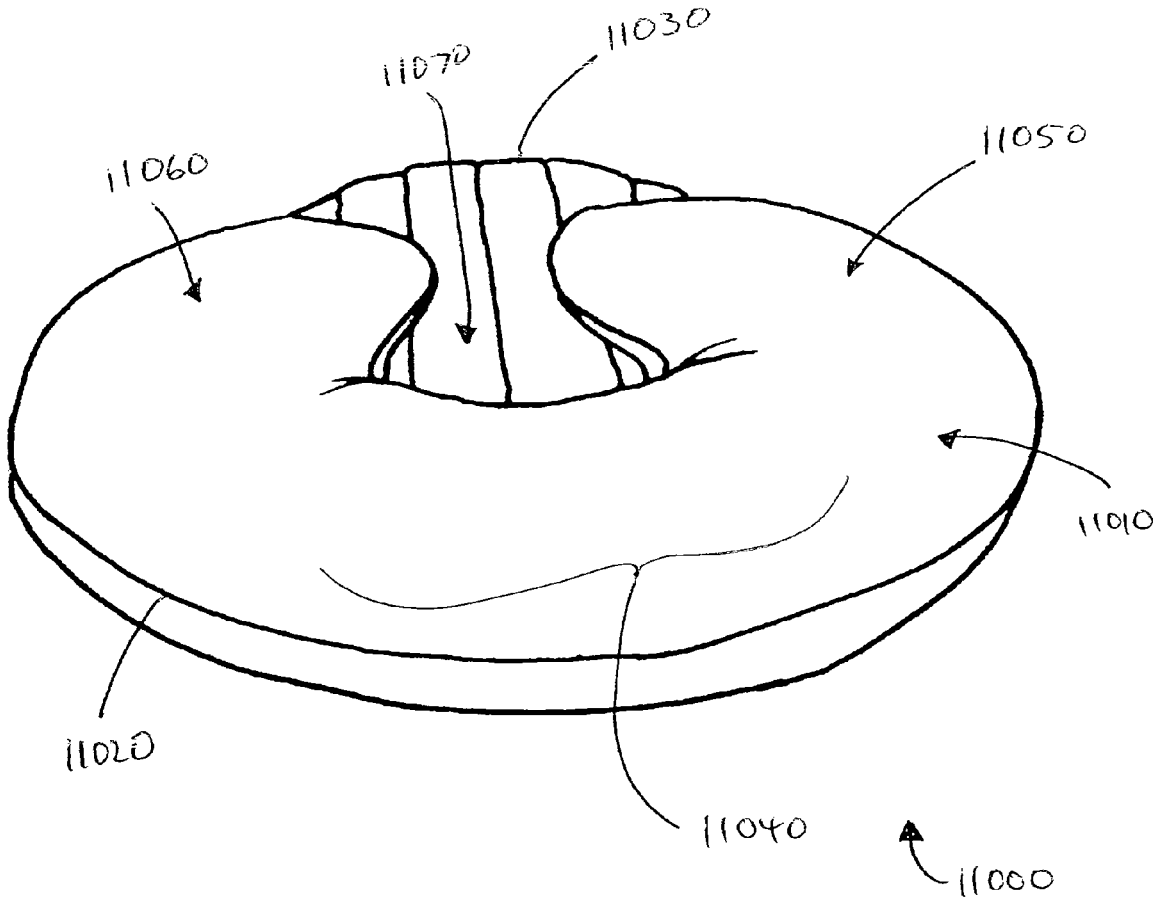
FIG. 76B is a perspective back view of the support pillow from FIG. 76A.
Figure 76C:
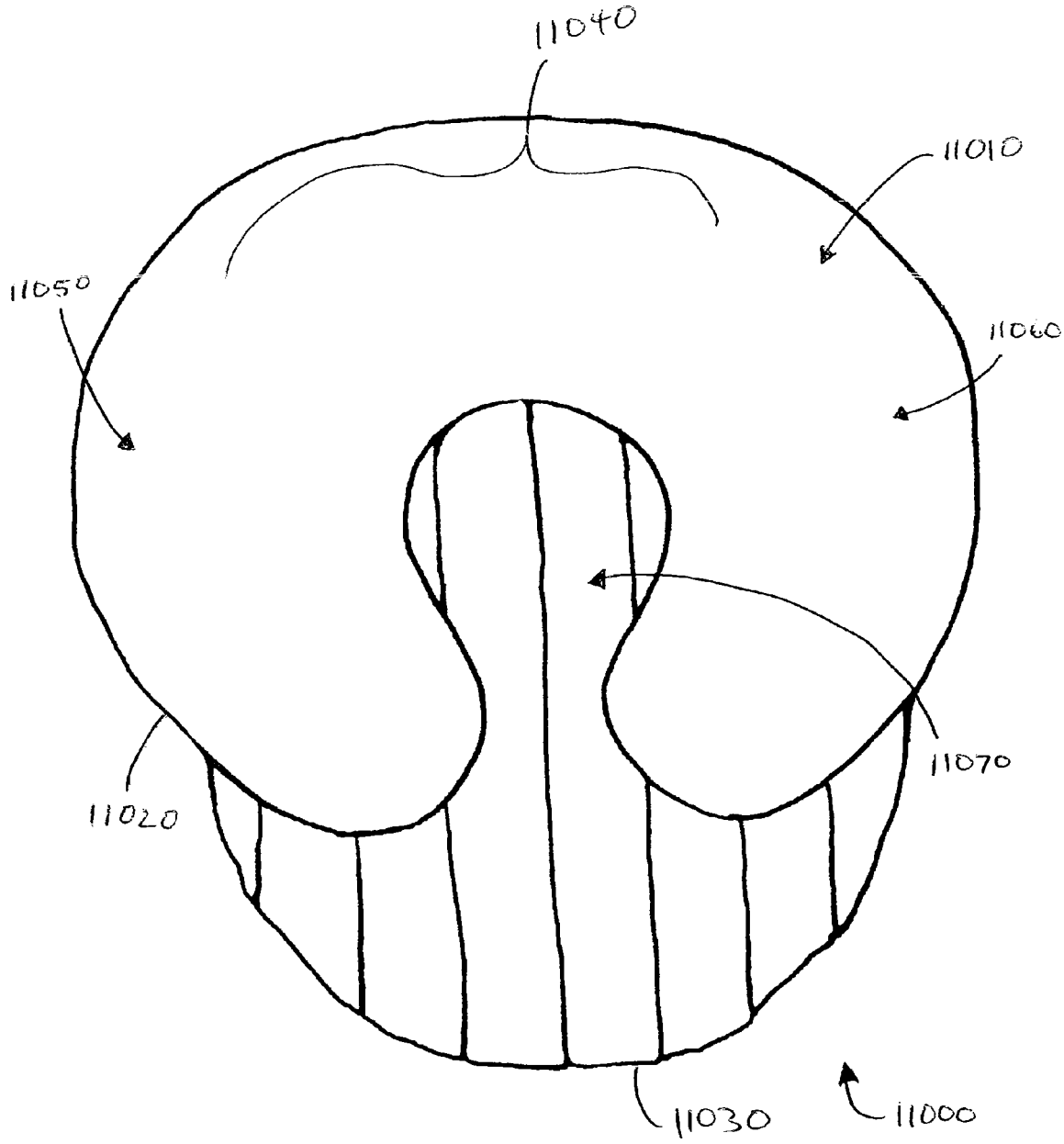
FIG. 76C is a top view of the support pillow from FIG. 76A.

FIG. 76A, FIG. 76B, and FIG. 76C illustrate another embodiment of the invention. In this embodiment, a support pillow 11000 is provided. Support pillow 11000 may include a cushion body 11010, a cover 11020, and a mat 11030. Cushion body 11010 may have a medial region 11040 and two opposing arms 11050, 11060 that define a generally open well 11070. Cushion body 11010 may include a shell and a fill material within the shell. Cover 11020 may be removably disposed over the shell of cushion body 11010 such that cover 11020 possibly conforms generally the shape of cushion body 11010. Mat 11030 may be coupled with cover 11020.

Figure 77A:
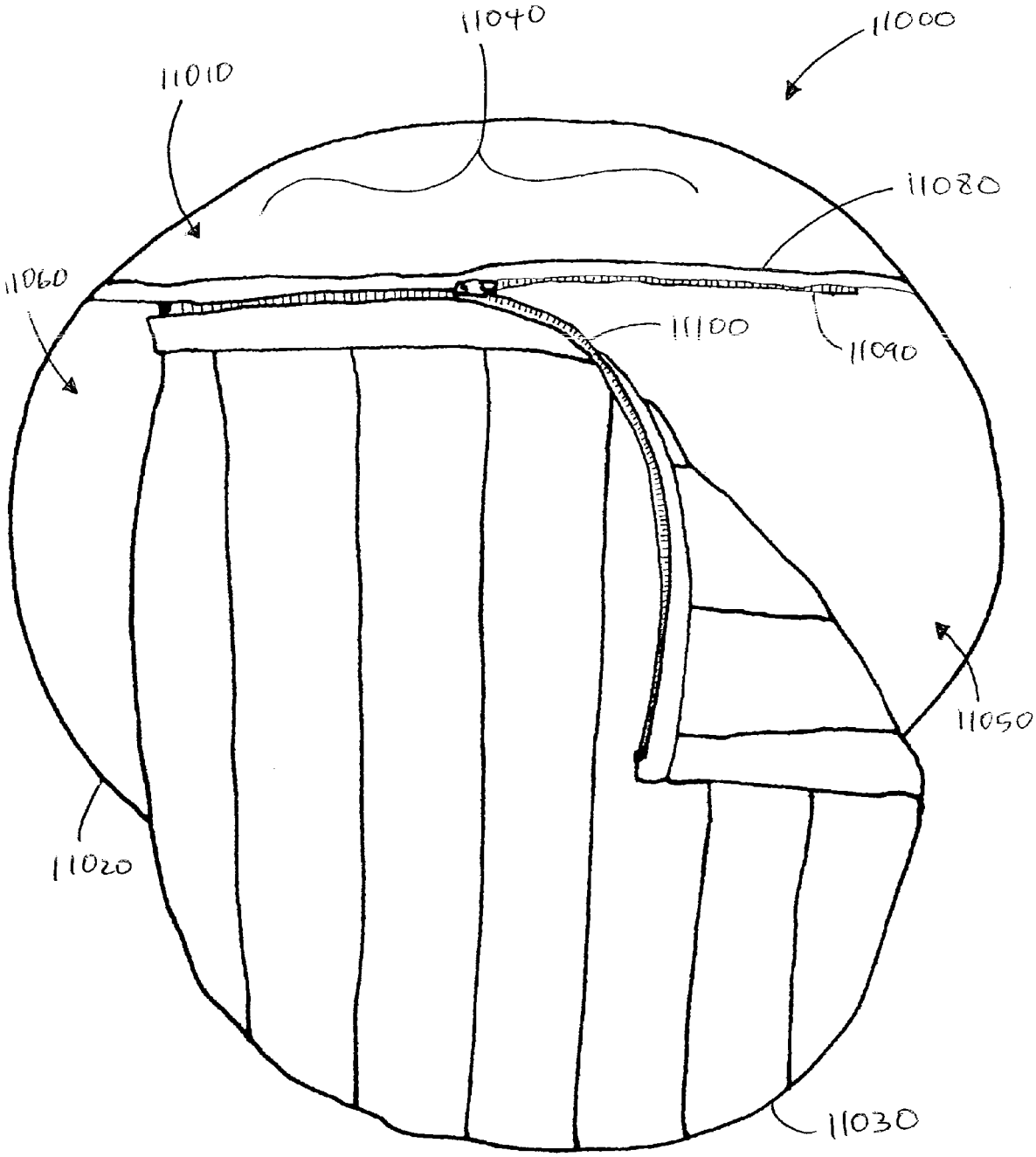
FIG. 77A is a bottom view of a support pillow having a cushion body, a cover and a mat detachably coupled with the cover at a seam.

In this embodiment, mat 11030 is shown coupled with cover 11020 beneath medial region 11040. In some embodiments, mat 11030 may be detachably coupled with cover 11020. Turning to FIG. 77A, such an embodiment is shown. FIG. 77A shows the bottom side of support pillow 11000. Under the medial region 11040, a seam 11080 couples a fastener 11090, in this example, half of a zipper mechanism, to cover 11020. Mat 11030 may have a matching fastener 11100, in this example, the other half of the zipper mechanism, to couple mat 11030 to cover 11020. Other possible type of fasteners include, but are not limited to, ties, buttons, buckles, hook and loop fastener material, snaps, reversible pockets and hooks.

Figure 77B:
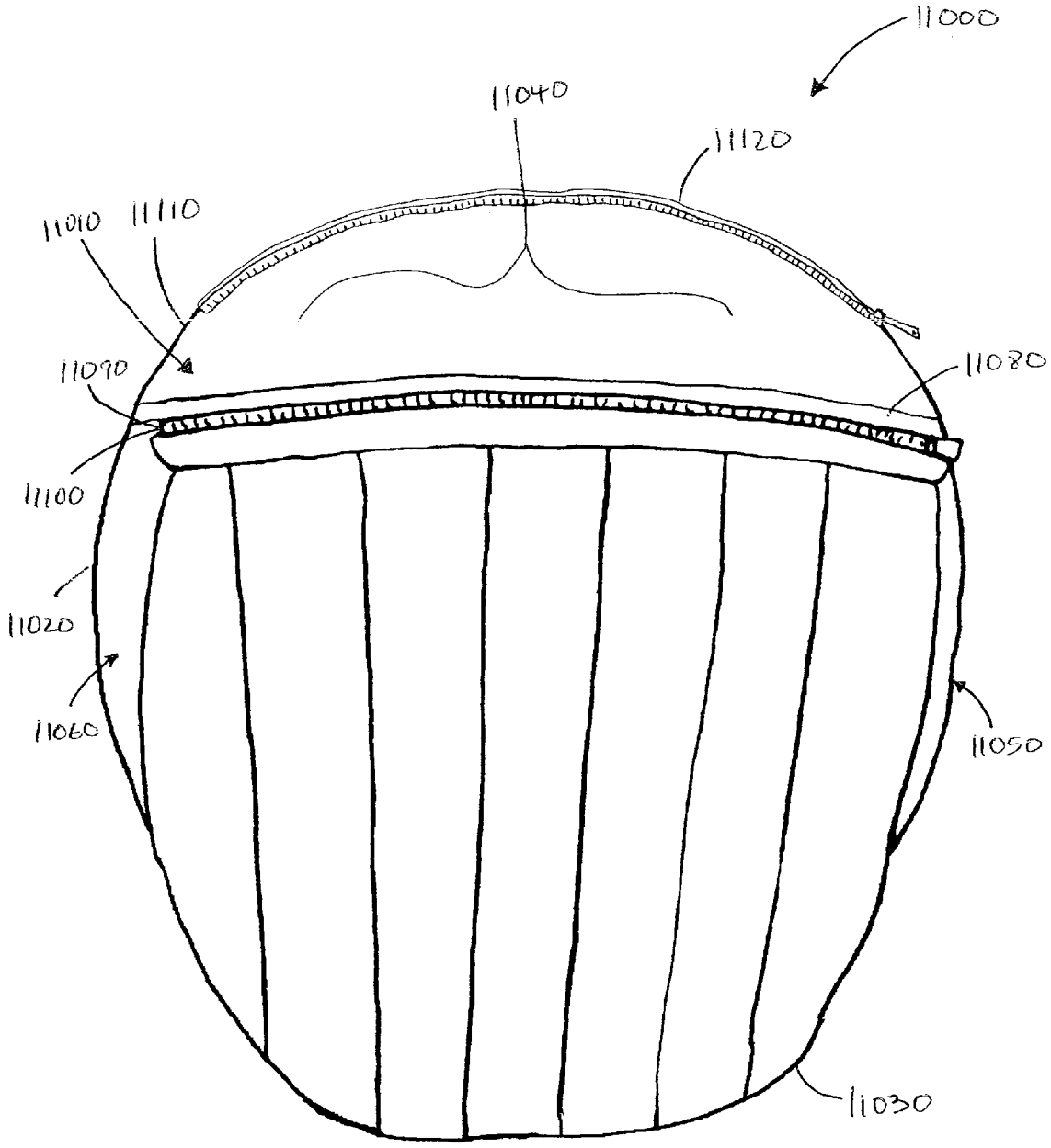
FIG. 77B is a bottom view of a support pillow having a cushion body, a cover and a mat detachably coupled with the cover at a seam, and also showing a fastener at another seam which allows the cover to be removably disposed over the cushion body.

As shown in FIG. 77B, in some embodiments, cover 11020 may include another seam 11110 that defines an opening to permit cover 11020 to be removable disposed over the shell of the cushion body 11010. Cover 11020 may include at least one fastener 11120, in this example shown as a zipper, coupled to the other seam 11110 to close the other seam 11110 once cover 11020 has been placed over cushion body 11010. In some embodiments, at least a portion of fastener 11120, normally used to close cover 11020 over cushion body 11010 may be used to couple mat 11030 to cover 11020.

Figure 78A:
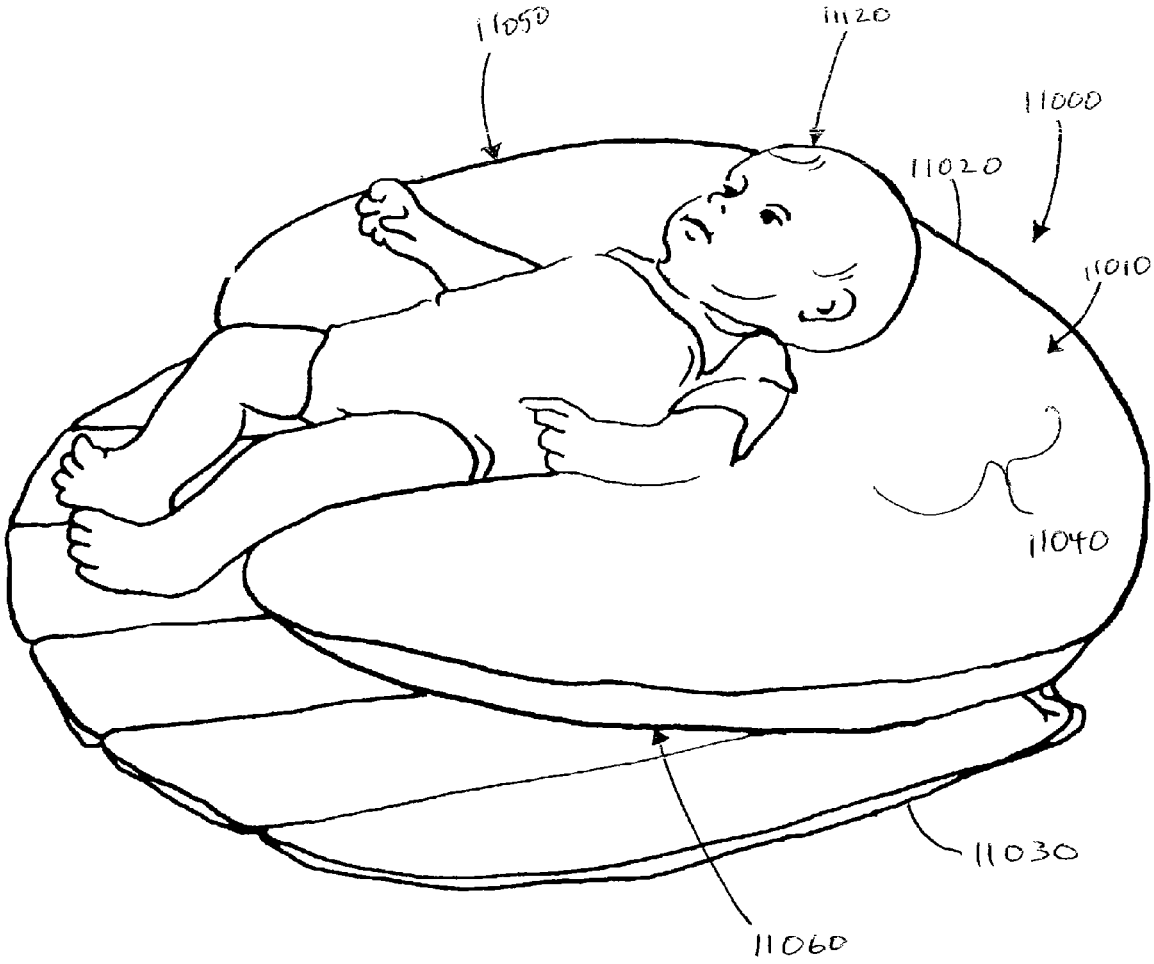
FIG. 78A is a perspective view of a baby with his back generally facing a mat detachably coupled with a cover of a support pillow, with the baby's head supported by the medial region of the support pillow.
Figure 78B:
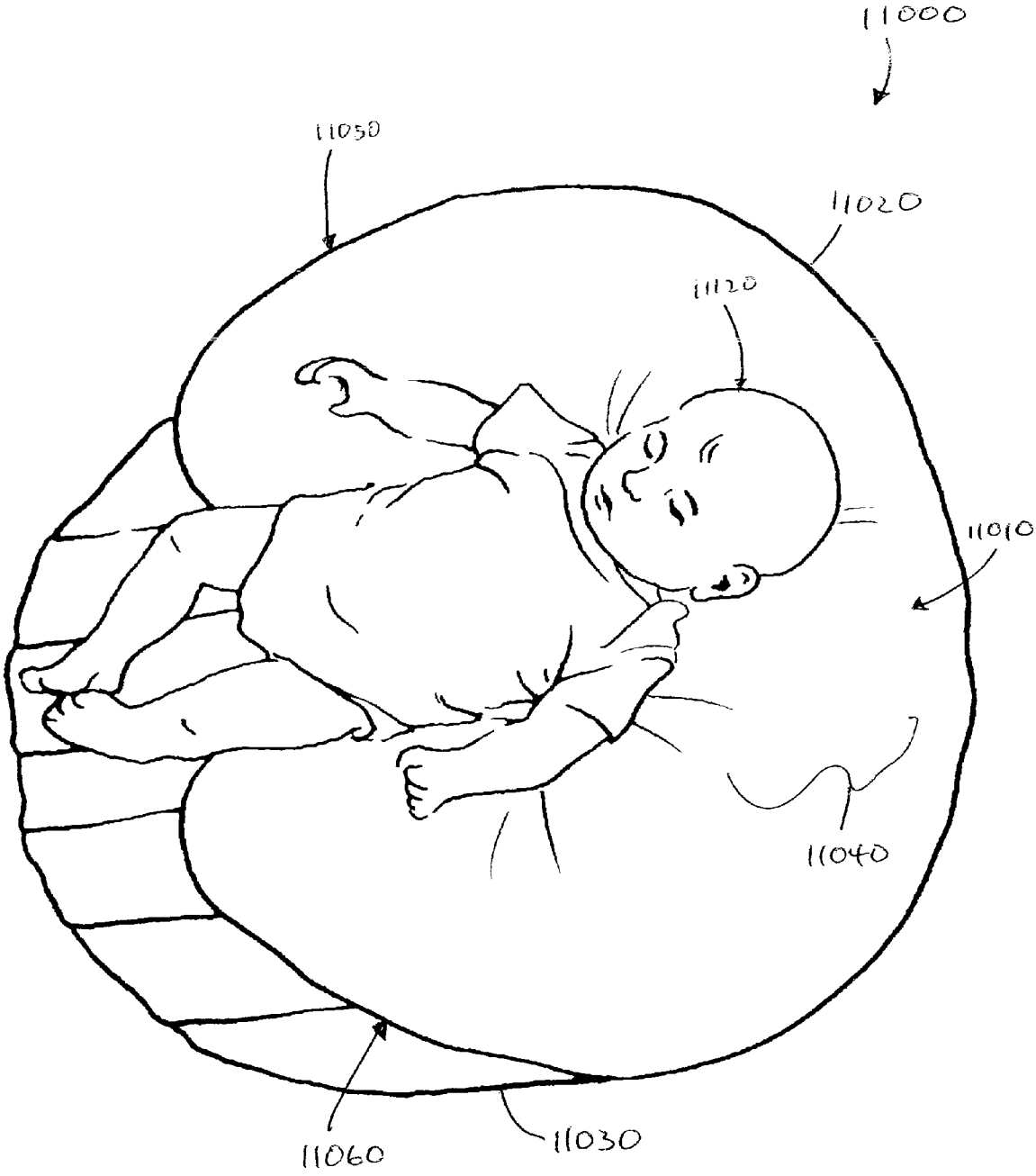
FIG. 78B is another perspective view of the baby and support pillow shown in FIG. 78A.
Figure 79:
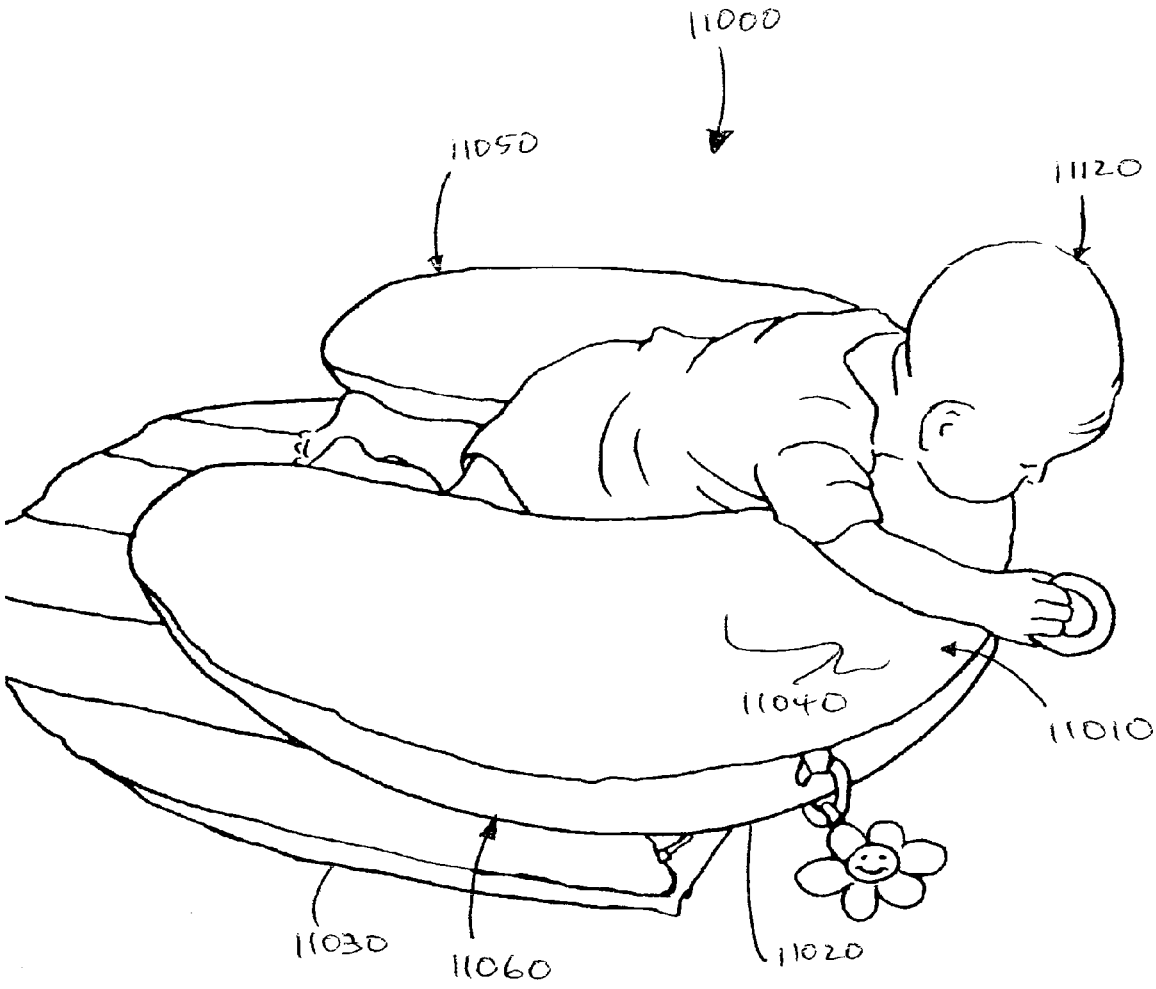
FIG. 79 is a perspective view of a baby with his back generally facing away from a mat detachably coupled with a cover of a support pillow, with the baby's upper torso supported by the medial region of the support pillow.

As shown in FIG. 78A and FIG. 78B, in another embodiment of the invention, a method of using a support pillow 11000 may be provided. The method may include providing support pillow 11000 having at least a cushion body 11010, a cover 11020, and a mat 11030. Cushion body 11010 may include a medial region 11040 and two opposing arms 11050, 11060 that define a generally open well 11070. The method may include placing support pillow 11000 onto a surface, and positioning mat 11030 to lie generally flat underneath the cushion body 11010 and well 11070. The method may further include placing a baby 11120 at least partially in well 11070, possibly as shown in FIG. 78A. In some embodiments, baby 11120 may be placed in well 11070 such that at least a portion of the baby's back is generally facing mat 11030. The baby's head may be supported by medial region 11040 in these embodiments. In other embodiments, such as the example shown in FIG. 79, baby 11120 may be place in well 11070 such that at least a portion of the baby's back is generally facing away from mat 11030. In these embodiments, at least a portion of the baby's upper torso may be supported by medial region 11040.

Figure 80:
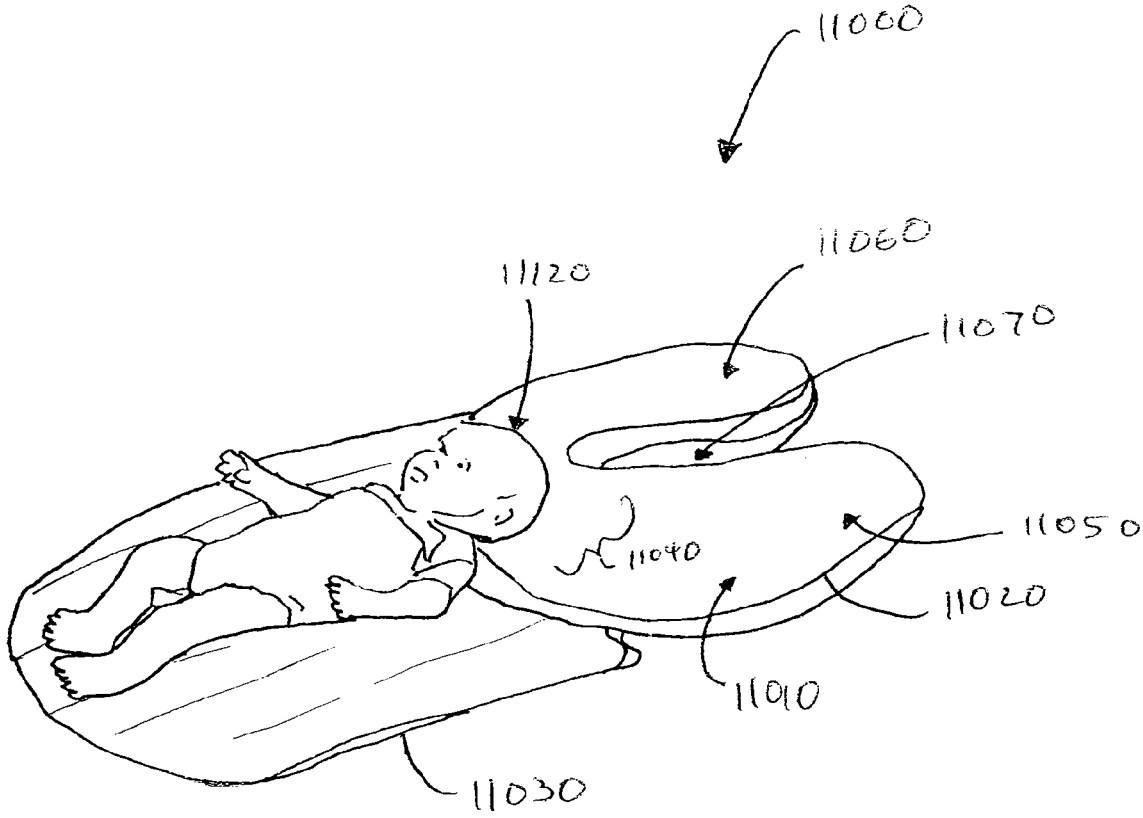
FIG. 80 is a perspective view of a baby with his back generally facing a mat detachably coupled with a cover of a support pillow, where the mat lies away from the well formed by the support pillow, with the baby's head supported by the medial region of the support pillow.
Figure 81:
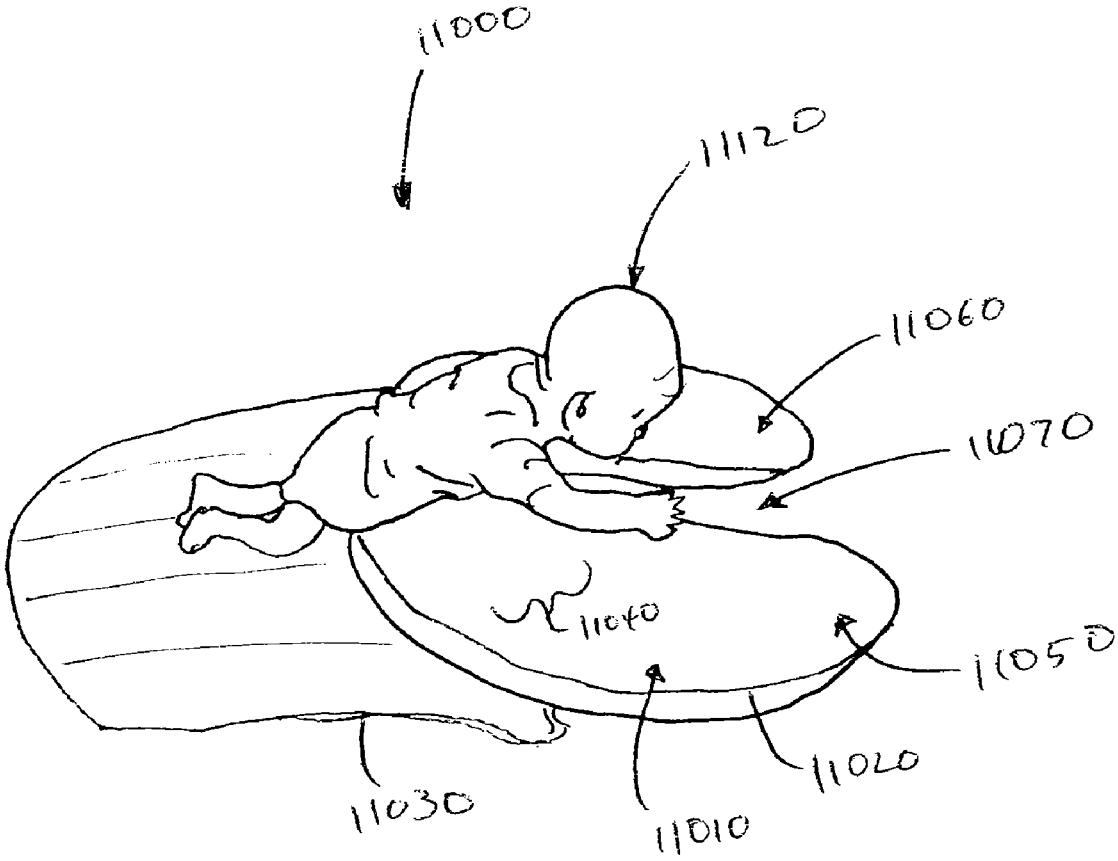
FIG. 81 is a perspective view of a baby with his back generally facing away from a mat detachably coupled with a cover of a support pillow, where the mat lies away from the well formed by the support pillow, with the baby's upper torso supported by the medial region of the support pillow.

As shown in FIG. 80 and FIG. 81, in another embodiment of the invention, another method of using a support pillow 11000 may be provided. In this embodiment, mat 11030 may be positioned such that mat 11030 lies generally flat on the surface and away from well 11070. Moreover, the method may include placing a baby 11120 at least partially on mat 11030 such that at least one of the baby's head or the baby's torso is supported by cushion body 11020. In one embodiment, such as that shown in FIG. 80, baby 11120 may be placed such that at least a portion of the baby's back is generally facing mat 11030. In this embodiment, at least a portion of the baby's head may be supported by medial region 11040. In another embodiment, such as that shown in FIG. 81, baby 11120 may be placed such that at least a portion of the baby's back is generally facing away from mat 11030. In this embodiment, at least a portion of the baby's upper torso may be supported by medial region 11040.

Figure 82:
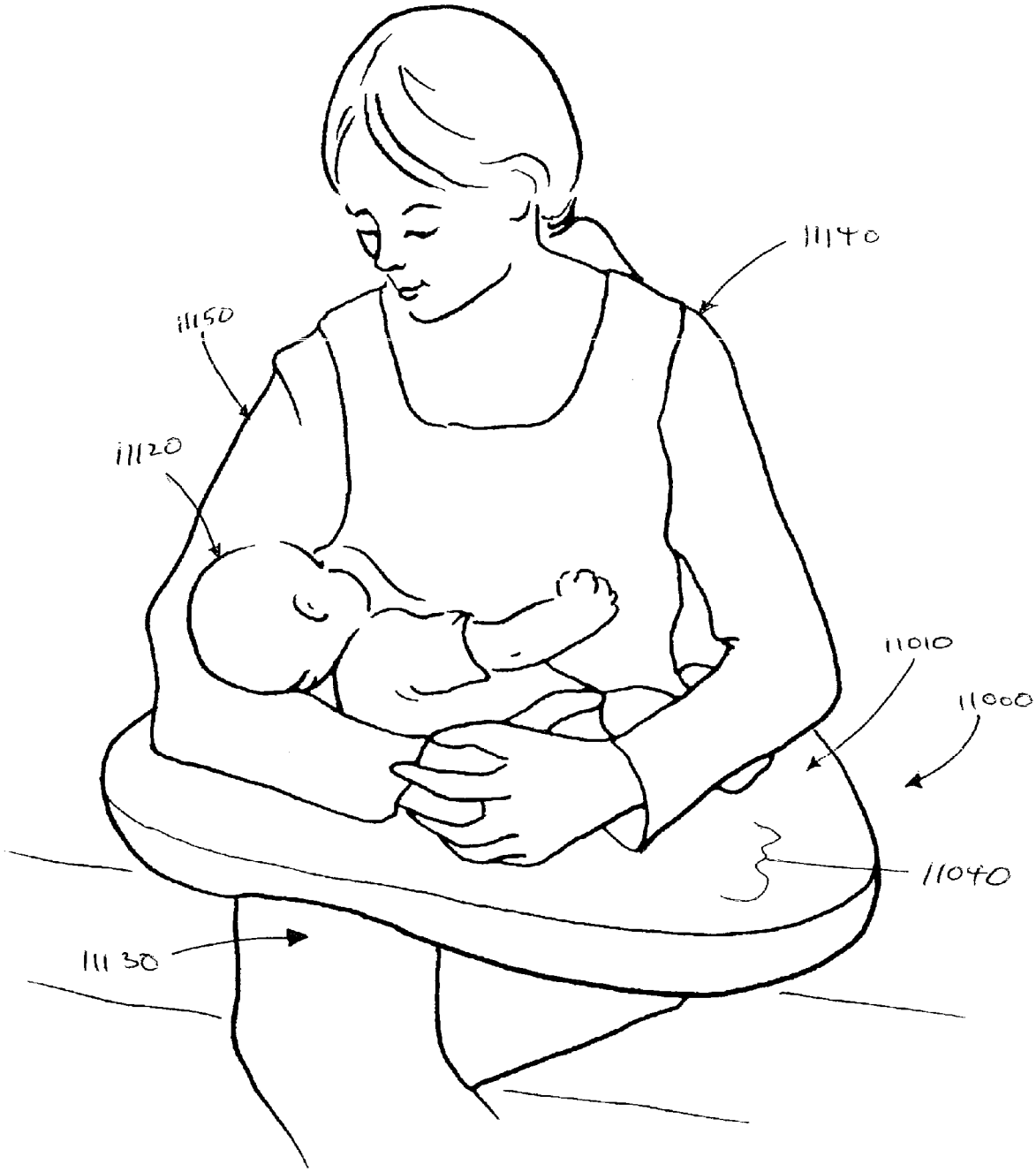
FIG. 82 is a perspective view of a caregiver nursing a baby on a support pillow having a cushion body, a cover, and a mat coupled with the cover; the cover may be hidden from view and be below the medial region of the cushion body.

As shown in FIG. 82, in another embodiment of the invention, another method of using a support pillow 11000 may be provided. In this embodiment, the method may include placing the cushion body 11010 on the lap 11130 of a caregiver 11140, where the waist or lower torso of caregiver 11140 is at least partially within well 11070, and where medial region 11040 is on lap 11130 of caregiver 11 140. The method may also include placing a baby 11120 at least partially above medial region 11040 such that at least a portion of the baby's back is generally facing medial region 11040. In some embodiments, the method may further include positioning baby 11120 such that caregiver 11140 may care for, nurse, or feed baby 11120, and then caring for, nursing or feeding baby 11120. In some embodiments, the method may further include positioning the caregiver's arm 11150 between the baby's head and the support pillow 11000. When employing these methods, mat 11030 may possibly hang down over the caregiver's legs, or possibly be folded underneath support pillow 11000.

Figure 83A:
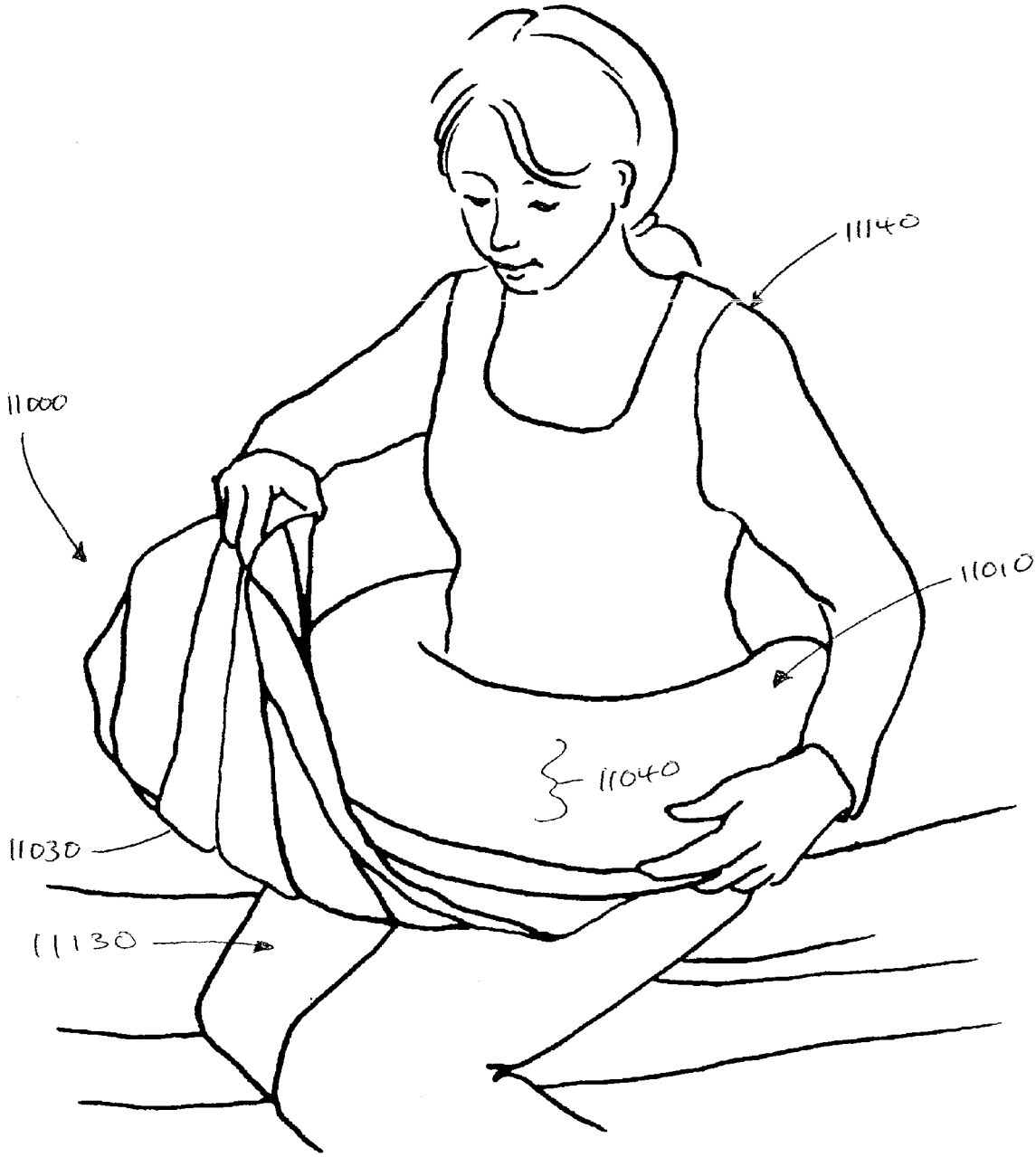
FIG. 83A is a perspective view of a caregiver beginning to fold the mat of a support pillow over the top of the medial region of the support pillow.
Figure 83B:
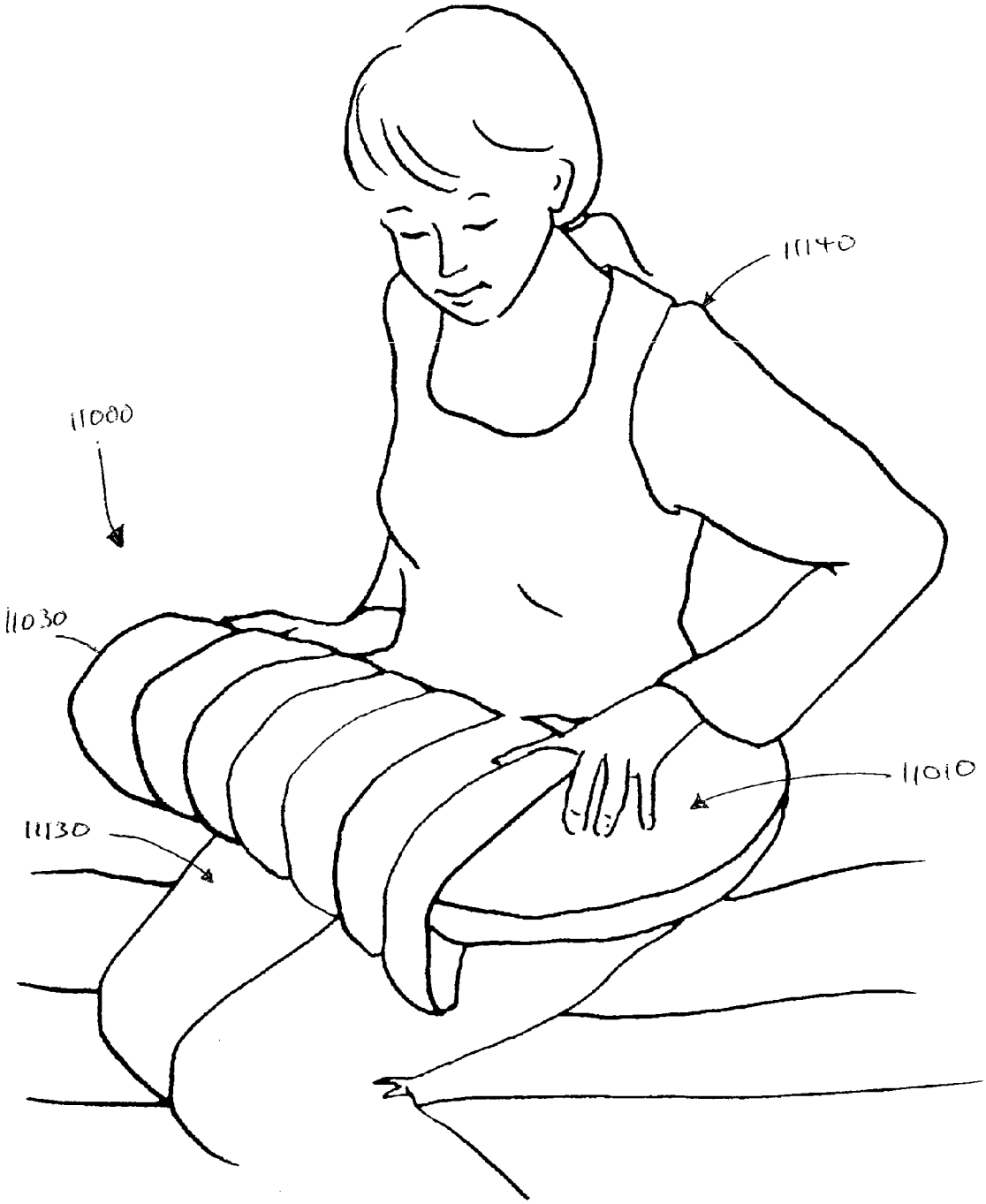
FIG. 83B is a perspective view of a caregiver completing the fold of the mat of a support pillow over the top of the medial region of the support pillow.
Figure 83C:
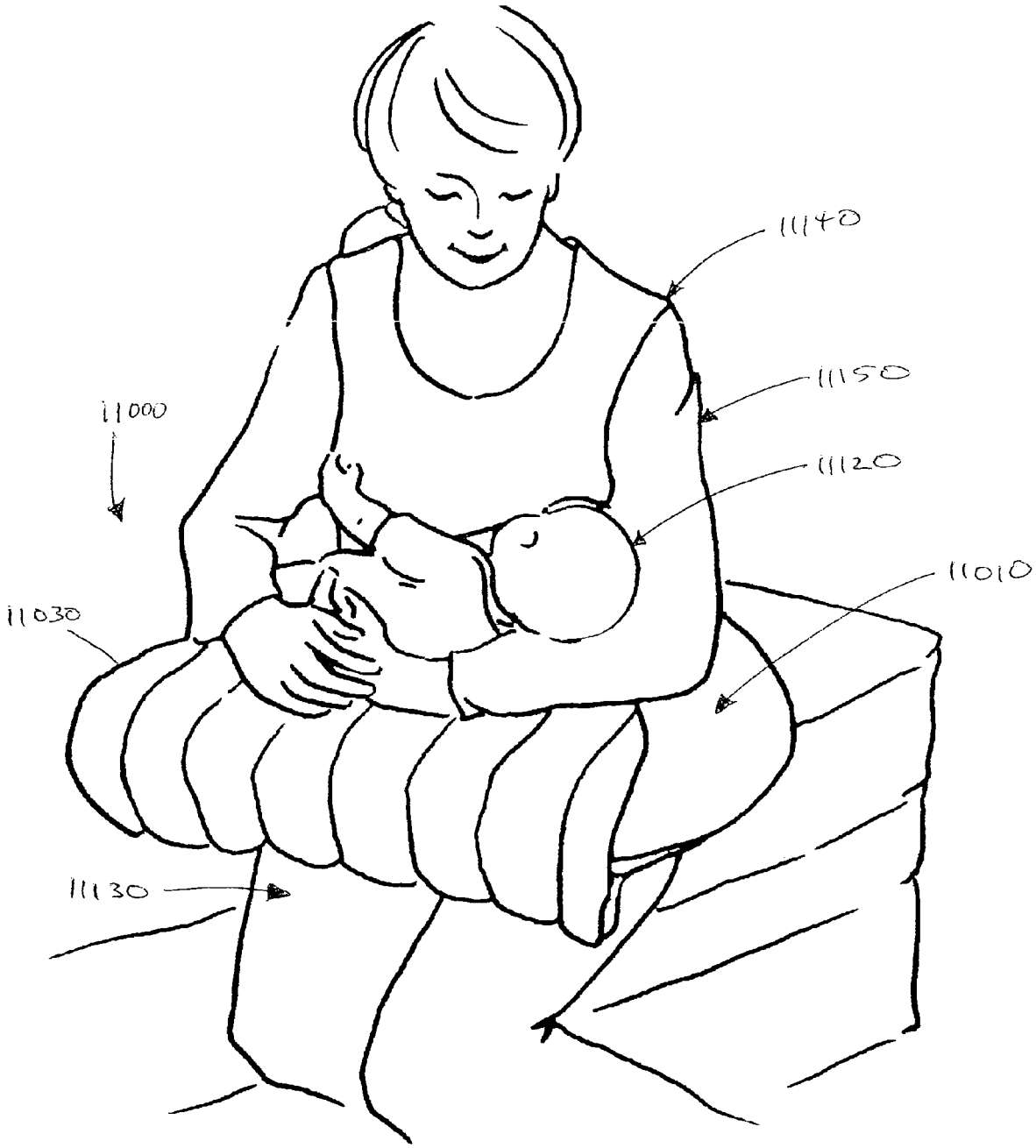
FIG. 83C is a perspective view of a caregiver nursing a baby on a support pillow, with the mat disposed between the cushion body and the baby.

As shown in FIG. 83A, FIG. 83B, and FIG. 83C, in another embodiment of the invention, another method of using a support pillow 11000 may be provided. In this embodiment, the method may include placing the cushion body 11010 on the lap 11130 of a caregiver 11140, where the waist or lower torso of caregiver 11140 is at least partially within well 11070, and where medial region 11040 is on lap 11130 of caregiver 11140. The method may also include positioning mat 11030 to lie at least partially above the cushion body 11010, and placing baby 11120 at least partially on top of mat 11030. In some embodiments, mat 11030 may lie partially in well 11070 after being folded over medial region 11040. As in the method discussed above in regard to FIG. 82, caregiver 11140 may then care for, nurse, or feed baby 11120.

The invention has now been described in detail for purposes of clarity and understanding. However, it will be appreciated that certain changes and modifications may be practiced within the scope of the appended claims. For example, it will be appreciated that other variations of the suspension system are possible. For instance, only a single bar could be used. Further, one end of the bar may be suspended above the pillow. Additionally, pockets or other utilitarian features may be incorporated into the cover to allow storage of baby care and food products. Furthermore, toys or other entertainment devices may be attached to various portions of any of the above described embodiments (i.e. the cushion body, the cover or the mat) for use by a caregiver, or baby itself, to entertain a baby.

What is claimed is:

1. A support pillow comprising:

a cushion body having a medial region and two opposing arms that define a generally open well, the cushion body comprising a shell and a fill material within the shell;

a cover removably disposed over the shell of the cushion body such that the cover conforms generally to the shape of the cushion body; and a mat detachably coupled with the cover;

wherein the cover comprises a seam that defines an opening to permit the cover to be removably disposed over the shell of the cushion body, and wherein the cover includes at least one fastener coupled to the seam to close the seam once the cover has been placed over the cushion body.

2. The support pillow of claim 1, wherein the mat is coupled with the cover beneath the medial region.

3. The support pillow of claim 1, wherein at least one of the cover and the mat comprises a fastener, and wherein the fastener couples the mat with the cover.

4. The support pillow of claim 3, wherein the fastener is selected from a group of fasteners consisting of zippers, ties, buttons, buckles, a hook and loop fastener material, snaps, reversible pockets and hooks.

5. The support pillow of claim 1, wherein each of the two arms terminates in an end, and wherein the cover further comprises a pair of ties coupled to the cover so as to be positioned at the ends of the arms, whereby the arms may be pulled together by tying the ties.

6. A method of using a support pillow, wherein the method comprises:

providing a support pillow comprising a cushion body having a medial region and two opposing arms that define a generally open well, the cushion body comprising a shell and a fill material within the shell; a cover removably disposed over the shell of the cushion body such that the cover conforms generally to the shape of the cushion body, wherein the cover further defines an opening to permit the cover to be removably disposed over the shell of the cushion body; and a mat coupled with the cover along the opening;

placing the support pillow onto a surface;

positioning the mat to lie generally flat underneath the cushion body and the well; and placing a baby at least partially in the well.

7. The method of using a support pillow of claim 6, wherein placing the baby in the well comprises placing the baby such that at least a portion of the baby's back is generally facing the mat.

8. The method of using a support pillow of claim 6, wherein placing the baby in the well comprises placing the baby such that at least a portion of the baby's back is generally facing away from the mat.

9. A method of using a support pillow, wherein the method comprises:

providing a support pillow comprising a cushion body having a medial region and two opposing arms that define a generally open well, the cushion body comprising a shell and a fill material within the shell; a cover removably disposed over the shell of the cushion body such that the cover conforms generally to the shape of the cushion body; and a mat coupled with the cover;

placing the support pillow onto a surface;

positioning the mat to lie generally flat on the surface and to extend away from the well without crossing the well; and placing a baby at least partially on the mat such that at least one of the baby's head or the baby's torso are supported by the cushion body.

10. The method of using a support pillow of claim 9, wherein placing the baby partially on the mat comprises Placing the baby such that at least a portion of the baby's back is generally facing the mat.

11. The method of using a support pillow of claim 9, wherein placing the baby partially on the mat comprises placing the baby such that at least a portion of the baby's back is generally facing away from the mat.

12. A method of using a support pillow, wherein the method comprises:

providing a support pillow comprising a cushion body having a medial region and two opposing arms that define a generally open well, the cushion body comprising a shell and a fill material within the shell; a cover removably disposed over the shell of the cushion body such that the cover conforms generally to the shape of the cushion body; and a mat coupled with the cover;

placing the cushion body on the lap of a caregiver, wherein the waist or lower torso of the caregiver is at least partially within the well, and wherein the medial region is on the lap of the caregiver;

placing a baby at least partially above the medial region such that at least a portion of the baby's back is generally facing the medial region.

13. The method of using a support pillow of claim 12, wherein the method further comprises:

positioning the baby such that the caregiver may nurse the baby; and nursing the baby.

14. The method of using a support pillow of claim 12, further comprising positioning the caregiver's arm between the baby's head and the support pillow.

15. The method of using a support pillow of claim 12, wherein the method further comprises:

positioning the mat to lie at least partially above the cushion body; and placing a baby at least partially on top of the mat.

16. The method of using a support pillow of claim 15, wherein the method further comprises positioning the mat to lie at least partially in the well.

17. The method of using a support pillow of claim 15, further comprising positioning the caregiver's arm between the baby's head and the support pillow.

18. The method of using a support pillow of claim 15, wherein the method further comprises:

positioning the baby such that the caregiver may nurse the baby; and nursing the baby.

19. A support pillow comprising:

a cushion body having a medial region and two opposing arms that define a generally open well, the cushion body comprising a shell and a fill material within the shell;

a cover removably disposed over the shell of the cushion body such that the cover conforms generally to the shape of the cushion body; and a mat coupled with the cover;

wherein the cover defines an opening to permit the cover to be removably disposed over the shell of the cushion body, wherein the opening is disposed across a face of the medial region, and wherein mat is coupled to the cover along an edge of the opening.

20. A support pillow comprising:

a cushion body having a medial region and two opposing arms that define a generally open well, the cushion body comprising a shell and a fill material within the shell;

a cover removably disposed over the shell of the cushion body such that the cover conforms generally to the shape of the cushion body; and a mat coupled with the cover;

wherein each of the two arms terminates in an end, and wherein the cover further comprises a pair of ties coupled to the cover so as to be positioned at the ends of the arms, whereby the arms may be pulled together by tying the ties.

* * * * *

UNITED STATES PATENT AND TRADEMARK OFFICE

CERTIFICATE OF CORRECTION

PATENT NO. : 7,624,461 B2
APPLICATION NO. : 11/623645
DATED : December 1, 2009
INVENTOR(S) : Kristin A. Tidwell et al.

It is certified that error appears in the above-identified patent and that said Letters Patent is hereby corrected as shown below:

At Col. 27, line 60 please replace [[Placing]] with --placing--

Signed and Sealed this

Twenty-sixth Day of January, 2010

David J. Kappos

David J. Kappos
*Director of the United States Patent and Trademark Office*